US005841416A

United States Patent [19]

Mano et al.

[11] Patent Number: 5,841,416

[45] Date of Patent: Nov. 24, 1998

[54] METHOD OF AND APPARATUS FOR DRIVING LIQUID-CRYSTAL DISPLAY DEVICE

[75] Inventors: Hiroyuki Mano, Chigasaki; Tatsuhiro Inuzuka; Satoshi Konuma, both of Yokohama; Toshio Futami; Kohji Takahashi, both of Mobara, all of Japan

[73] Assignees: Hitachi, Ltd., Tokyo; Hitachi Video & Information System, Inc., Yokohama, both of Japan

[21] Appl. No.: 862,509

[22] Filed: Apr. 2, 1992

[30] Foreign Application Priority Data

Apr. 2, 1991 [JP] Japan ..... 3-069869
Nov. 13, 1991 [JP] Japan ..... 3-297387

[51] Int. Cl.[6] ..... G09G 3/36

[52] U.S. Cl. ..... 345/94; 345/208

[58] Field of Search ..... 340/784, 765, 340/805; 359/54, 55; 345/87, 94, 95, 97, 208, 210; 349/33, 34, 41

[56] References Cited

U.S. PATENT DOCUMENTS 4,679,043 7/1987 Morokawa ..... 345/103
4,745,485 5/1988 Iwasaki ..... 340/784
4,816,816 3/1989 Urui ..... 340/765
5,175,535 12/1992 Yamazaki ..... 340/784
5,179,371 1/1993 Yamagaki ..... 340/805
5,307,084 4/1994 Yamaguchi et al. ..... 345/87

FOREIGN PATENT DOCUMENTS 2-6921 7/1990 Japan .
2-250030 4/1991 Japan .
3-126986 5/1992 Japan .

*Primary Examiner*—Dennis-Doon Chow
*Attorney, Agent, or Firm*—Antonelli, Terry, Stout & Kraus, LLP

[57] ABSTRACT

A liquid-crystal display device of a simple matrix type is permitted to present a liquid-crystal display of good display quality free from nonuniformity in display brightness. A method of driving a liquid-crystal display device wherein voltages which correspond to potential differences between scanning voltages from a Y drive circuit and display voltages from an X drive circuit are applied to liquid-crystal cells at intersection points between scanning electrodes (Y electrodes) and data electrodes (X electrodes), thereby presenting a display conforming to display data comprises the steps of providing a correction time period for correcting the display voltage to be output from the X drive circuit at least once every scanning period of one line, and outputting a correction voltage at a voltage level which is intermediate between a voltage level in an ON-display state and a voltage level in an OFF-display state instead of the display voltage from the X drive circuit within the correction time period.

26 Claims, 69 Drawing Sheets

FIG. 18

| DISPLAY DATA 5 | | | | 'ON' DECODE OUTPUTS 63 | | | NUMBER OF 'ON' DISPLAYS (DECIMAL) |
|---|---|---|---|---|---|---|---|
| D3 | D2 | D1 | D0 | O2 | O1 | O0 | |
| 0 | 0 | 0 | 0 | 0 | 0 | 0 | 0 |
| 0 | 0 | 0 | 1 | 0 | 0 | 1 | 1 |
| 0 | 0 | 1 | 0 | 0 | 0 | 1 | 1 |
| 0 | 0 | 1 | 1 | 0 | 1 | 0 | 2 |
| 0 | 1 | 0 | 0 | 0 | 0 | 1 | 1 |
| 0 | 1 | 0 | 1 | 0 | 1 | 0 | 2 |
| 0 | 1 | 1 | 0 | 0 | 1 | 0 | 2 |
| 0 | 1 | 1 | 1 | 0 | 1 | 1 | 3 |
| 1 | 0 | 0 | 0 | 0 | 0 | 1 | 1 |
| 1 | 0 | 0 | 1 | 0 | 1 | 0 | 2 |
| 1 | 0 | 1 | 0 | 0 | 1 | 0 | 2 |
| 1 | 0 | 1 | 1 | 0 | 1 | 1 | 3 |
| 1 | 1 | 0 | 0 | 0 | 1 | 0 | 2 |
| 1 | 1 | 0 | 1 | 0 | 1 | 1 | 3 |
| 1 | 1 | 1 | 0 | 0 | 1 | 1 | 3 |
| 1 | 1 | 1 | 1 | 1 | 0 | 0 | 4 |

FIG. 19

| "ON" NUMBER - "OFF" NUMBER | DECODE VALUE 60 FOR "ON" DISPLAY | DURATION | DECODE VALUE 80 FOR "OFF" DISPLAY | DURATION |
|---|---|---|---|---|
| 640 ~ 321 | 139 | 20 | 129 | 30 |
| 320 ~ 11 | 134 | 25 | 129 | 30 |
| 10 ~ -11 | 129 | 30 | 129 | 30 |
| -11 ~ -320 | 124 | 35 | 129 | 30 |
| -321 ~ -640 | 117 | 40 | 129 | 30 |

| LINE CLOCK CL I | L | H |
|---|---|---|
| INPUT M | H → L OR L → H | —— |
| OUTPUT | L → H | L |

METHOD OF AND APPARATUS FOR DRIVING LIQUID-CRYSTAL DISPLAY DEVICE

BACKGROUND OF THE INVENTION

The present invention relates to a liquid-crystal display device which is an element having, at least, a substrate formed with scanning electrodes, a substrate formed with signal electrodes, and a dielectric liquid crystal or any other dielectric sandwiched in between both the substrates. More particularly, it relates, in a matrix type liquid-crystal display device, to a method of and an apparatus for driving the liquid-crystal display device which can relieve nonuniformity in display brightness so as to present a display of high quality.

With a conventional liquid-crystal display device, voltages are applied to a liquid crystal by a time-division driving method. The construction and operation of the device are disclosed in, for example, the official gazette of Japanese Patent Application Laid-open No. 250030/1990. Such a liquid-crystal display device in the prior art will be explained with reference to FIGS. 71–73 of the accompanying drawings.

FIG. 71 is a block diagram showing the prior-art liquid-crystal display device. Referring to the figure, a matrix type liquid-crystal display panel 1 (herein-below, termed "liquid-crystal panel 1") presents a display in such a way that the state of the liquid crystal at each display dot is changed by the difference between the output potentials of an X driver 2 and a Y driver 3. The X driver 2 switchingly delivers output supply voltages from a power source circuit 157 to the liquid-crystal panel 1 in accordance with display data and control signals, while the Y driver 3 does so in accordance with the control signals.

FIG. 72 shows the internal arrangement diagram of the prior-art liquid-crystal display device, especially the power source circuit 157. The output voltages V1, V6, V3, V4, V5 and V2 of the power source circuit 157 have the relationship of V1>V6>V3>V4>V5>V2. The X driver 2 is fed with the voltages V1, V3, V4 and V2, while the Y driver 3 is fed with the voltages V1, V6, V5 and V2. Supposing now that a line corresponding to the output Y2 of the Y driver 3 is selected (for scanning) with out of the outputs (X1–Xm) of the X driver 2 and the output Y2 of those (Y1–Yn) of the Y driver 3 shown in the FIG. 73, the waveforms of applied voltages to the liquid crystal in the prior art are as shown in the figure. This figure corresponds to a case where lines (horizontal lines) of display dots are alternately held in a display ON state and a display OFF state over the whole display screen of the liquid-crystal panel 1.

With the prior-art liquid-crystal display device, in general, the waveforms of the applied voltages to the liquid crystal are distorted from the ideal waveforms of liquid crystal driving voltages depending upon the impedances of the liquid crystal and circuits such as wiring lines as illustrated in FIG. 73. More specifically, the distortion magnitudes of the waveforms of the applied voltages to the liquid crystal vary at the ON/OFF and OFF/ON transition points of the display data and the transition points of an alternation signal M. As the distortion of waveform becomes greater, the effective value of the applied voltage decreases more. Therefore, the rate of decrease of the effective value is higher for a data electrode which is undergoing a larger number of ON/OFF transitions, whereas the rate of the decrease of the effective value is lower as to a data electrode undergoing a smaller number of times of ON/OFF changes.

As a result, non-uniformity in display brightness (shadowing) arises depending upon display patterns.

In addition, voltage fluctuations are electrically induced on the output (Y1–Yn) wiring lines of the Y driver 3 intersecting orthogonally to the output (X1–Xm) wiring lines of the X driver 2, through the capacitive property of the liquid crystal layer, at transition points of the voltage waveforms of the display data and the alternation signal M at the outputs (X1–Xm) of the X driver 2. Consequently, the distortion magnitudes of the waveforms of the applied voltages to the liquid crystal vary, and the effective values of the applied voltages of the liquid crystal vary.

In this manner, the distortion magnitudes of the waveforms of the applied voltages to the liquid crystal, in other words, the effective values of the applied voltages of the liquid crystal vary depending upon the display patterns, so that differences in the display brightness appear on the display screen of the liquid crystal giving rise to the non-uniformity in the display brightness.

Meanwhile, as regards a liquid-crystal display device having a liquid-crystal display panel of a simple matrix shape, a technique for relieving nonuniformity in display brightness dependent upon display patterns is disclosed in, for example, the official gazette of Japanese Patent Application Laid-open No. 6921/1990. The prior-art technique provides, in a drive system for a liquid-crystal display wherein the display is presented in such a way that voltages corresponding to the differences between a scanning voltage from a Y drive circuit and data voltages from an X drive circuit are applied to liquid-crystal cells located at the intersection points between scanning electrodes (hereinbelow, called "Y electrodes") and data electrodes (hereinbelow, called "X electrodes"), a time period for which the applied voltages (difference voltages) to the liquid-crystal cells become 0 [V] within every line scanning period, while presenting the display according to display data. Now, this system will be explained in more detail with reference to the drawings.

FIG. 65 shows the block diagram of the liquid-crystal display device in the prior art. Referring to the figure, the display device includes a liquid-crystal panel 1, an X drive circuit 2 for driving a column side realized in this case by a product "HD66107T" manufactured by Hitachi, Ltd., a Y drive circuit 3 for driving a row side as represented by the same product, and a monostable multivibrator 4. Numeral 5 indicates display data, which is parallel data items of 4 dots or 8 dots in an example employing the aforementioned product as the X drive circuit 2. For brevity of the explanation, however, the display data 5 shall be explained as serial data here. Numeral 6 denotes a data latch clock, numeral 7 a line clock, numeral 8 an alternation signal, numeral 9 a head line clock, and numeral 10 an enable signal. Further, numerals 11–16 denote supply voltages for driving the liquid crystal of the display device. The X drive circuit 2 is fed with the serial display data items 5 corresponding to the electrodes of one scanning and the data latch clock pulses 6 corresponding thereto. Thus, when the display data items 5 have been shifted in and have been accumulated in correspondence with the electrodes of one scanning, the line clock pulse 7 is impressed on the X drive circuit 2, and the accumulated display data items 5 are loaded on the output side of the X drive circuit 2.

Then, from among the 4 levels of liquid-crystal driving supply voltages which consist of the V1 voltage 11, the V3 voltage 13, the V4 voltage 14 and the V2 voltage 16, any voltages are selected for the respective data electrodes in accordance with the combinations between the loaded display data items 5 and the alternation signal 8. In this way, X drive voltages corresponding to the electrodes of one scanning are applied to the X electrodes Vx1–Vxi in parallel.

On the other hand, the Y drive circuit 3 accepts the head line clock 9 in response to the line clock 7, thereby selecting a head line in the first place. Thenceforth, lines to be selected are sequentially shifted in accordance with the line clock 7. Herein, from among the 4 levels of liquid-crystal driving supply voltages which consist of the V1 voltage 11, the V6 voltage 12, the V5 voltage 15 and the V2 voltage 16, any voltages are selected in accordance with the combinations between the alternation signal 8 and a scanning signal for the sequential line selection operations, and they are applied to the selected lines corresponding to the Y electrodes Vy1–Vyj.

Besides, the monostable multivibrator 4 is triggered by the line clock 7 and supplies the X drive circuit 2 and Y drive circuit 3 with the enable signal 10 having a duration shorter than one line scanning period. The X drive circuit 2 and Y drive circuit 3 respond to the enable signal 10 applied from the monostable multivibrator 4, to deliver 0 [V] when this signal is "0" and to deliver the voltages of the selected levels when it is "1".

FIGS. 67 and 68 are diagrams showing the operations of the X drive circuit 2 and Y drive circuit 3, respectively. FIG. 67 illustrates the states of the output voltages Vx which the X drive circuit 2 delivers under its operation according to the alternation signal, enable signal and display data, while FIG. 68 illustrates the states of the output voltages Vy which the Y drive circuit 3 delivers under its operation according to the alternation signal, enable signal and scanning signal.

Incidentally, the liquid-crystal driving voltages of 6 levels (V1–V6) are generated in such a way that, as illustrated in FIG. 66, an external supply voltage V0 indicated at numeral 17 is divided by resistors R1–R5. When the liquid-crystal display device is driven by a time-division drive system stated in "Liquid-crystal Device Handbook" (issued on Sep. 29, 1989 by Nikkan Kogyo Shinbun-sha, First Edition, First Print), p. 395, the voltage dividing resistors have the following relations of resistances:

$$R1=R2=R4=R5=R$$

$$R3=(a-4)R$$

where "a" denotes a bias ratio.

The 6 levels of liquid-crystal driving voltage are related as follows:

$$V1>V6>V3>V4>V5>V2$$

$$V1-V6=V6-V3=V4-V5=V5-V2$$

Next, voltages which are applied to the liquid-crystal cells of the prior-art display device will be explained with reference to FIG. 70 by taking a display pattern in FIG. 69 as an example.

In the display pattern shown in FIG. 69, all the liquid-crystal cells located at the intersection points between the X electrode Vx1 and the Y electrodes Vy1–Vy4 are ON display cells indicated by black spots (including the liquid-crystal cell A). Besides, the liquid-crystal cells located at the intersection points between the X electrode Vx2 and the Y electrodes Vy1–Vy4 are in a pattern in which ON display cells (including the liquid-crystal cell B) indicated by black spots and OFF display cells indicated by white spots are alternately arranged.

When the display pattern is presented by driving the display device with the alternation signal of frame alternation 8 whose polarity is inverted every frame, the voltages applied to the liquid-crystal cells A and B are as depicted in FIG. 70. More specifically, since the liquid-crystal cell A is located between the Y electrode Vy1 and the X electrode Vx1, the voltage VA applied to this cell is given by the potential difference (Vy1–Vx1) between the applied voltage of the electrode Vy1 and that of the electrode Vx1. Likewise, since the liquid-crystal cell B is located between the Y electrode Vy1 and the X electrode Vx2, the voltage VB applied to this cell is given by the potential difference (Vy1–Vx2) between the applied voltage of the electrode Vy1 and that of the electrode Vx2.

As seen from FIG. 70, the time periods of 0 [V] are set for the applied voltages of the individual X and Y electrodes in accordance with the enable signal 10, so that the applied voltages VA and VB of the respective liquid-crystal cells A and B are also formed with the time periods of 0 [V].

According to this system, the numbers of times which the respective applied voltages VA and VB fall from the designated voltages to 0 [V] and rise from 0 [V] back to the designated voltages equalize irrespective of display patterns. Accordingly, the dispersion in the effective values of the applied voltages of the liquid-crystal cells dependent upon the display patterns is relieved.

However, when the output voltages from the X drive circuit 2 and Y drive circuit 3 are brought to 0 [V] on the basis of the enable signal, the magnitudes of distortion of the waveforms at the respective X electrodes still differ depending upon the display patterns for the reasons that the levels of the voltages are unequal and that the OFF/ON transition and the ON/OFF transition characteristics (transient characteristics) of the liquid-crystal panel may be unequal. By way of example, when the V2 voltage 16 is rendered 0 [V], almost no distorted waveform is involved (in general, the V2 voltage is 0 [V]), and when the V1 voltage 11 of the highest level is rendered 0 [V], the waveform distortion is great. On account of the differences of the magnitudes of distortion of the voltage waveforms, the effective values of the applied voltages still disperse to some extent dependent upon the liquid-crystal display patterns.

Moreover, as briefly stated above, the great changes of the applied voltages incur a so-called "crosstalk", which forms an obstacle to enhancement in the display quality of the liquid-crystal display device. By way of example, in a case where the driving capability of the Y drive circuit is low, there is the problem that the output changes of the X drive circuit distort the output of the Y drive circuit through the liquid crystal. This problem will be more specifically explained below.

FIG. 14 shows an example wherein all the outputs Vx of the X drive circuit 2 rise at a point "a" and fall at a point "b" and wherein the outputs Vx rise and fall in equal numbers at a point "c". Regarding such points, the output operation of the X drive circuit 2 distorts the output of the Y drive circuit 3 upwards at the point "a" and downwards at the point "b" through the liquid crystal. In contrast, it hardly distorts the Y output at the point "c". That is, the distortion of the output of the Y drive circuit 3 differs depending upon the display states of all the X electrodes corresponding to one scanning (differences in the numbers of the rising and falling outputs of the X drive circuit 2 during the correction time periods). Also this fact gives rise to nonuniformity in the display brightness.

SUMMARY OF THE INVENTION

The present invention has for its object the provision of a method of and an apparatus for driving a liquid-crystal display device in which a dispersion in the effective values of applied voltages to a liquid crystal which depends upon display patterns is further reduced to enhance the display quality of the device.

According to the present invention, there is provided a method of driving a liquid-crystal display device wherein voltages which correspond to potential differences between scanning voltages from a Y drive circuit and display voltages from an X drive circuit are applied to liquid-crystal cells at intersection points between scanning electrodes (Y electrodes) and data electrodes (X electrodes), thereby presenting a display conforming to display data, comprising the steps of providing a correction time period for correcting the display voltage to be output from the X drive circuit at least once every scanning period of one line, and outputting a correction voltage at a voltage level which is intermediate between a voltage level in an ON-display state and a voltage level in an OFF-display state instead of the display voltage from the X drive circuit within said correction time period.

According to another aspect of the invention, there is provided a method of driving a liquid-crystal display device wherein voltages which correspond to potential differences between scanning voltages from a Y drive circuit and display voltages from an X drive circuit are applied to liquid-crystal cells at intersection points between scanning electrodes (Y electrodes) and data electrodes (X electrodes), thereby presenting a display conforming to display data, the method comprising the steps of providing a correction time period for correcting the display voltage to be output from the X drive circuit at least once every scanning period of one frame, determining either of a magnitude and an application duration of a correction voltage to be applied to the corresponding data electrode in accordance with contents of the display data items which are to be bestowed on the respective data electrodes within the scanning period of one frame, and outputting this correction voltage instead of the display voltage from the X drive circuit to the each data electrode within the correction time period.

Besides, there is provided an apparatus for driving a liquid-crystal display device wherein voltages are applied to liquid-crystal cells at intersection points between scanning electrodes (Y electrodes) and data electrodes (X electrodes), thereby presenting a display conforming to display data, comprising scanning-electrode drive means operating every predetermined scanning period of one line for sequentially selecting any of the scanning electrodes and applying a scanning voltage thereto, and for applying a non-scanning voltage to the other scanning electrodes not selected at that time; data-electrode drive means for applying display voltages to the data electrodes, the display voltages corresponding to contents of the display data items as are externally input; and voltage control means for applying a correction voltage to the each data electrode instead of the display voltage to be output from the X drive circuit, within a preset correction time period each time the each scanning electrode is selected by the scanning-electrode drive means, said correction voltage being at a voltage level which is intermediate between a voltage level in an ON-display state and a voltage level in an OFF-display state.

In an apparatus for driving a liquid-crystal display device wherein voltages are applied to liquid-crystal cells at intersection points between scanning electrodes (Y electrodes) and data electrodes (X electrodes), thereby presenting a display conforming to display data; another apparatus for driving a liquid-crystal display device according to the present invention consists in comprising a frame memory in which the display data items corresponding to one frame are stored; scanning-electrode drive means operating every predetermined scanning period of one line for sequentially selecting any of the scanning electrodes and applying a scanning voltage thereto, for applying a non-scanning voltage to the other scanning electrodes not selected at that time, and for applying the non-scanning voltage to each scanning electrode in a correction time period which is set after scanning of the one frame; data-electrode drive means for applying display voltages to the data electrodes, the display voltages corresponding to contents of the display data items which are input from the frame memory; arithmetic means for calculating either of a magnitude and an application duration of a correction voltage to be applied to the corresponding data electrode in the correction time period in accordance with the contents of the display data items which are to be bestowed on the respective data electrodes within the scanning period of one frame; and voltage control means for outputting the correction voltage instead of the display voltage to the each data electrode within the correction time period.

Now, the operations of the typical constructions of the present invention will be described.

A correction time period is provided at least once every scanning period of one line in order that the number of transitions of the applied voltages of X electrodes within the scanning period of one frame may be held constant irrespective of the contents of display data items. According to the present invention, in order to reduce the differences of the distortion of the voltage waveforms of the applied voltages of the individual electrodes dependent upon the contents of the display data items, the further expedient is performed that a correction voltage at a voltage level which is intermediate between a voltage level in an ON-display state and a voltage level in an OFF-display state is output instead of a display voltage to be delivered from an X drive circuit, within the correction time period. Therefore, a dispersion in the effective values of applied voltages to a liquid crystal can be relieved still more.

The voltages which are applied to liquid-crystal cells are the voltage differences between the applied voltages of Y electrodes and those of the X electrodes. In order to bring the applied voltage of each liquid-crystal cell to 0 [V] in the correction time period, the applied voltage of the Y electrode and that of the X electrode may be equalized. In one aspect of the present invention, the control of the applied voltage of the Y electrode in the correction time period is done away with, and the applied voltage of the X electrode is set at the same level as that of the applied voltage of the Y electrode in the correction time period. Consequently, as regards the applied voltages of the X electrodes, voltage values fluctuating in such correction time periods become constant irrespective of the voltage levels based on the display data items, and the differences of the distorted waveforms of the applied voltages of the X electrodes in the correction time periods which depend upon the display data items decrease, so that the dispersion in the effective values of the voltages to be applied to the liquid-crystal cells can also be reduced.

From a different viewpoint, for the purpose of reducing the dispersion of the effective values of the voltages to be applied to the liquid-crystal cells which depends upon display patterns, the number of transitions in the applied voltages which are caused by switching the ON-display state and OFF-display state of each display pattern may be held constant irrespective of the display patterns. It is accordingly considered that the voltage to be applied to each liquid-crystal cell in the correction time period every line scanning period need not be especially set at 0 [V], but that it may be set at the correction voltage which prevents the effective values of the applied voltages from dispersing. In another aspect of the present invention, therefore, the voltage level to which the level of the display voltage is changed-over in the correction time period by a voltage selector is set at a voltage level which is close to the level of the applied voltage of the Y electrode and which prevents the dispersion of the effective values of the applied voltages, unlike the above aspect in which the correction voltage level is set to be identical to the level of the applied voltage of the Y electrode.

Further, the liquid-crystal cell acts as a capacitance, and the different transient characteristics thereof can incur some discrepancy in the effective values of voltages in non-scanning periods between when in the ON-display state and when in the OFF-display state. For the purpose of relieving the discrepancy, it is also possible to set unequal correction voltage values for the ON-display state and the OFF-display state, respectively.

Besides, a measure to be described below is taken against the problem that, in a case where the driving capability of a Y drive circuit is low, the output change of the X drive circuit in the correction time period distorts the output of the Y drive circuit through the liquid crystal. The voltage distortion of the Y drive circuit varies depending upon the difference between the number of ON-display pixels and OFF-display pixels of the display data corresponding to the scanning operation of one line. Therefore, the distortion of the output of the Y drive circuit can be corrected by counting the number of the ON-display and OFF-display pixels and then controlling the length of the correction time period on the basis of the difference between them. Further, liquid-crystal display devices in each of which the number of display lines is as comparatively large as 400, 480 or 780 are so constructed as to present two divided picture frames. With regard to these devices, the distortion of the output of the Y drive circuitry can be corrected by a similar expedient.

More specifically, in general, the Y drive circuitry of the liquid-crystal display device constructed so as to present the two, upper and lower frames can be broadly classified into two structural schemes. One of the schemes is such that the upper frame and lower frame of a liquid-crystal panel are simultaneously scanned by a single Y drive circuit. Herein, the number of display dots which are scanned per Y drive circuit in the scanning period of one line is double the number in the case of the single-frame construction. The other scheme is such that the upper frame and lower frame of the liquid-crystal panel are respectively scanned by dedicated Y drive circuits. Herein, the number of display dots which are scanned per Y drive circuit in the scanning period of one line is equal to the number in the case of the single-frame construction. According to the present invention, the former structural scheme is dealt with by counting the number of ON-display pixels and OFF-display pixels of display data items (the display data of the upper frame plus the display data of the lower frame) which are double the in number than in the case of the single-frame construction, and then controlling the correction time period in accordance with the difference between the count values, whereby the output distortion of the single Y drive circuit is corrected. On the other hand, the latter structural scheme is dealt with similarly to the single-frame construction by counting the number of ON-display pixels and OFF-display pixels of the display data items of each of the upper and lower frames, and then controlling the correction time period in accordance with the difference between the count values, whereby the output distortion of the Y drive circuit of each of the upper and lower frames is corrected.

Incidentally, the influence of the voltage changes of the X electrodes on the voltages of the Y electrodes can be relieved by setting the waveform of the correction voltage to be triangular.

BRIEF DESCRIPTION OF THE DRAWINGS

FIG. 18 is a diagram for explaining the operation table of an ON decoder shown in FIG. 17;

FIG. 19 is a diagram for explaining the operation table of decoder circuits shown in FIG. 16;

DETAILED DESCRIPTION OF THE PREFERRED EMBODIMENT

Now, the first embodiment of the present invention will be described with reference to FIGS. 1–7.

Figure 1:
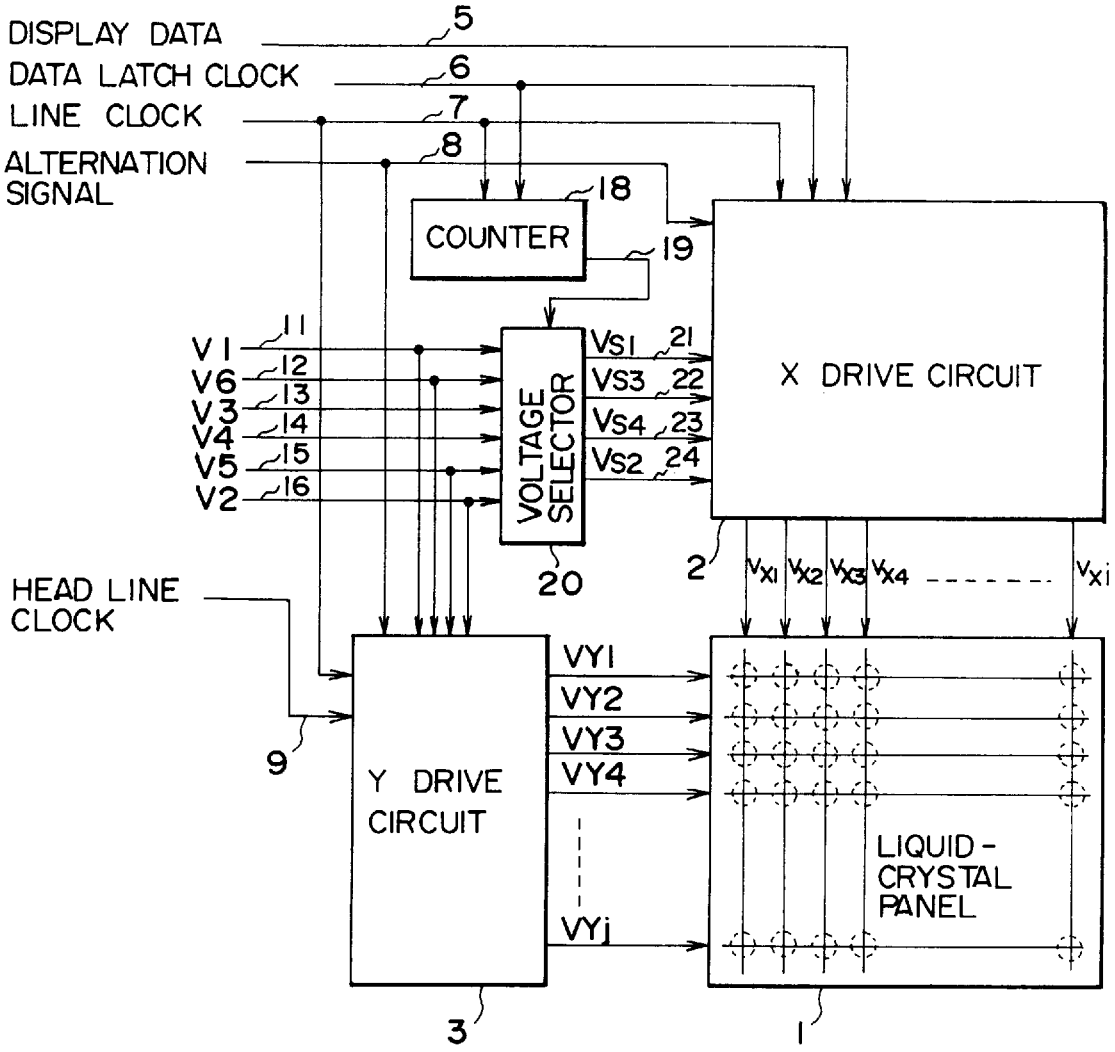
FIG. 1 is a block diagram showing the construction of a liquid-crystal display device according to the first embodiment of the present invention.
Figure 65:
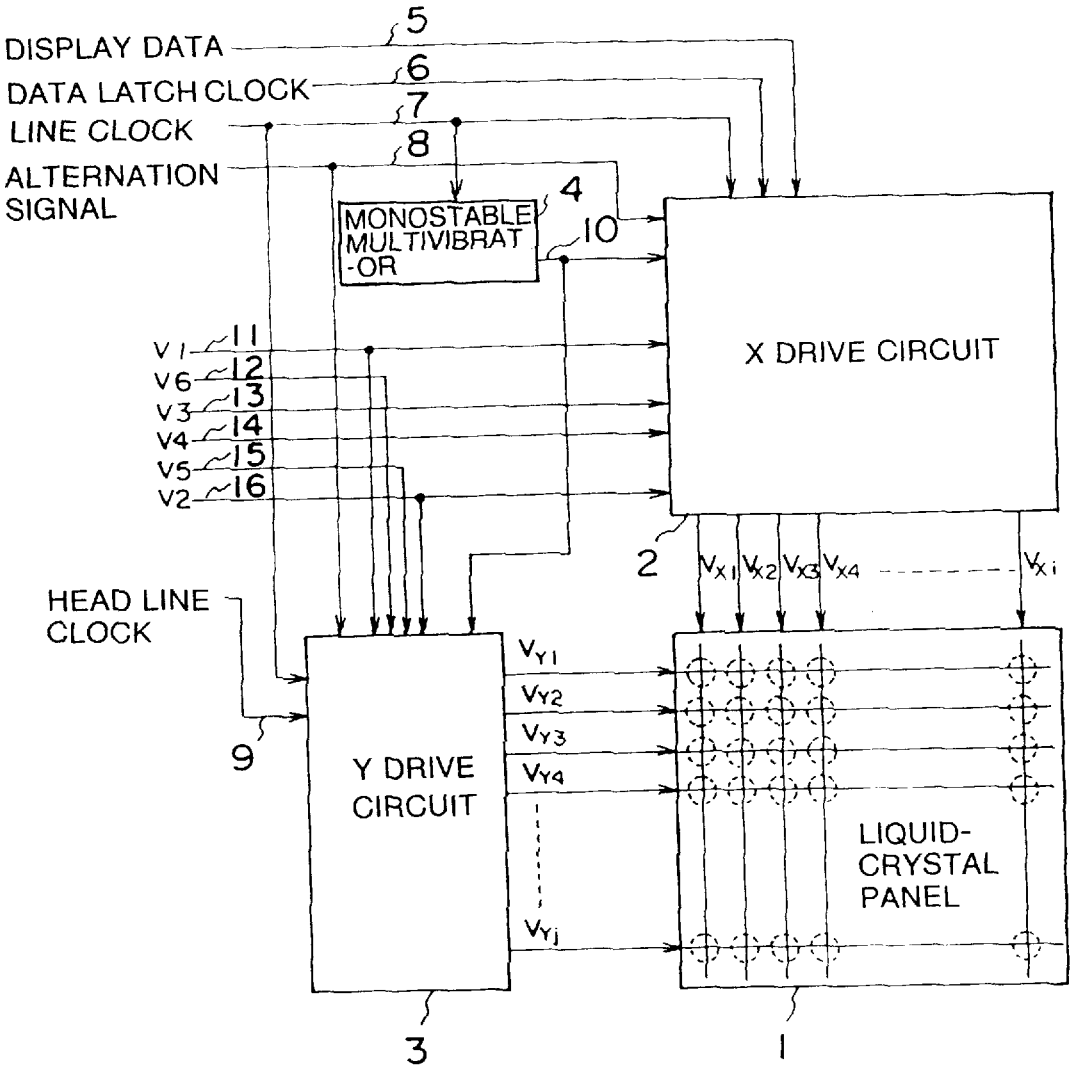
FIG.65 PRIOR ART
FIG. 65 is a block diagram showing the construction of a liquid-crystal display device in the prior art.

FIG. 1 shows the construction of a liquid-crystal display device in the embodiment of the present invention. Referring to the figure, numerals 1–3, numerals 5–9 and numerals 11–16 indicate the same constituents as explained in conjunction with FIG. 65 showing the prior-art technique. Numeral 18 indicates a counter, which is reset by the line clock 7 and which counts the pulses of the data latch clock 6 to a predetermined number, thereby generating a correction clock 19 whose duration is shorter than one scanning period. The correction clock 19 is a signal which is similar to the enable signal 10 explained with respect to the prior-art technique. Unlike the enable signal 10 in the prior art, however, the correction clock 19 is fed to only a voltage selector 20 to be farther described below, and it is not fed to either the X drive circuit 2 or the Y drive circuit 3. The voltage selector 20 selects supply voltages to be output to the X drive circuit 2, in accordance with the correction clock 19. Numerals 21–24 denote the supply voltages Vs1, Vs3, Vs4 and Vs2 which are afforded from the voltage selector 20 to the X drive circuit 2.

Figure 2A:
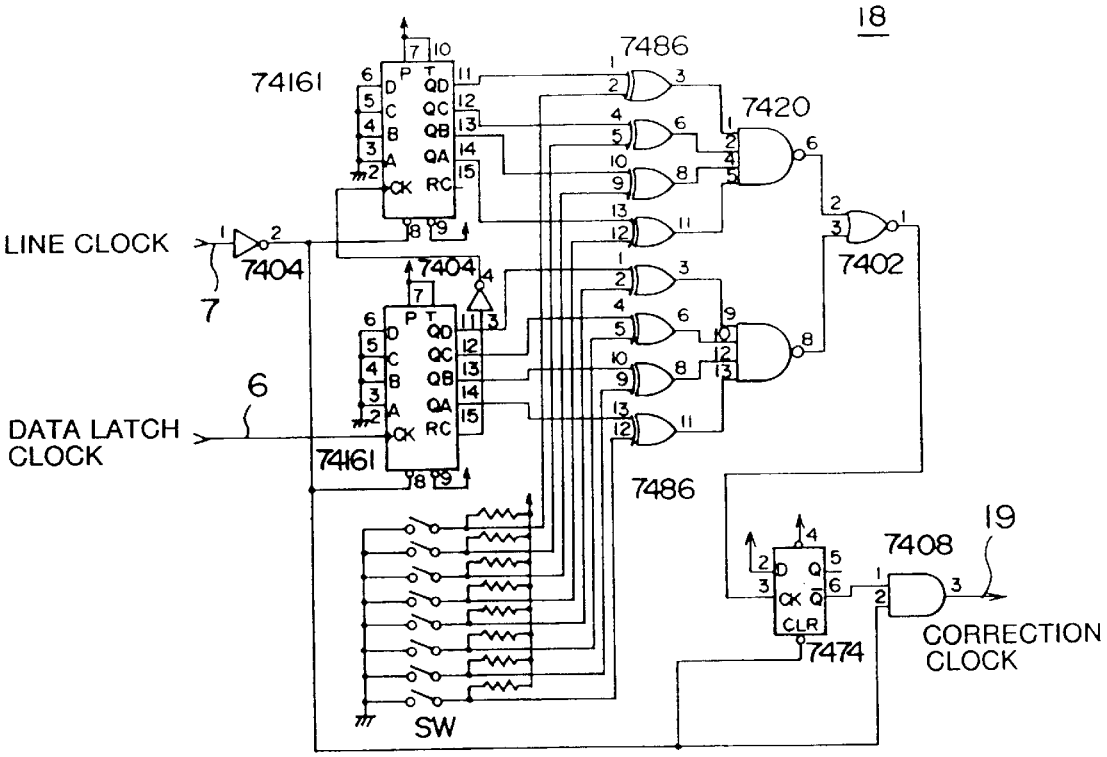
FIG. 2(*a*) is a circuit diagram showing an example of the internal arrangement of a counter (18) shown in FIG. 1, while FIG. 2(*b*) is a timing chart for explaining the operation of the counter (18)
Figure 2B:
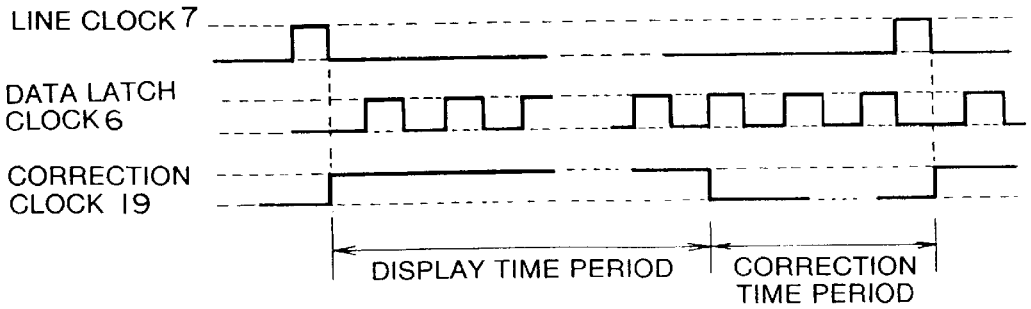

FIG. 2(*a*) shows an example of the internal arrangement of the counter 18. This counter 18 includes two 4-bit counter ICs which constitute an 8-bit counter, a group of switches SW which serve to set a target count value, and a group of gates which compare a current count value with the target count value and generate the correction clock 19 upon the coincidence of the count values. The correction clock 19 rises in synchronism with the fall of the line clock pulse 7 as illustrated in FIG. 2(*b*), and it falls after the pulses of the data latch clock 6 have been counted up to the target count value. A time period for which the correction clock 19 is "low", becomes a correction time period for which a correction pulse is produced. Although the switches SW are manually set in this embodiment, an embodiment in which signals equivalent to the outputs of the switches SW are automatically generated will be described later.

Figure 3:
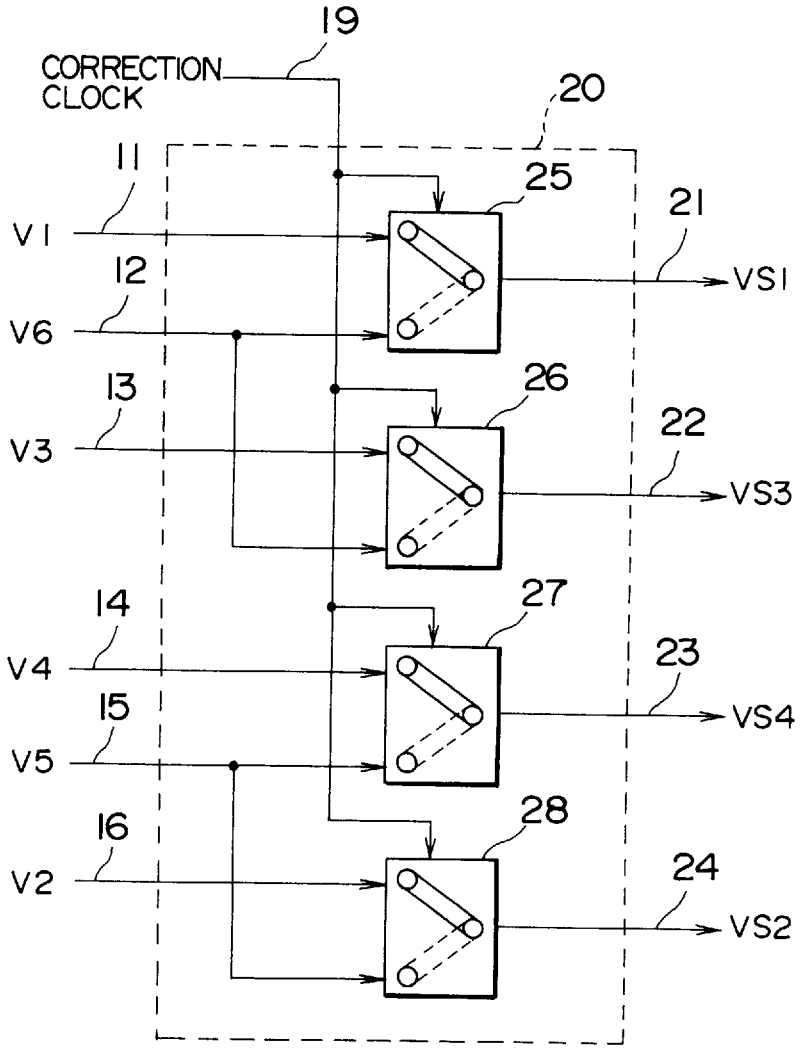
FIG. 3 is a block diagram showing the arrangement of a voltage selector (20) shown in FIG. 1.
Figure 4:
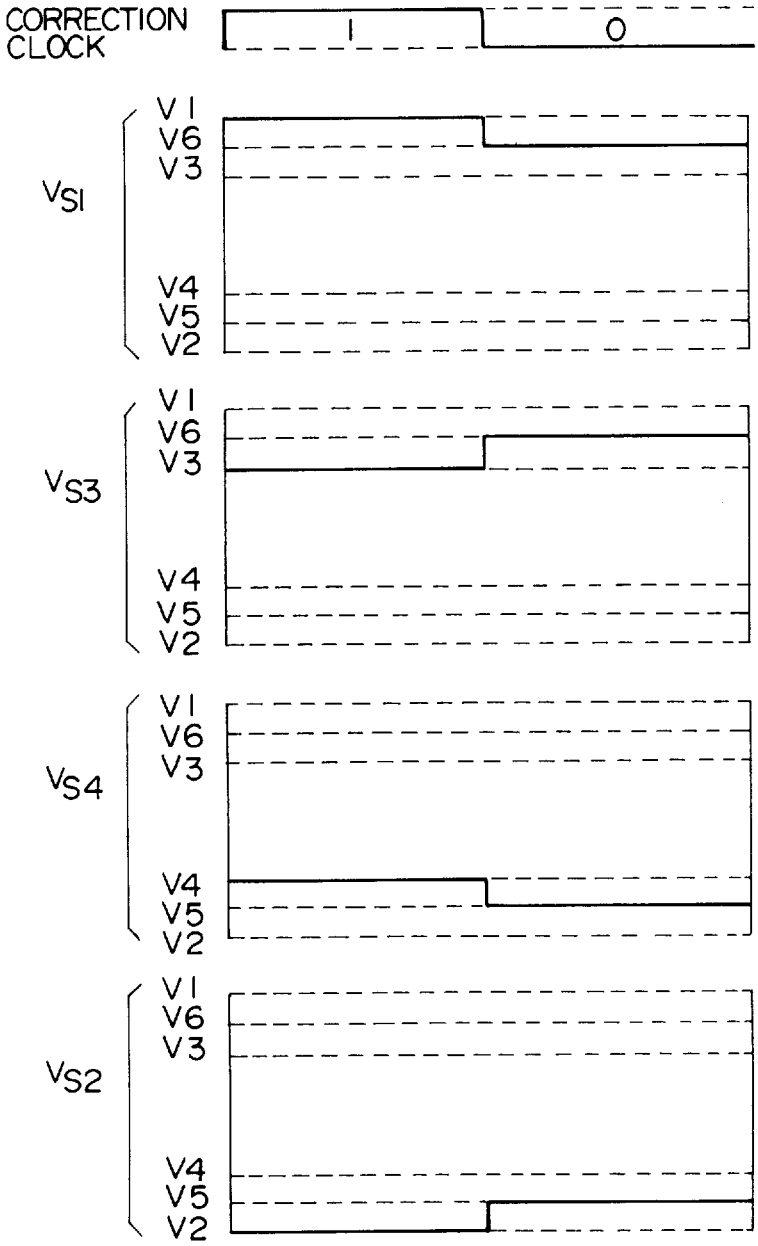
FIG. 4 is a diagram for explaining the operation of the voltage selector (20) in FIG. 3.

FIG. 3 is a block diagram showing the arrangement of the voltage selector 20. This voltage selector 20 is configured of four selector elements 25–28 which perform selection operations in accordance with the correction clock 19. As illustrated in FIG. 4 for explaining the operation of the voltage selector 20, when the correction clock 19 is "1", the selector elements 25–28 select the V1 voltage 11, V3 voltage 13, V4 voltage 14 and V2 voltage 16 and deliver them as the Vs1 voltage 21, Vs3 voltage 22, Vs4 voltage 23 and Vs2 voltage 24, respectively. In addition, when the correction clock 19 is "0", the selector elements 25 and 26 deliver the V6 voltage 12 as the Vs1 voltage 21 and Vs3 voltage 22, respectively, and the selector elements 27 and 28 deliver the V5 voltage 15 as the Vs4 voltage 23 and Vs2 voltage 24, respectively.

Figure 5:
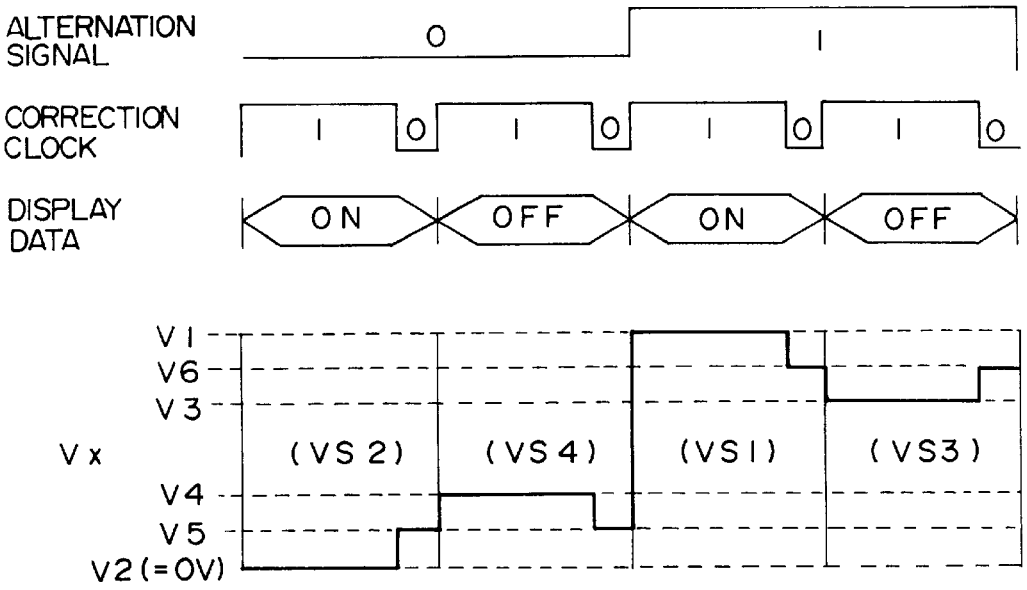
FIG. 5 is a diagram for explaining the operation of an X drive circuit in the embodiment of FIG. 1.

As illustrated in FIG. 5, when the alternation signal 8 is "0", the X drive circuit 2 selects and delivers the Vs2 voltage 24 on condition that the display data (pixel) 5 is "ON", and it selects and delivers the Vs4 voltage 23 on condition that the display data 5 is "OFF". In addition, when the alternation signal 8 is "1", the Vs1 voltage 21 is selected and delivered on condition that the display data 5 is "ON", and the Vs3 voltage 22 is selected and delivered on condition that the display data 5 is "OFF". Incidentally, with regard to each of the Vs2 voltage 24, Vs4 voltage 23, Vs1 voltage 21 and Vs3 voltage 22, one of the two voltage values is selected according to the correction clock 19 as described in conjunction with FIG. 3.

Figure 6:
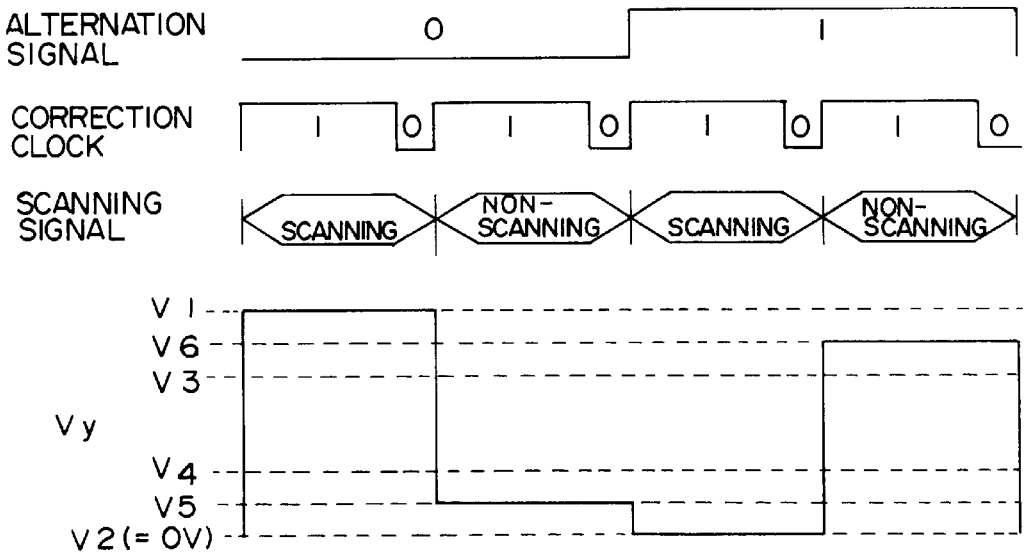
FIG. 6 is a diagram for explaining the operation of a Y drive circuit in the embodiment of FIG. 1.

On the other hand, as illustrated in FIG. 6, when the alternation signal 8 is "0", the Y drive circuit 3 selects and delivers the V1 voltage 11 on condition that the scanning signal is "scanning", and it selects and delivers the V5 voltage 15 on condition that the scanning signal is "non-scanning". In addition, when the alternation signal 8 is "1", the V2 voltage 16 is selected and delivered on condition that the scanning signal is "scanning", and the V6 voltage 12 is selected and delivered on condition that the scanning signal is "non-scanning".

Now, the operation of the liquid-crystal display device shown in FIG. 1 will be described.

The serial display data items 5 for the electrodes of one scanning are shifted in to the X drive circuit 2 in accordance with the data latch clock pulses 6 for the electrodes of one scanning. When the display data items 5 for the electrodes of one scanning have been accumulated, the X drive circuit 2 is clocked by the line clock 7, and the display data items 5 having been shifted in are loaded on the output side of the X drive circuit 2. The voltages of the predetermined levels are selected from among the liquid-crystal driving supply voltages of the four levels; the Vs1 voltage 21, Vs3 voltage 22, Vs4 voltage 23 and Vs2 voltage 24 which are supplied from the voltage selector 20, as described in conjunction with FIG. 5 on the basis of the combinations between the loaded display data items 5 and the alternation signal 8. Thus, the X drive voltages for the electrodes of one scanning (numbering "i" in the illustration) are applied to the X electrodes Vx1–Vxi in parallel.

Figure 66:
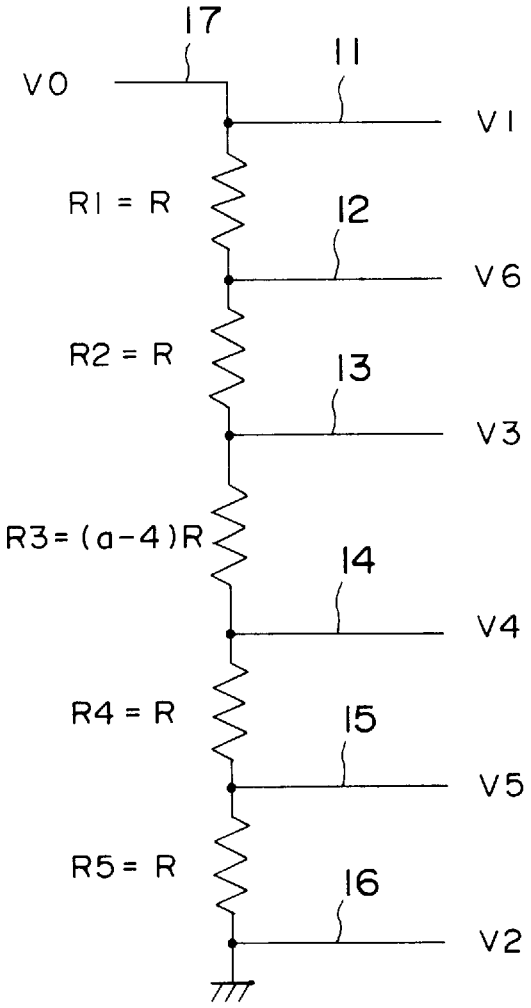
FIG. 66 PRIOR ART
FIG. 66 is a circuit diagram showing a supply voltage divider circuit in the prior art.
Figure 67:
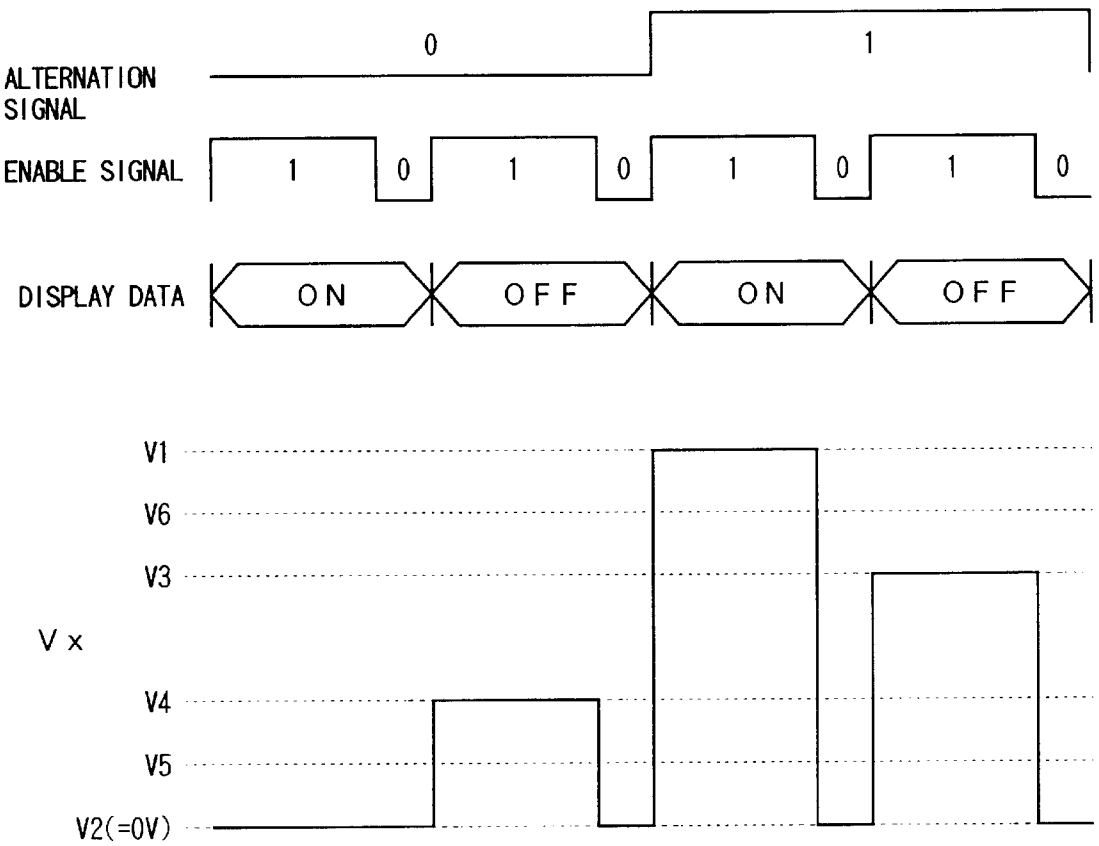
FIG. 67 PRIOR ART
FIG. 67 is a diagram for explaining the operation of an X drive circuit in the prior art.
Figure 68:
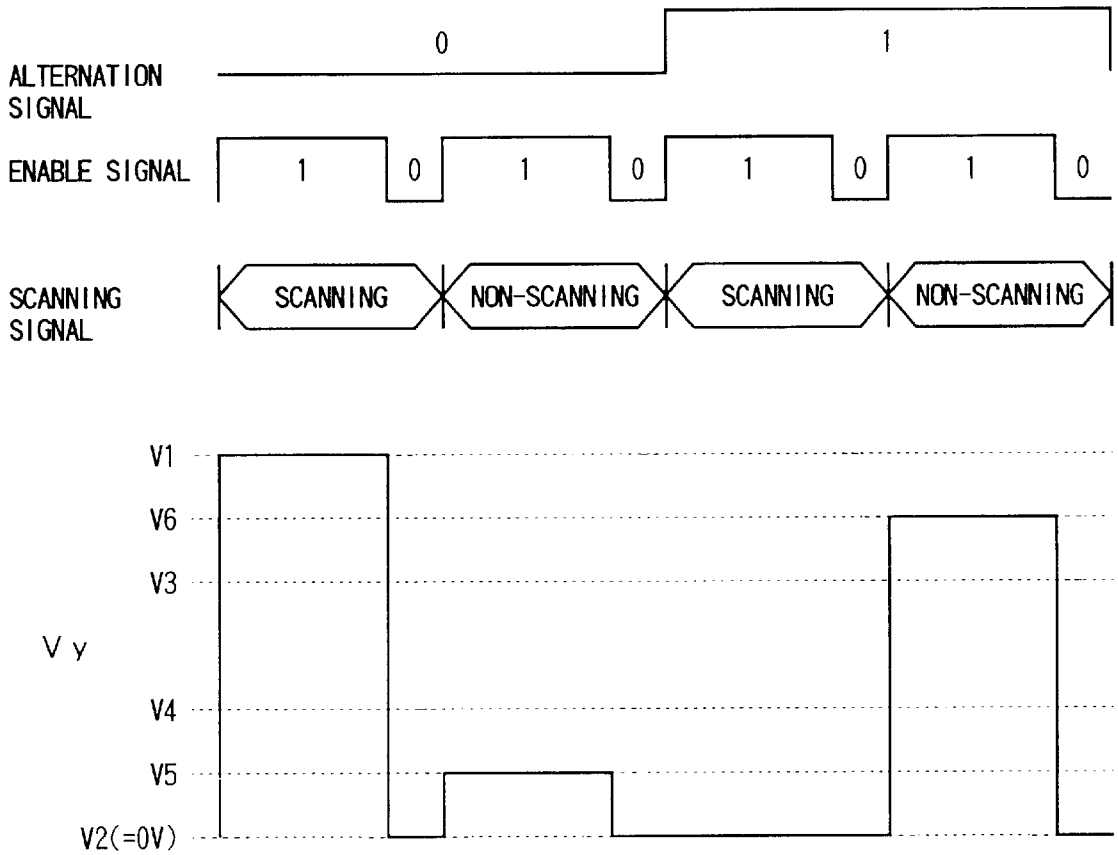
FIG. 68 PRIOR ART
FIG. 68 is a diagram for explaining the operation of a Y drive circuit in the prior art.

On the other hand, the Y drive circuit 3 accepts the head line clock 9 in response to the line clock 7, thereby selecting and scanning the head line. Thenceforth, it shifts the lines to be scanned sequentially in accordance with the line clock 7. The voltages of the predetermined levels are selected from among the liquid-crystal driving supply voltages of the four levels; the V1 voltage 11, V6 voltage 12, V5 voltage 15 and V2 voltage 16, as described in conjunction with FIG. 6 on the basis of the combinations between the line scanning signals and the alternation signal 8. The selected voltages are applied to the Y electrodes Vy1–Vyj. Incidentally, the liquid-crystal driving voltages of the six levels are the same as in the prior-art technique. That is, as stated before with reference to FIG. 66, the resistances of the voltage divider resistors have the following relationship:

$$R1=R2=R4=R5=R$$

$$R3=(a-4)R$$

where "a" denotes a bias ratio.

The liquid-crystal driving voltages of the six levels are related as follows:

$$V1>V6>V3>V4>V5>V2$$

$$V1-V6=V6-V3=V4-V5=V5-V2$$

Figure 7:
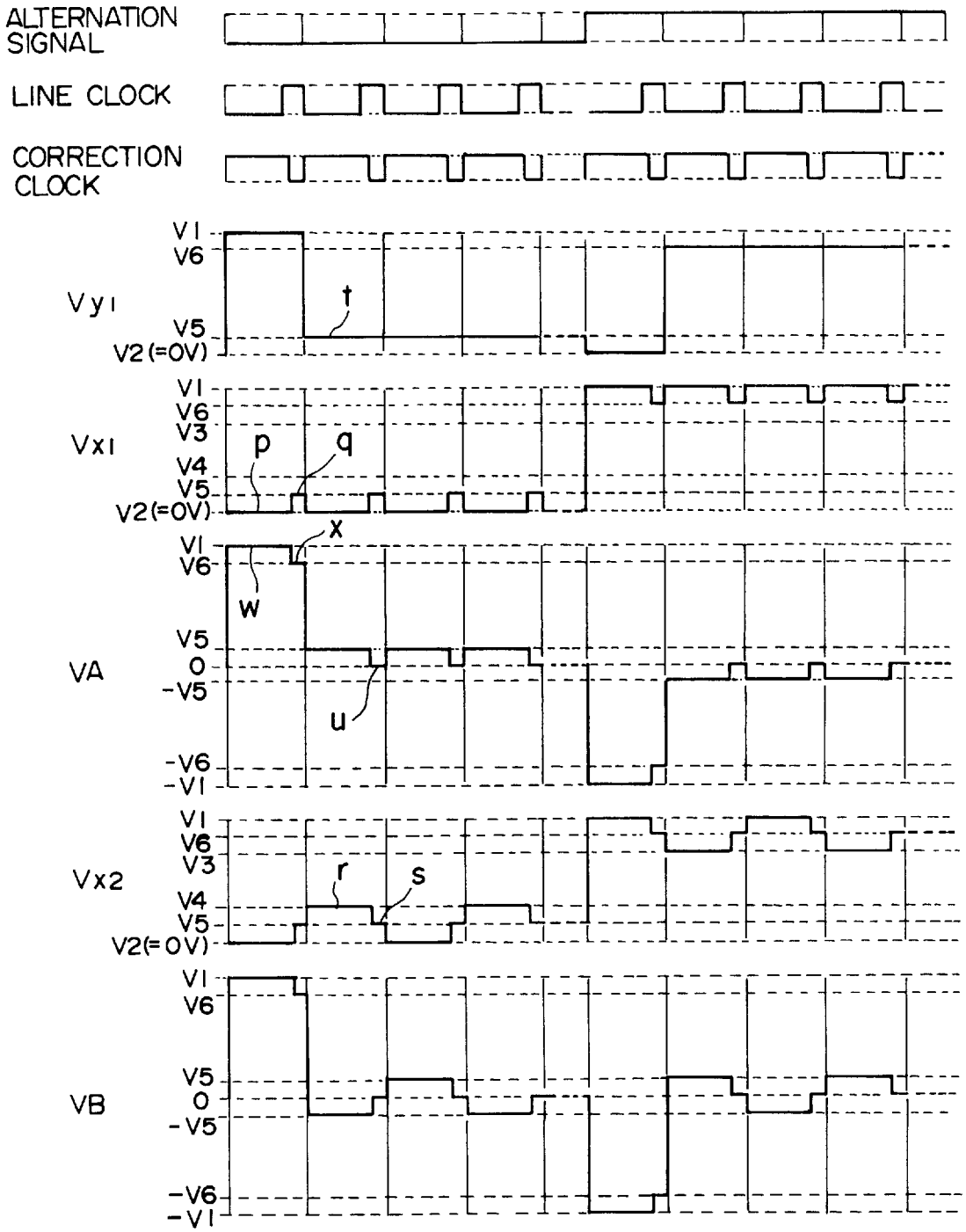
FIG. 7 is a timing chart showing the waveforms of voltages applied to a liquid crystal in the embodiment of FIG. 1.
Figure 69:
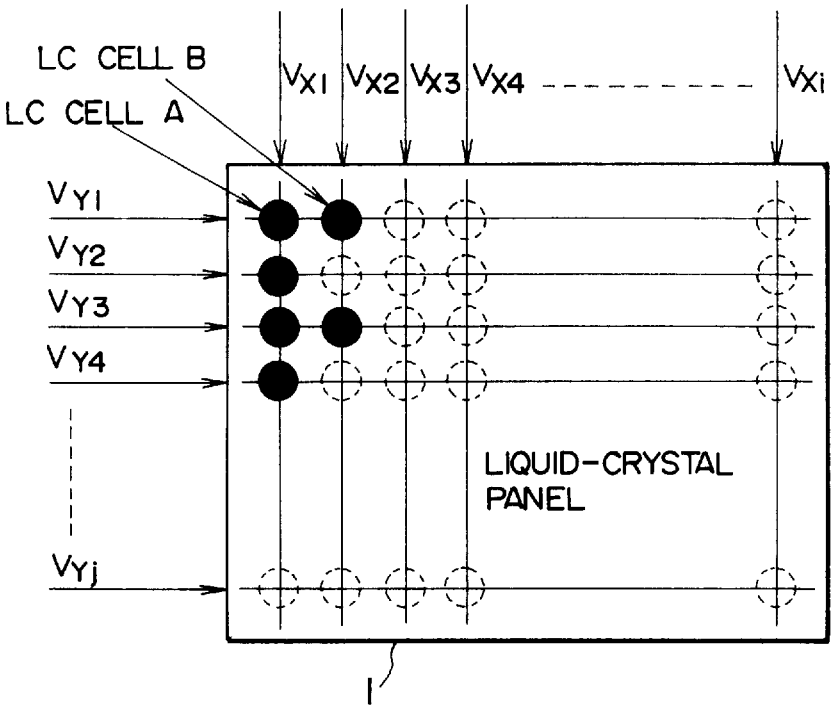
FIG. 69 is a diagram for explaining an example of the display pattern of a liquid-crystal panel.
Figure 70:
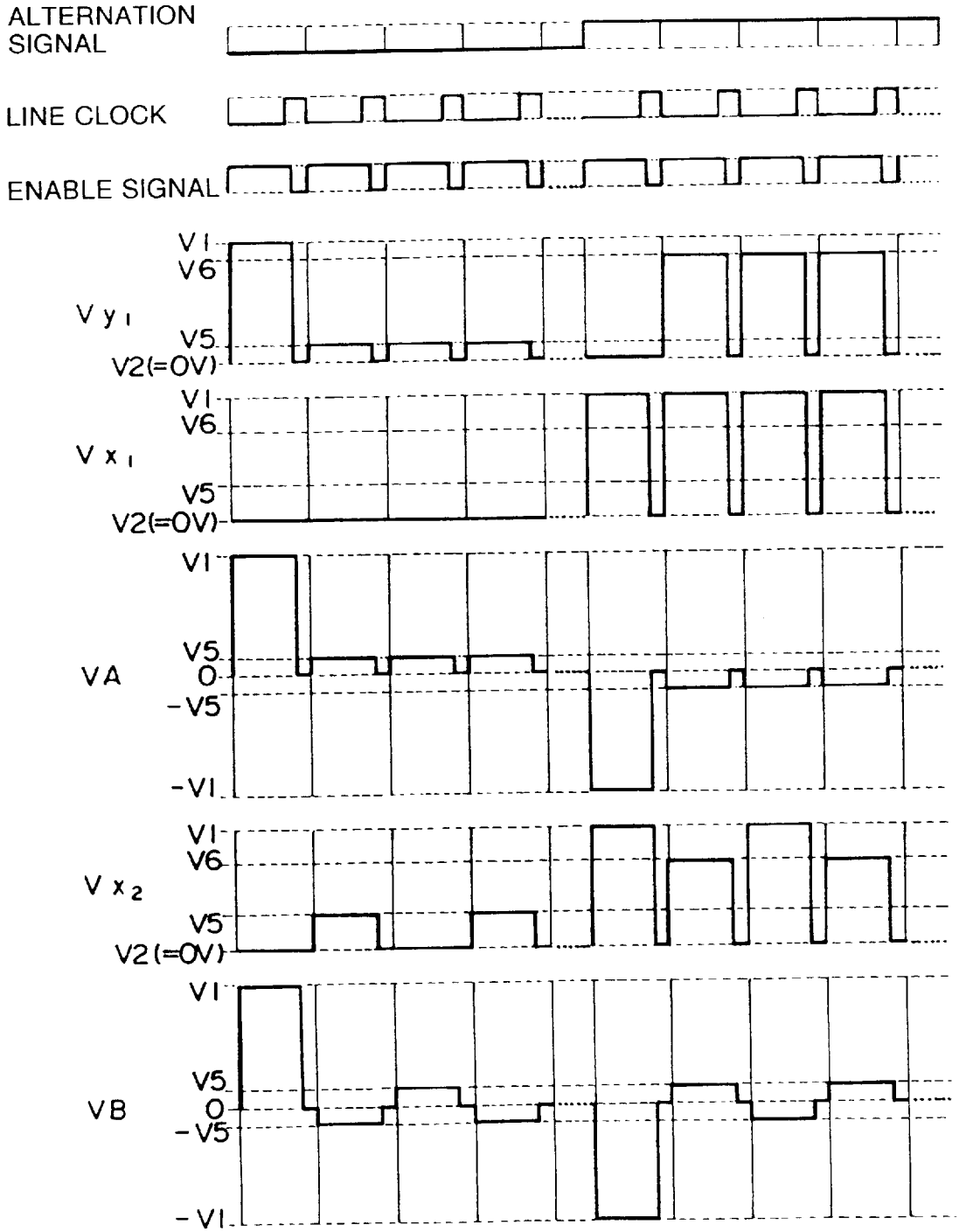
FIG. 70 PRIOR ART
FIG. 70 is a timing chart showing the waveforms of applied voltages to a liquid crystal in the prior art.
Figure 71:
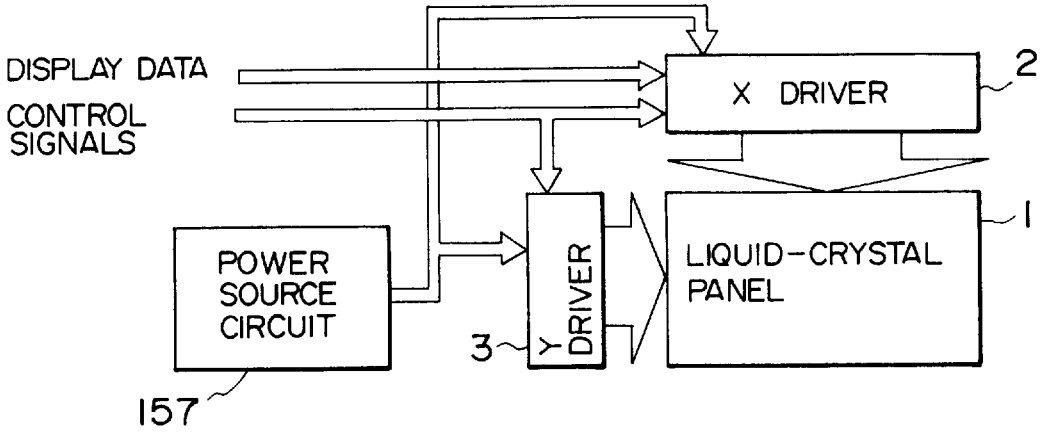
FIG. 71 PRIOR ART
FIG. 71 is a block diagram showing the construction of another liquid-crystal display device in the prior art.
Figure 72:
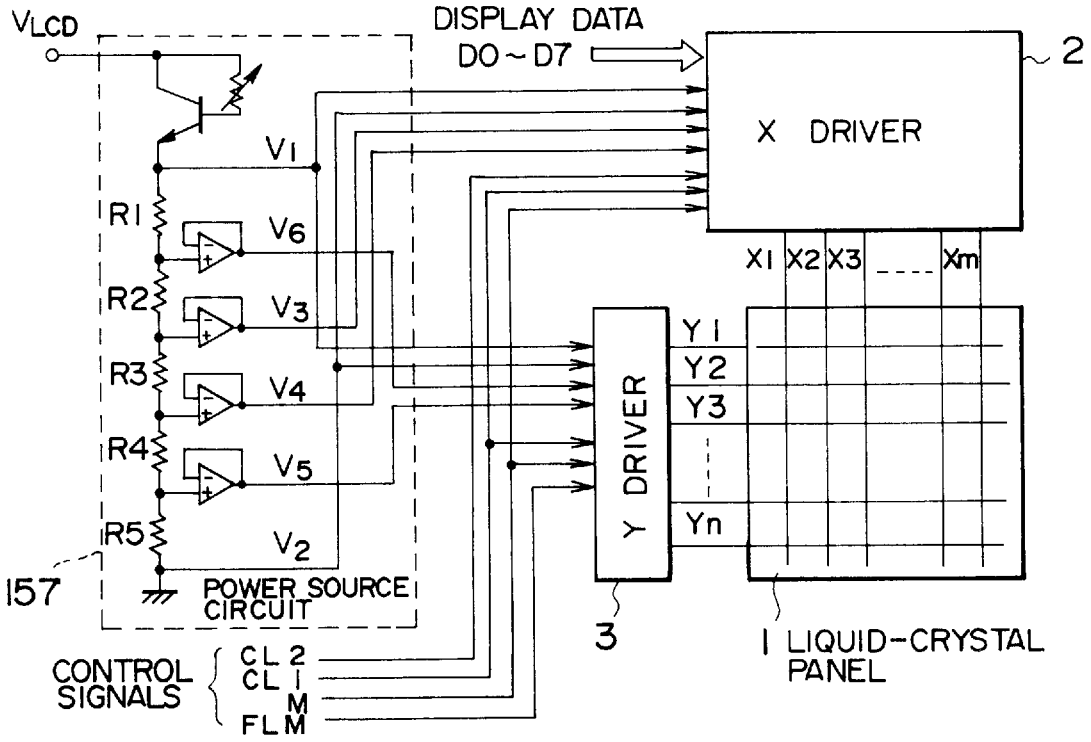
FIG. 72 PRIOR ART
FIG. 72 is a circuit block diagram showing the practicable construction of the device in FIG. 71.
Figure 73:
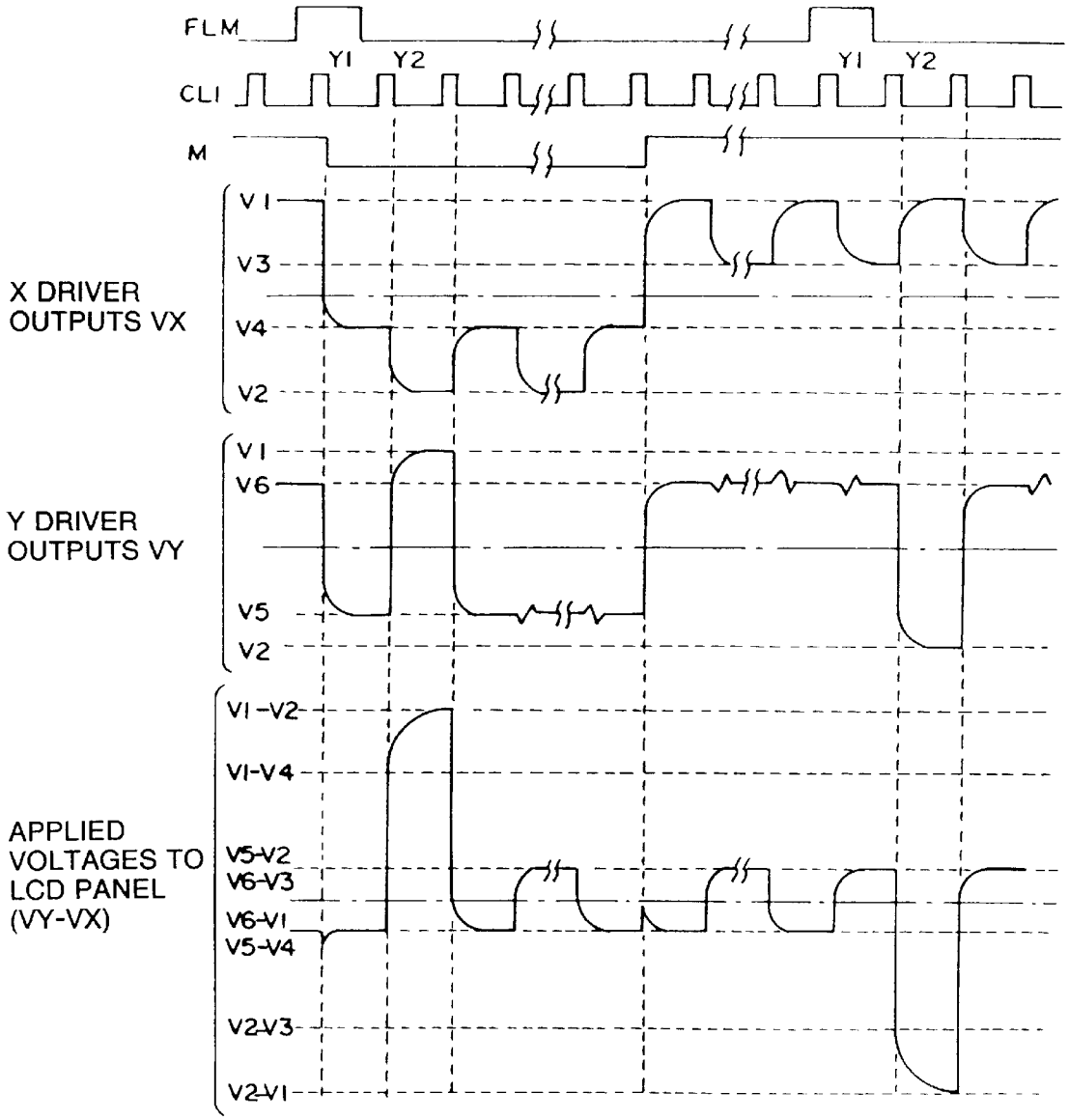
FIG. 73 PRIOR ART
FIG. 73 is a timing chart of the waveforms of voltages applied to the liquid-crystal display device in FIG. 71.

Next, the voltages which are applied to the liquid-crystal cells of the display device will be described with reference to FIG. 7 by taking the display pattern in FIG. 69 as an example. FIG. 7 shows the waveforms of the applied voltages of the liquid-crystal cells in the case where the liquid-crystal display pattern shown in FIG. 69 is displayed. In the display pattern shown in FIG. 69, all the liquid-crystal cells located at the intersection points between the X electrode Vx1 and the Y electrodes Vy1–Vy4 are ON display cells indicated by black spots (including the liquid-crystal cell A). Besides, the liquid-crystal cells located at the intersection points between the X electrode Vx2 and the Y electrodes Vy1–Vy4 are in a pattern in which ON display cells (including the liquid-crystal cell B) indicated by black spots and OFF display cells indicated by white spots are alternately arranged. When the display pattern is presented by driving the display device with the alternation signal of frame alternation 8 whose polarity is inverted every frame, the voltages applied to the liquid-crystal cells A and B are as depicted in FIG. 7. More specifically, since the liquid-crystal cell A is located between the Y electrode Vy1 and the X electrode Vx1, the voltage VA applied to this cell is giving by the voltage difference (Vy1–Vx1) between the applied voltage of the electrode Vy1 and that of the electrode Vx1. Besides, since the liquid-crystal cell B is located between the Y electrode Vy1 and the X electrode Vx2, the voltage VB applied to this cell is given by the voltage difference (Vy1–Vx2) between the applied voltage of the electrode Vy1 and that of the electrode Vx2.

Owing to the provision of the voltage selector 20, in the correction time period for which the correction clock 19 is "0", the applied voltage of the X electrode becomes the same level as that of the applied voltage of the Y electrode in the non-scanning state. More specifically, when the alternation signal 8 is "0", the V2 voltage (p in FIG. 7) is selected subject to the "ON" display data 5, but it is changed-over to the V5 voltage ("q") during the correction time period. Although the V4 voltage ("r") is selected subject to the "OFF" display data 5, it is changed-over to the V5 voltage ("s") during the correction time period. Since the applied voltage of the Y electrode in the non-scanning state is the V5 voltage ("t"), the voltage (difference voltage) applied to the liquid-crystal cell during the correction time period becomes 0 [V] ("u"). In the scanning state of the Y electrode, the applied voltage of the liquid-crystal cell is V1−V2=V1 ("w") subject to the "ON" display data 5, but it becomes V1−V5=V6 ("x") during the correction time period. Incidentally, although not shown in FIG. 7, the applied voltage of the liquid-crystal cell for the "OFF" display data 5 changes from V1−V4=V3 into V1−V5=V6 during the correction time period.

Accordingly, the applied voltage of the liquid-crystal cell in the scanning state during the correction time period does not become 0 [V], but it becomes the voltage (V6 when the alternation signal 8 is "0", or −V6 when it is "1") at the intermediate level between the ON-display voltage (V1 when the alternation signal 8 is "0", or −V1 when it is "1") and the OFF-display voltage (V3 when the alternation signal 8 is "0", or −V3 when it is "1"). Therefore, the voltage fluctuation values of the applied voltages of the X electrode and Y electrode decrease compared with those in the prior-art technique. The greatest fluctuation of the applied voltage of the X electrode from the V1 voltage to the V2 voltage (0 [V]) as is involved in the prior-art technique, decreases to the minute voltage fluctuation (the difference between the V1 voltage and the V6 voltage) in this embodiment. Further, the voltage fluctuation of the applied voltage of the Y electrode during the correction time period becomes null in this embodiment. Besides, the voltage fluctuations of the four supply voltages which are output from the voltage selector 20 during the correction time period become equal value (the same voltage fluctuation value as in the fluctuation from the V1 voltage to the V6 voltage).

As a result of the above, the voltage value width by which the applied voltage of the X electrode fluctuates during the correction time period is held constant irrespective of the voltage levels which are selected and output in accordance with the display data. Thus, the differences of the distorted waveforms of the applied voltages of the liquid crystal during the correction time periods decrease irrespective of the display patterns. As a result, the dispersion in the effective values of the voltages which are applied to the liquid-crystal cells decreases, so that the display quality of the display device can be enhanced.

Figure 8:
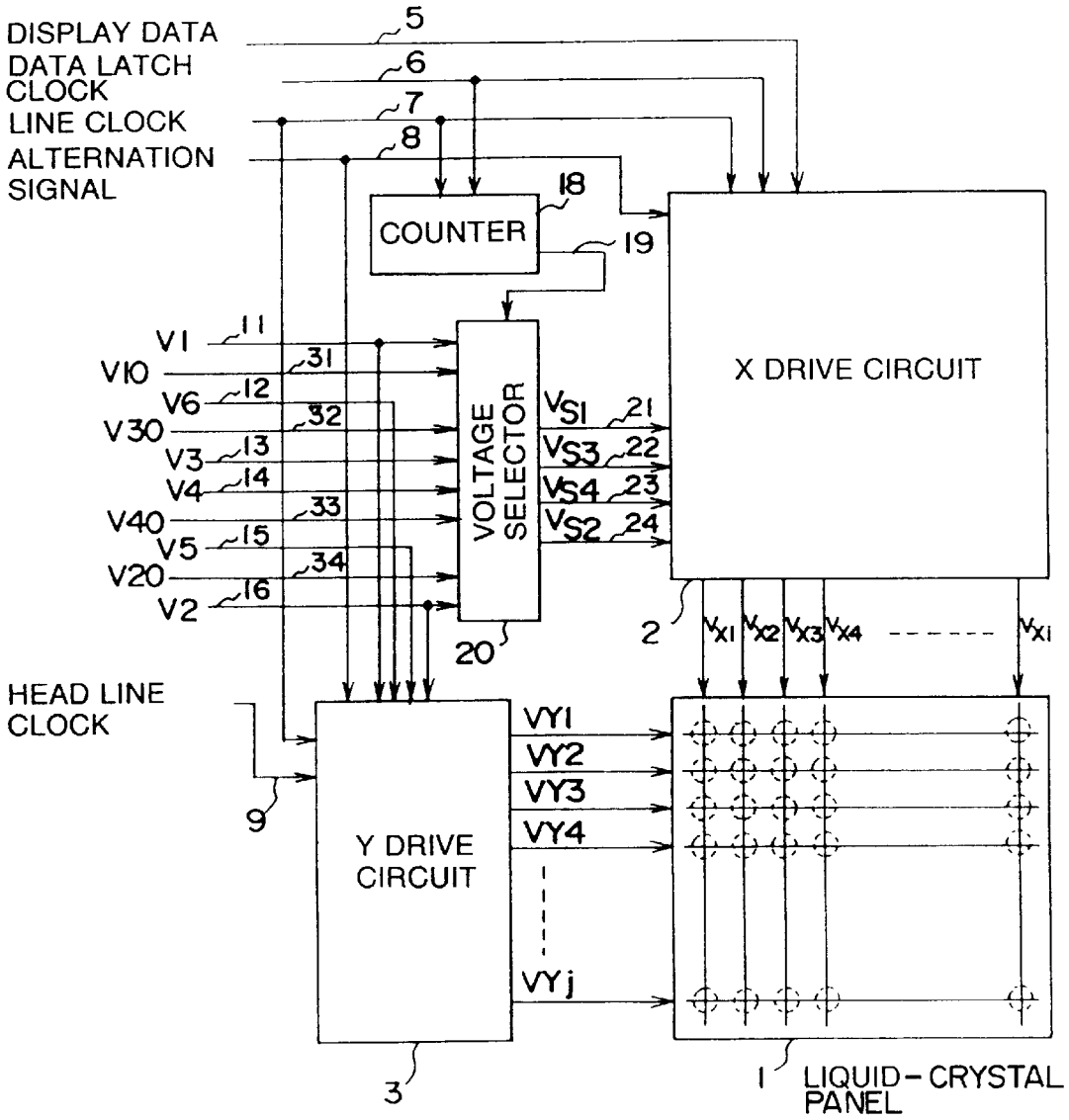
FIG. 8 is a block diagram showing the construction of a liquid-crystal display device according to the second embodiment of the present invention.

Incidentally, the X drive circuit 2 in FIG. 1 can be realized in a form shown in "Hitachi LCD Driver LSI Data Book (5th Edition, March 1990)" published by Hitachi, Ltd., 'FIG. 8: Example of Application Circuit' on page 286. However, the display data described as being serial with reference to FIG. 1 for the brevity of the description is parallel 8-bit data in 'FIG. 8' mentioned above. Similarly, the Y drive circuit 3 can be realized in the form shown in 'FIG. 8' mentioned above. In addition, the counter 18 can be realized by TTL devices of the "74 Series" as in the circuit arrangement shown in FIG. 2. Further, the circuit arrangement in FIG. 2 may well be replaced with a gate array. Besides, the counter 18 in the form of the gate array can be included in an identical gate array together with a circuit, not referred to in this embodiment, for generating the alternation signal 8 shown in FIG. 1.

From a different viewpoint, in order to relieve the dispersion of the effective values of the applied voltages of the liquid-crystal cells dependent upon the display patterns, the number of transitions in the applied voltages which are caused by switching the display state and non-display state of each display pattern may be held constant irrespective of the display patterns. It is accordingly considered that the difference voltage to be applied to each liquid-crystal cell in the correction time period every line scanning period need not always be set at 0 [V], but that it may be set at the correction voltage which prevents the effective values of the applied voltages from dispersing. In the second embodiment, therefore, the voltage level to which the level of the display voltage is changed-over in the correction time period by the voltage selector is not set to be identical to the level of the applied voltage of the Y electrode, but it is set at a voltage level which is close to the level of the applied voltage of the Y electrode and which prevents the dispersion of the effective values of the applied voltages.

Now, the second embodiment of the present invention will be described with reference to FIGS. 8–13.

Figure 9:
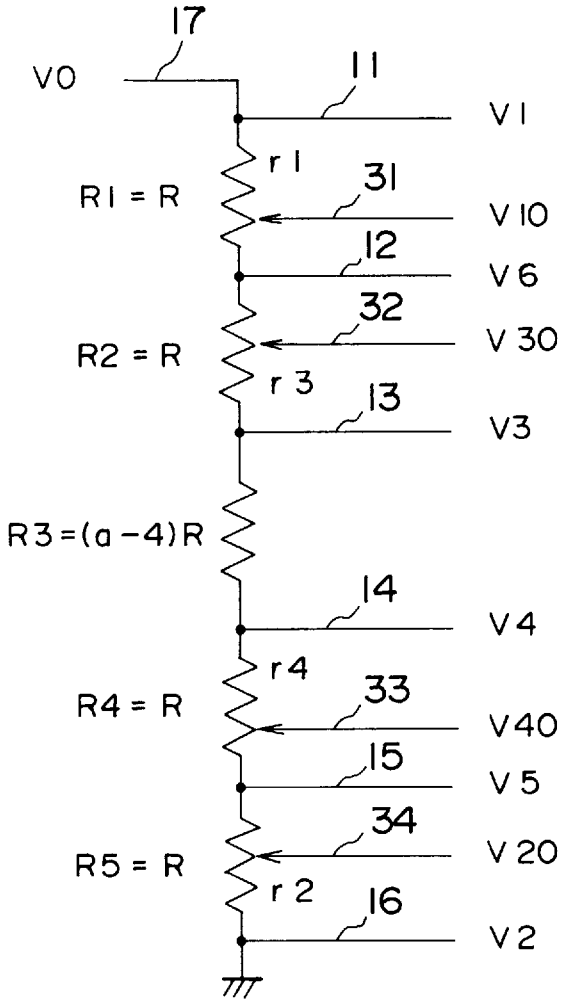
FIG. 9 is a circuit diagram of a supply voltage divider circuit suited to the second embodiment.

FIG. 8 shows the construction of a liquid-crystal display device in the second embodiment of the present invention, and FIG. 9 shows a voltage divider circuit which generates liquid-crystal supply voltages and correction voltages in this embodiment.

As illustrated in FIG. 9, the six levels of liquid-crystal driving voltages 11–16 are the same as in the prior-art technique and the first embodiment and are related as follows:

$$V1>V6>V3>V4>V5>V2$$

$$V1-V6=V6-V3=V4-V5=V5-V2$$

On the other hand, the correction voltages 31–34 are generated by setting the internal resistances of voltage divider resistors R1, R2, R4 and R5 as:

$$r1=r2=r4=r5$$

Thus, the voltages satisfy the following conditions:

$$V1>V10,\ V3<V30,\ V4>V40,\ V2<V20$$

$$V1-V10=V30-V3=V4-V40=V20-V2=\Delta V$$

A block diagram depicted in FIG. 8 is the same as FIG. 1 except for the method of supplying the correction voltages to the voltage selector 20.

Figure 10:
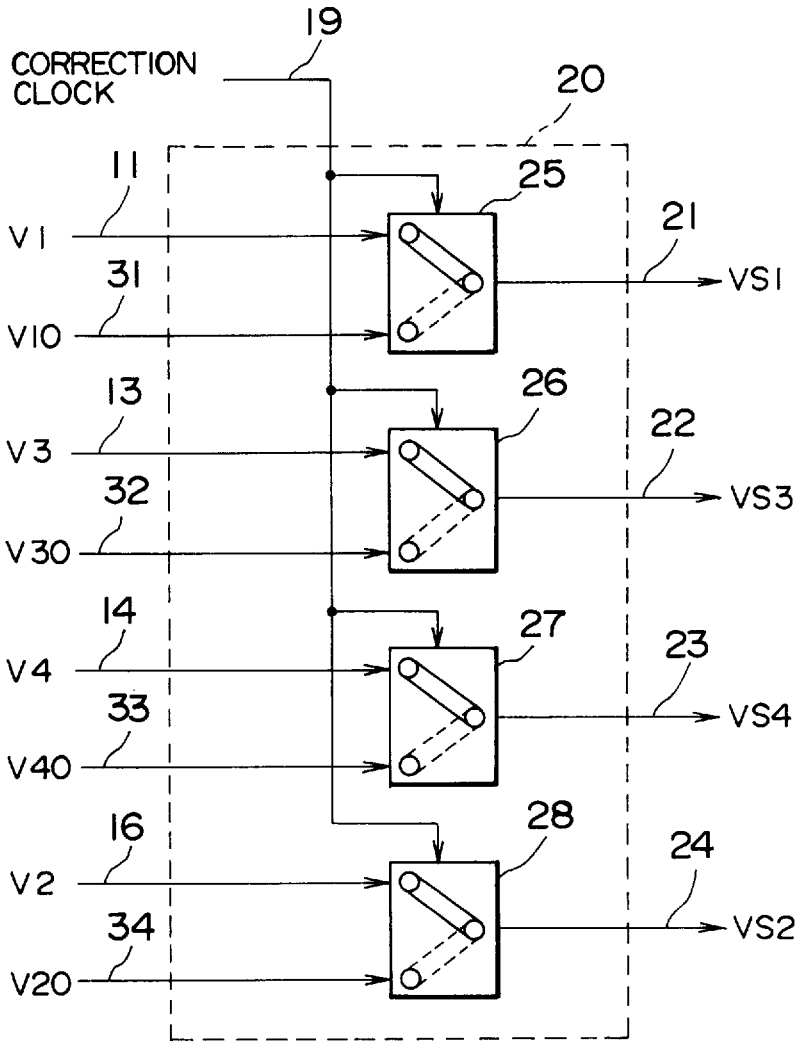
FIG. 10 is a block diagram showing the arrangement of a voltage selector (20) suited to the second embodiment.
Figure 11:
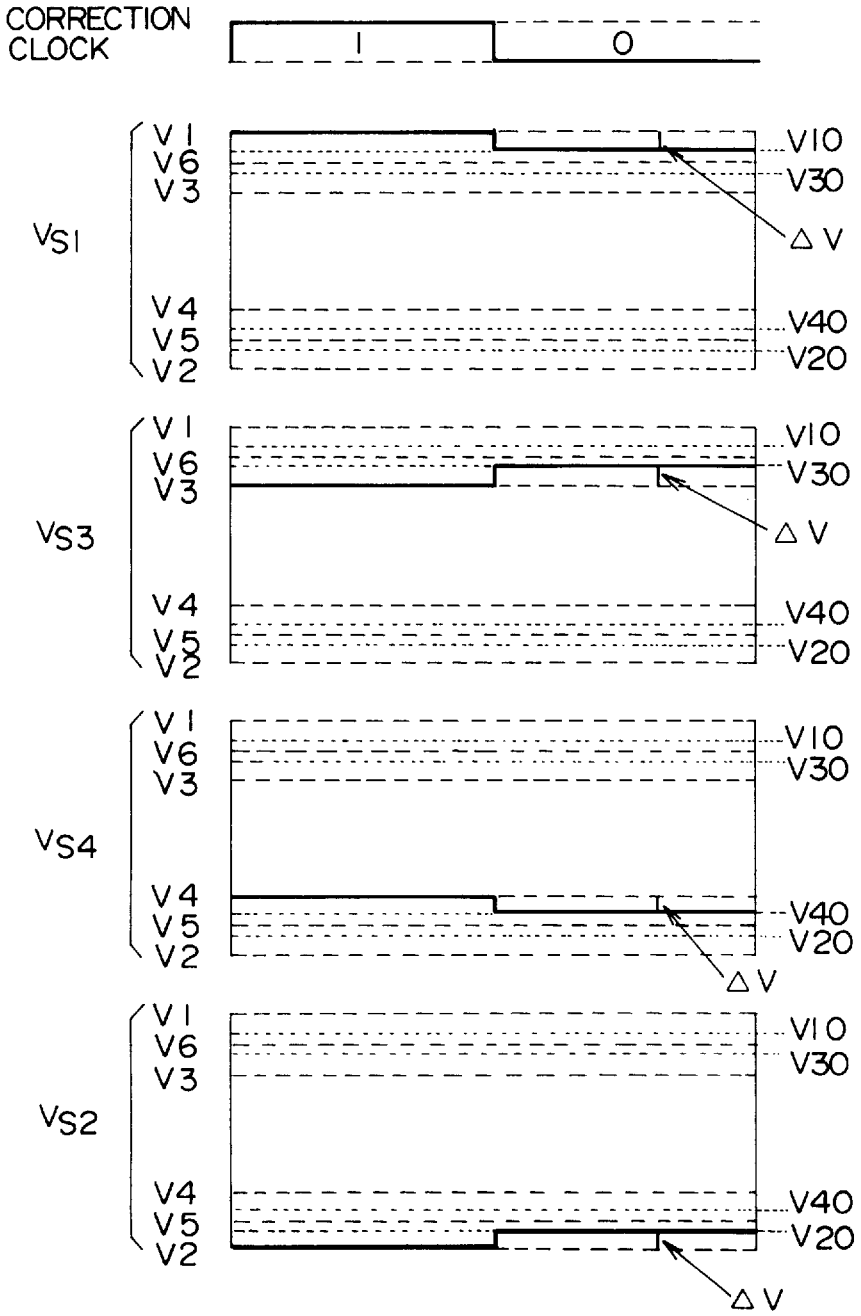
FIG. 11 is a diagram for explaining the operation of the voltage selector (20) in FIG. 10.

As shown in FIG. 10, the voltage selector 20 is configured of four selector elements 25–28 which perform selection operations in accordance with the correction clock 19. As illustrated in FIG. 11 for explaining the operation of the voltage selector 20, when the correction clock 19 is "1", the selector elements 25–28 deliver the V1 voltage 11, V3 voltage 13, V4 voltage 14 and V2 voltage 16 as the Vs1 voltage 21, Vs3 voltage 22, Vs4 voltage 23 and Vs2 voltage 24, respectively. In addition, when the correction clock 19 is "0", the V10 voltage 31, V30 voltage 32, V40 voltage 33 and V20 voltage 34 which are the correction voltages are respectively delivered as the Vs1 voltage 21, Vs3 voltage 22, Vs4 voltage 23 and Vs2 voltage 24.

Figure 12:
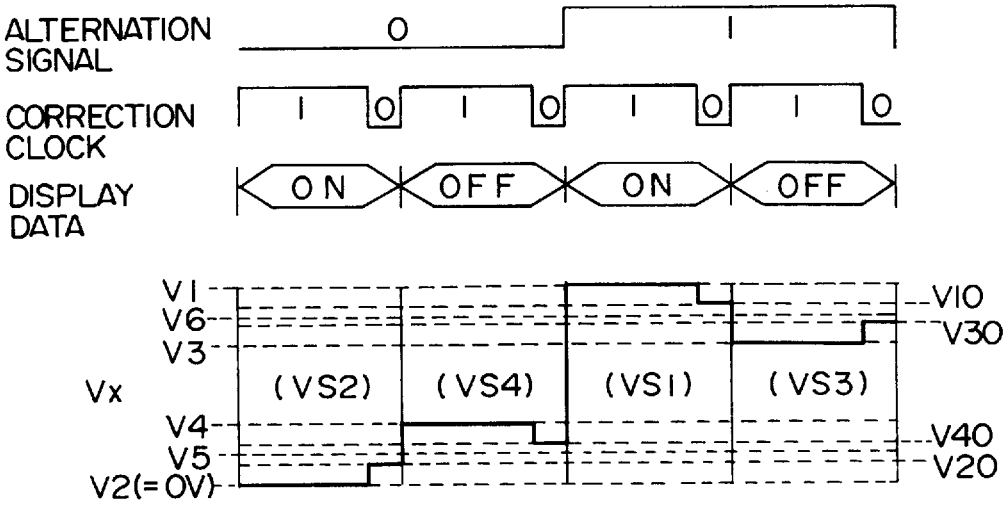
FIG. 12 is a diagram for explaining the operation of an X drive circuit in the second embodiment.

As illustrated in FIG. 12, the X drive circuit 2 selects the voltages of the predetermined levels from among the liquid-crystal driving supply voltages of the four levels; the Vs1 voltage 21, Vs3 voltage 22, Vs4 voltage 23 and Vs2 voltage 24 which are output from the voltage selector 20, in accordance with the combinations between the display data items 5 loaded on the output side of this drive circuit 2 and the alternation signal 8. Thus, the X drive voltages numbering "i" for the electrodes of one scanning are applied to the X electrodes Vx1–Vxi in parallel. That is, when the alternation signal 8 is "0", the Vs2 voltage (the V2 voltage in the non-correction time period, and the V20 voltage in the correction time period) is selected and output on condition that the display data 5 is "ON", and the Vs4 voltage (the V4 voltage in the non-correction time period, and the V20 voltage in the correction time period) is selected and output on condition that the display data 5 is "OFF". In addition, when the alternation signal 8 is "1", the Vs1 voltage (the V1 voltage in the non-correction time period, and the V10 voltage in the correction time period) is selected and output on condition that the display data 5 is "ON", and the Vs3 voltage (the V3 voltage in the non-correction time period, and the V30 voltage in the correction time period) is selected and output on condition that the display data 5 is "OFF".

Figure 13:
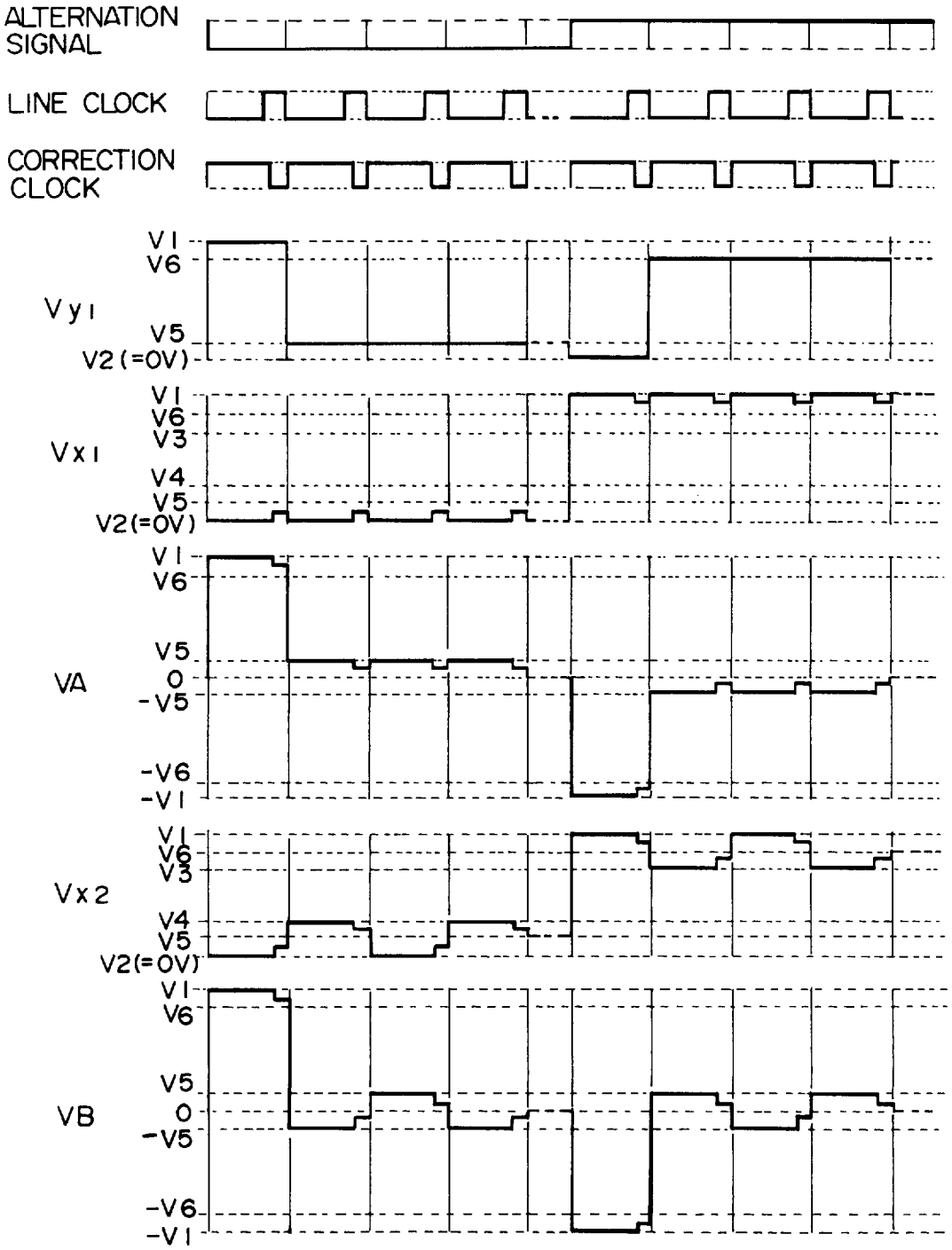
FIG. 13 is a timing chart showing the waveforms of voltages applied to a liquid crystal in the second embodiment.

Next, the applied voltages of the liquid crystal based on the second embodiment will be described with reference to FIG. 13 by the use of the display pattern shown in FIG. 69. The display pattern exemplified in FIG. 69 is as stated before. The difference voltages VA and VB which are respectively applied to the liquid-crystal cells A and B when the display pattern is presented, are illustrated in FIG. 13. As seen from the figure, the applied voltages change once every scanning period without fail, and the number of transitions are equal for both the voltages VA and VB. Further, the amounts of the changes (the magnitudes of corrections ΔV) are equal, and the effective values of the applied voltages become the same.

Incidentally, the first embodiment is equivalent to a case where the magnitudes of corrections ΔV in the second embodiment are fixed to V5−V2 (=V5).

Meanwhile, each of the liquid-crystal cells acts as a capacitance. In this regard, since the transient characteristics of the cell in the ON-display state and OFF-display state are different, some discrepancy can arise between the effective voltage values in the states during the non-scanning period. In the embodiment, the correction magnitude ΔV is set at the same value for both the ON- and OFF-display states, supposing ideally that no difference in the transient characteristics is involved between in the ON-display state and in the OFF-display state. However, the correction magnitude ΔV can be set at unequal values for the ON- and OFF-display states for the purpose of relieving the discrepancy of the effective voltage values in both the states during the non-scanning period. More specifically, in the case of the ON display, symbol ΔVon denotes the correction magnitude ΔV which is the difference between the voltage to be applied to the X electrode during the non-correction time period; the V1 voltage 11 (or the V2 voltage 16), and the voltage to be applied thereto during the correction time period; the V10 voltage 31 (or the V20 voltage 34), while in the case of the OFF display, symbol ΔVoff denotes the correction magnitude ΔV which is the difference between the voltage to be applied to the X electrode during the non-correction time period; the V3 voltage 13 (or the V4 voltage 14), and the voltage to be applied thereto during the correction time period; the V30 voltage 32 (or the V40 voltage 33). Then, some difference is given between the values ΔVon and ΔVoff. This measure can be realized by setting the internal resistances r1, r2, r4 and r5 of the voltage divider circuit shown in FIG. 9, as follows:

$$r1=r5=R_{on},\ r2=r4=R_{off}$$

Further, in order to correct the discrepancy of the effective voltage values in the ON-display state and OFF-display state during the non-scanning period, there is considered an expedient in which the resistances $R_{on}$ and $R_{off}$ are respectively regulated by finely adjusting semifixed resistors in conformity with the display situations of the ON- and OFF-display states. In the case of a liquid-crystal display panel which is normally in the OFF display state, $\Delta Von<\Delta Voff$ is established by setting $R_{on}<R_{off}$, whereby a display whose background is the OFF display can be optimized.

Owing to the methods described above, it becomes possible to reduce the dispersion in the effective values of the applied voltages of the liquid-crystal cells dependent upon the display patterns, and to enhance the display quality.

Now, the third embodiment will be described with reference to FIGS. 14–20.

Figure 14:
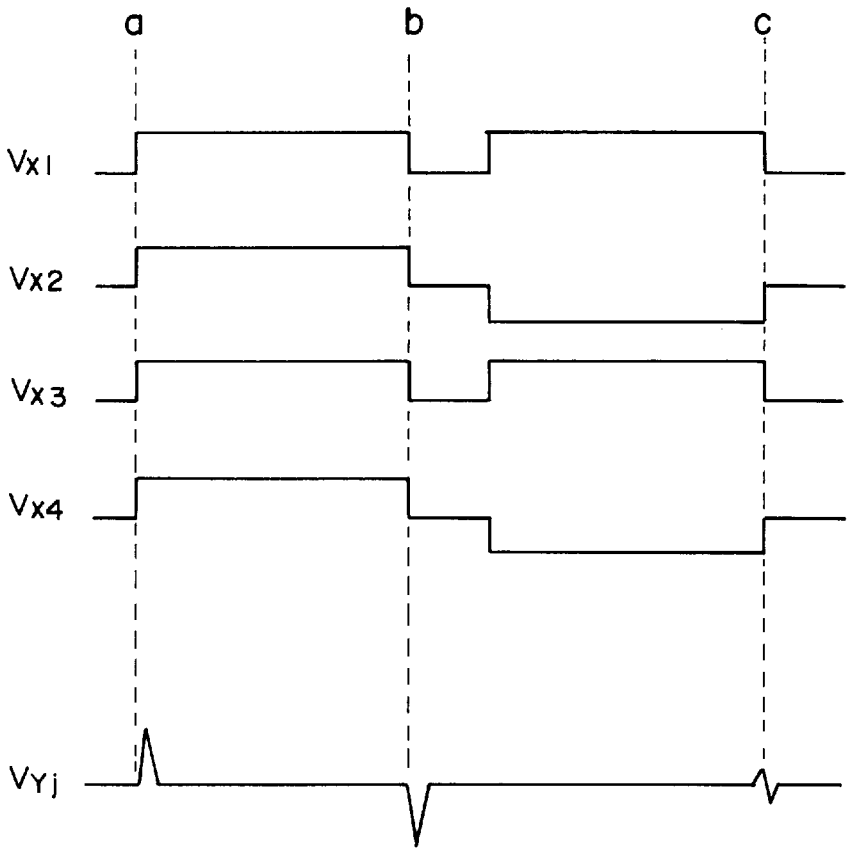
FIG. 14 is a diagram of the output waveforms of X and Y drive circuits for explaining the third embodiment of the present invention.

This embodiment serves to solve the problem that, in a case where the driving capability of a Y drive circuit 3 is low, the output thereof is distorted through a liquid crystal at the change point of the output of an X drive circuit 2 during a correction time period as illustrated in FIG. 14. The output of the X drive circuit 2 during the correction time period has its rise or fall determined depending upon whether it presents an ON display or an OFF display. Therefore, the extent of the distortion of the output of the Y drive circuit 3 differs depending upon the ON-display and OFF-display states of display data corresponding to one scanning line (the number of rises and the number of falls of the outputs of the X drive circuit 2 during the correction time period).

Figure 15:
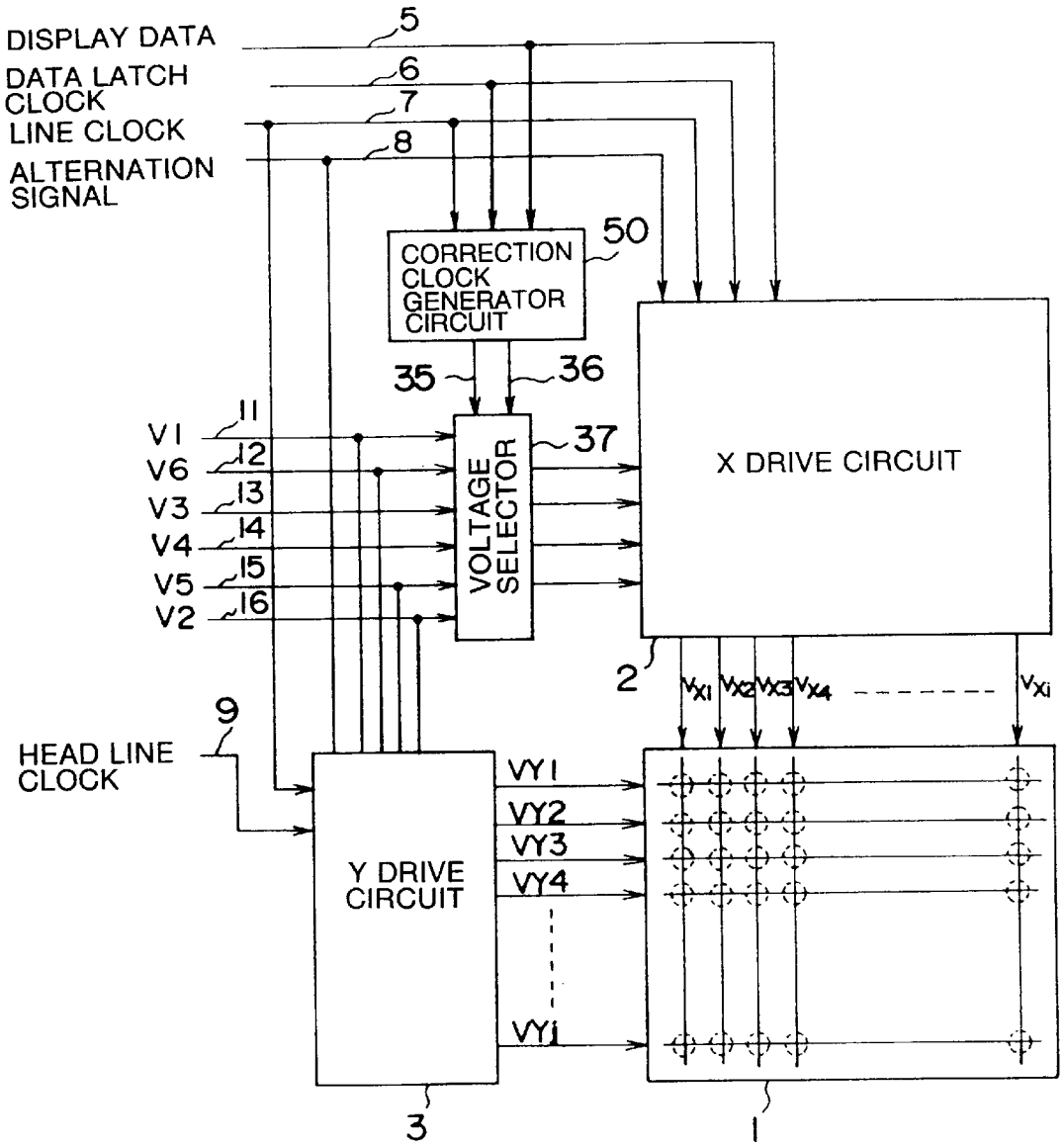
FIG. 15 is a block diagram showing the construction of a liquid-crystal display device in the third embodiment.

FIG. 15 is a block diagram of a liquid-crystal display device which prevents the output of the Y drive circuit from being distorted. Referring to the figure, numeral 50 indicates a correction clock generator circuit which controls the durations of correction clock pulses 35 and 36 provided separately for the ON display and the OFF display, and numeral 37 a voltage selector by which supply voltages to be applied to the X drive circuit 2 are selected in accordance with the ON-displaying correction clock 35 and OFF-displaying correction clock 36. The other constituents are the same as in the first embodiment (FIG. 1).

Figure 16:
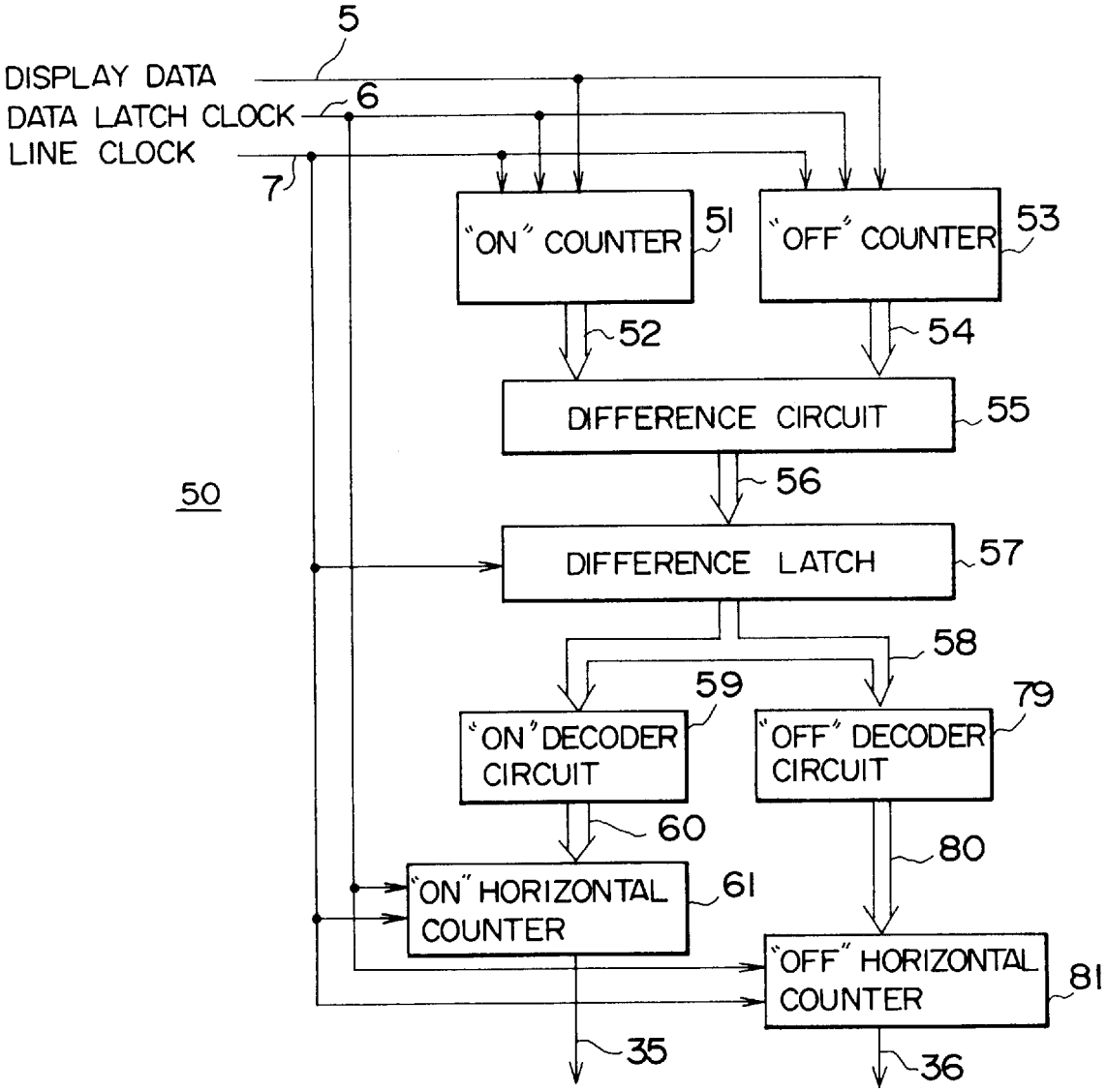
FIG. 16 is a block diagram showing an example of a correction clock generator circuit in the third embodiment.

FIG. 16 shows an example of the arrangement of the correction clock generator circuit 50. This circuit 50 includes an ON-display counter 51 which accepts the display data 5 in accordance with the data latch clock 6 so as to count the number of ON-display data items or pixels, and an OFF-display counter 53 which accepts the display data 5 in accordance with the data latch clock 6 so as to count the number of OFF-display data items or pixels. Numeral 55 indicates a difference circuit which subtracts the number 54 of the OFF-display pixels from the number 52 of the ON-display pixels. Numeral 57 indicates a difference latch by which a display difference 56 delivered from the difference circuit 55 is latched in accordance with the line clock 7. An ON-displaying decoder circuit 59 decodes difference data 58 so as to generate an ON-displaying correction clock position 60 which appoints the position of the falling of the ON-displaying correction clock 35. An ON-displaying horizontal counter 61 sets the ON-displaying correction clock 35 to "1" in response to the line clock 7. Thereafter, this counter 61 counts the data latch clock pulses 6, and it sets the correction clock 35 to "0" when the count value has coincided with the value of the ON-displaying correction clock position 60. Likewise, an OFF-displaying decoder circuit 79 decodes the difference data 58 so as to generate an OFF-displaying correction clock position 80 which appoints the position of the falling of the OFF-displaying correction clock 36. An OFF-displaying horizontal counter 81 sets the OFF-displaying correction clock 36 to "1" in response to the line clock 7. Thereafter, this counter 81 counts the data latch clock pulses 6, and it sets the correction clock 36 to "0" when the count value has coincided with the value of the OFF-displaying correction clock position 80.

Figure 17:
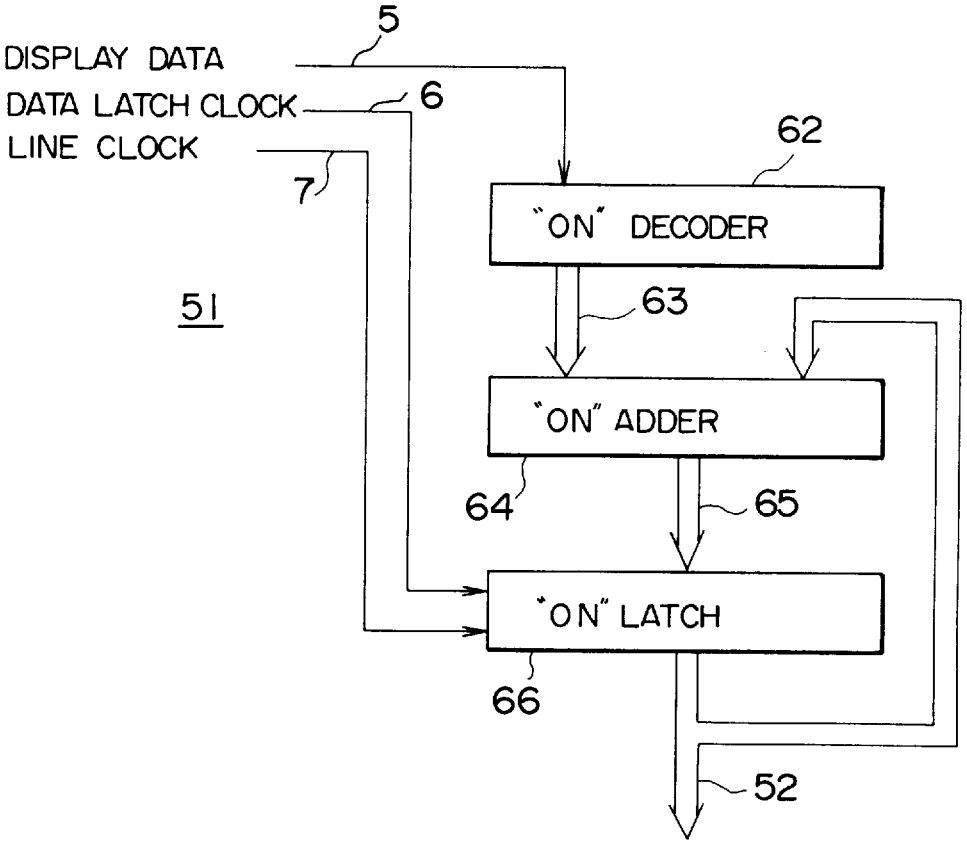
FIG. 17 is a block diagram showing an example of an ON-display counter shown in FIG. 16.

FIG. 17 is a block diagram of an example of the ON-display counter 51. This counter 51 is comprised of an ON decoder 62 which decodes the number of the ON display items or pixels of the display data 5, an ON adder 64 which adds the number 63 of the ON display items, and an ON latch 66 which latches the sum number 65 of the ON display items. The ON adder 64 adds up the display-ON number 63 and the ON number 52. The sum ON number 65 being the result of the addition is latched in the ON latch 66 in response to the data latch clock 6. Since the ON latch 66 is reset to "0" by the line clock 7, it latches the ON-display items and affords the latched results to the ON adder 64 successively in response to the data latch clock pulses 6. Thus, when the data latch clock pulses 7 corresponding to one scanning operation have been output, the number of all the ON-display items within the scanning period of one line is latched. The OFF-display counter 53 can be realized by an arrangement similar to that of the ON-display counter 51 in FIG. 17 (except that the number of "0's" is decoded in a decoder operation illustrated in FIG. 18).

The difference circuit 55 subtracts the OFF number 54 from the ON number 52, and outputs the result as the display difference 56.

FIG. 18 is a table illustrative of the operation of the ON decoder 62 which is a constituent of the ON-display counter 51. Herein, it is assumed that the display data 5 consists of 4 parallel bits and that the display of the scanning period of one line contains 640 dots. The number of bits indicating the ON display items of the display data 5 is produced as the decode output 63.

FIG. 19 is a table illustrative of the operation of the decoder circuit 59 shown in FIG. 16. The ON-displaying decode value 60 and the OFF-displaying decode value 80 are preset for every range of "ON number–OFF number". In the illustrated example, the scanning period of one line includes the data latch clock pulses 6 in the number of "159", and the duration of the correction clock is given by a value which is obtained by subtracting the decode value "20" (or "30") from "159". By way of example, in the range in which the difference "ON number–OFF number" is "640" to "321", the ON-displaying decode value 60 is set at "139", and hence, the duration of the correction clock becomes "20".

Figure 20:
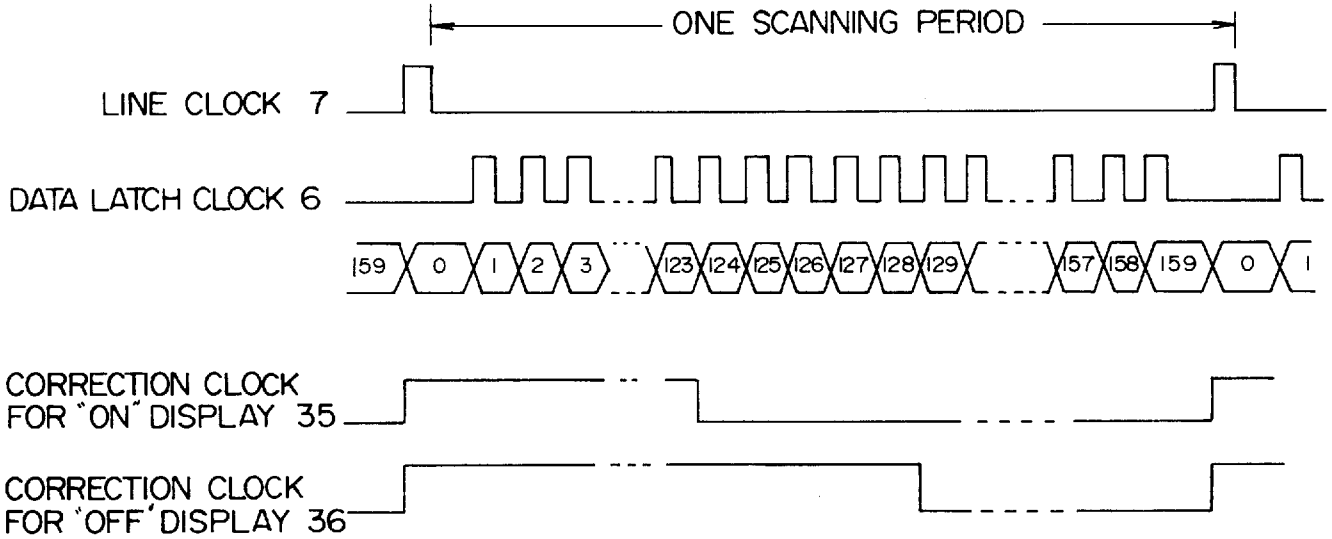
FIG. 20 is a timing chart illustrating the operations of horizontal counters shown in FIG. 16.

FIG. 20 is a timing chart illustrative of the operation of the horizontal counter 61, and it shows an example corresponding to the range "−11" to "−320" in FIG. 19. More specifically, the ON-displaying correction clock 35 rises in synchronism with the pulse of the line clock 7, and it falls at the point of time at which the count value of the data latch clock pulses 6 reaches "124". A time period from this point in time until the next pulse of the line clock 7 becomes the duration of the correction clock 35. The OFF-displaying correction clock 36 is similar to the ON-displaying correction clock 35 except that the former 36 falls at the point in time at which the count value of the data latch clock pulses 6 reaches "129".

Owing to the operation of the correction clock generator circuit 50 described above, the correction clock is separated into the ON-displaying one 35 and the OFF-displaying one 36, and the "0" time periods of the respective correction clock pulse trains can be controlled in accordance with the difference between the numbers of the ON-display dots and the OFF-display dots within the scanning period of one line. Therefore, the distortion of the output of the Y drive circuit 3 attributed to the outputs of the X drive circuit 2 in the correction time periods can be compensated for, and a display free from nonuniformity in the display brightness can be presented.

Although the difference between the numbers of the ON-display data items and OFF-display data items is simply computed in this embodiment, the computation is not restrictive. It is also possible to perform a calculation in which the number of the ON-display data items and that of the OFF-display data items are respectively weighted. Besides, the circuit arrangements in the embodiment are not restricted to the forms explained above, but they may be in any forms capable of controlling the "0" durations of the correction clock pulse trains 35, 36.

Moreover, although the voltage during the correction time period is set at the same level as that of the output voltage of the Y drive circuit 3 by the voltage selector 37, it is not restrictive. It is also possible to set a level which is close to the value of the output voltage. Further, it is possible to set unequal voltage levels for the ON display and the OFF display.

Figure 21:
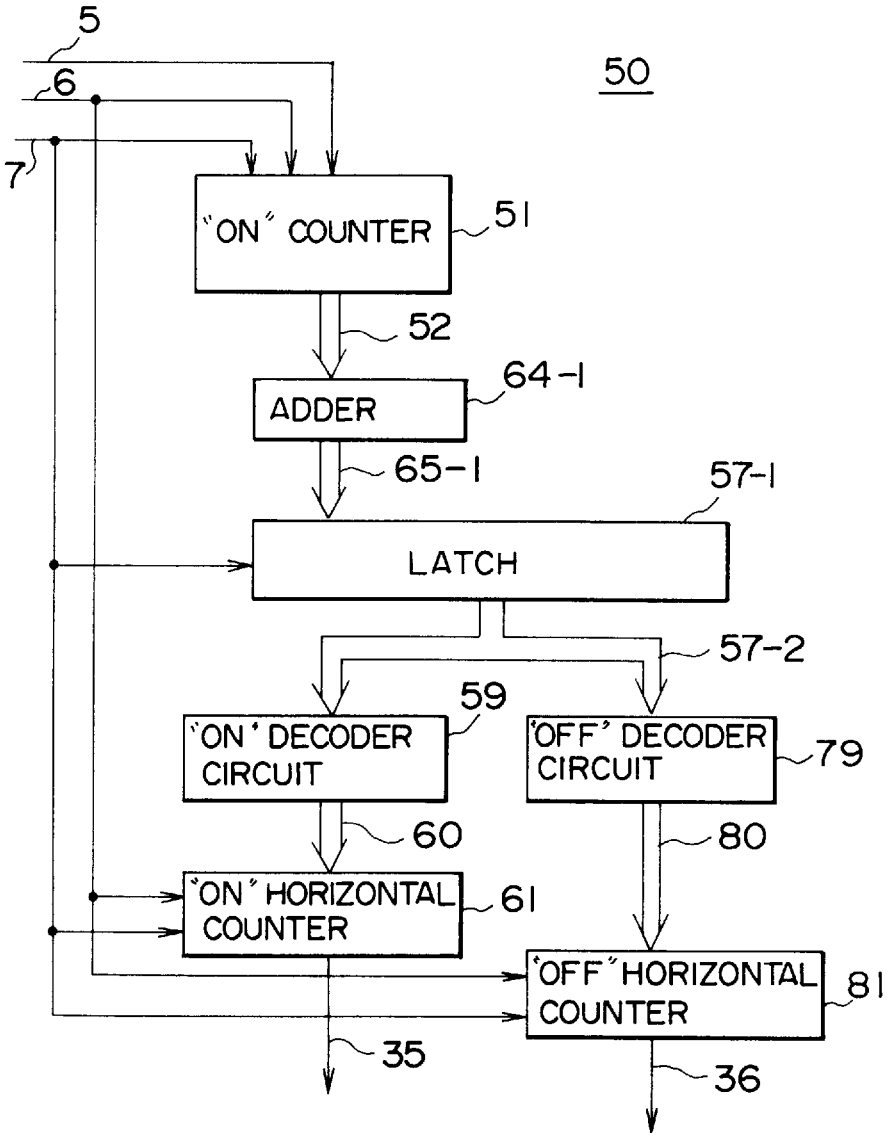
FIG. 21 is a block diagram showing another example of the correction clock generator circuit in the third embodiment.

FIG. 21 shows another example of the correction clock generator circuit 50 in FIG. 15. The same reference numerals are assigned to the same constituents as shown in FIG. 16. Symbol 64-1 denotes an adder which adds up the numbers of the ON-display data items or pixels 52 so as to deliver the total number 65-1 of the ON-display items. Symbol 57-1 denotes a latch which latches the total number 65-1 of the ON-display items in response to the line clock 7. The output 57-2 of the latch 57-1 indicates the total number of the ON-display data items. This correction clock generator circuit 50 operates similarly to the circuit in FIG. 16 except that the correction clock pulse trains 35 and 36 are produced on the basis of the total number of the ON-display items counted by the ON-display counter 51, without employing the OFF-display counter.

Figure 22:
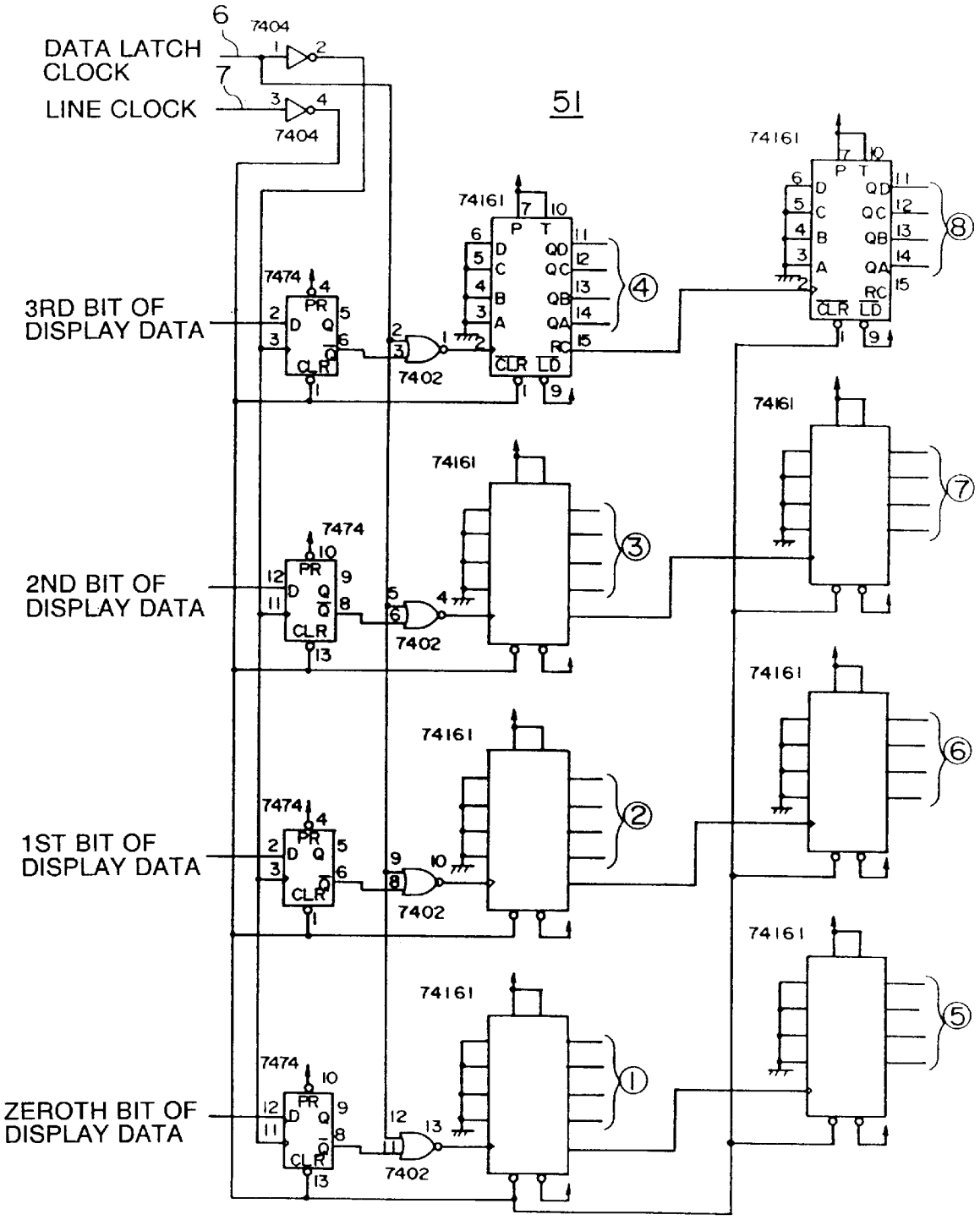
FIG. 22 is a circuit diagram showing an example of an ON-display counter (51) shown in FIG. 21.
Figure 23:
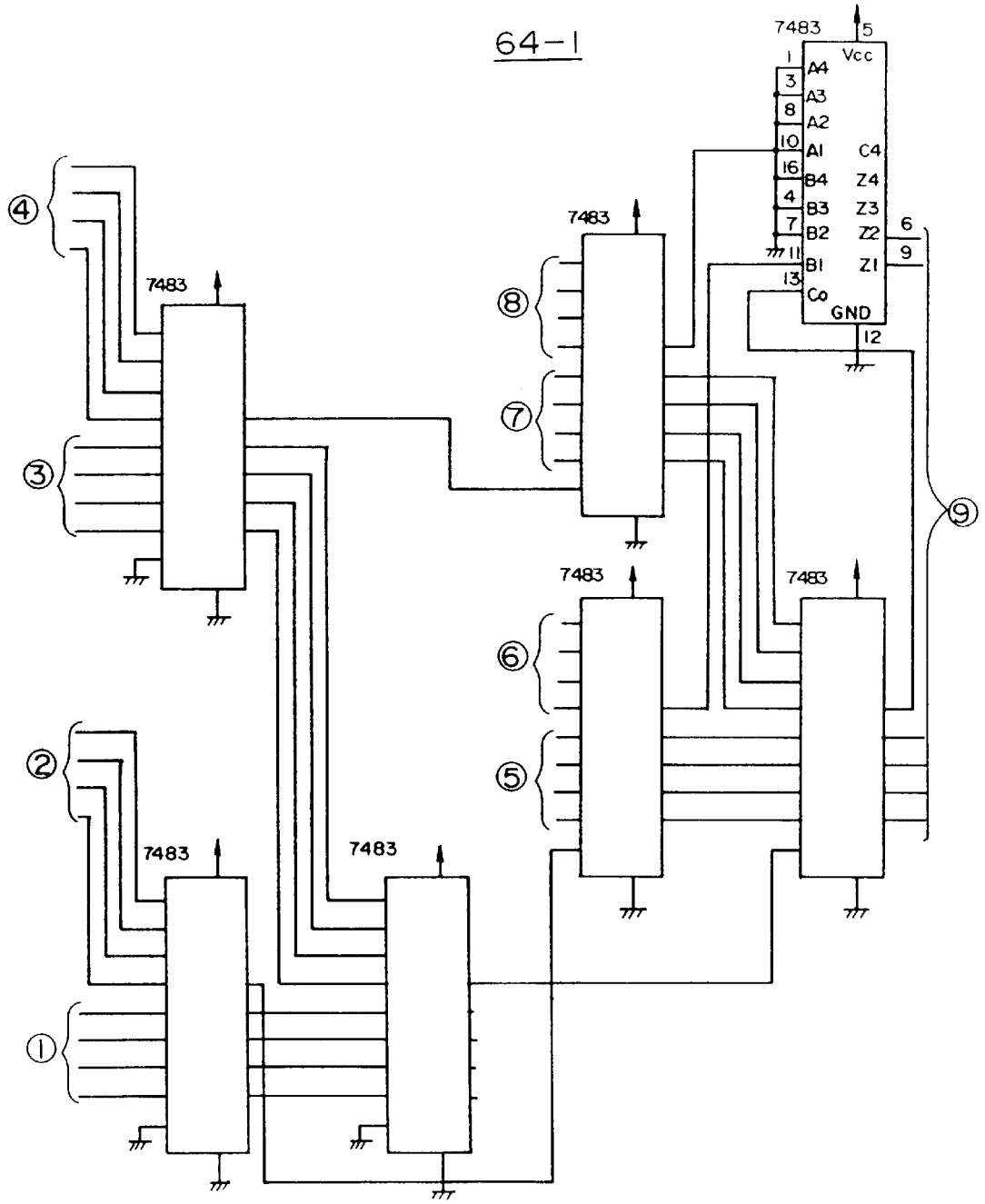
FIG. 23 is a circuit diagram showing an example of an adder (64-1) shown in FIG. 21.
Figure 24:
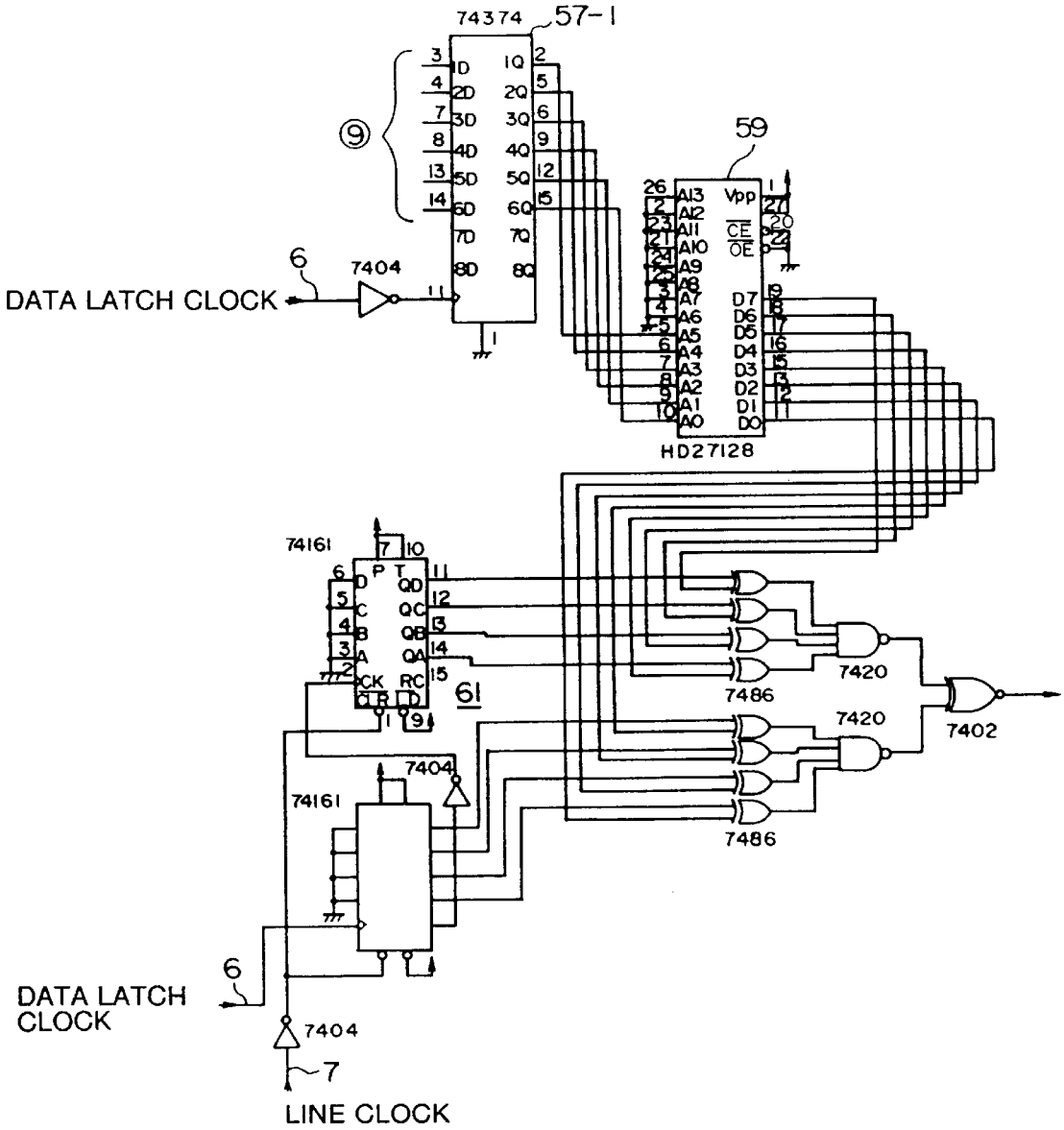
FIG. 24 is a circuit diagram showing an example of each of an ON-display number latch (57-1), a decoder (59) and a horizontal counter (61) which are shown in FIG. 21.

FIGS. 22–24 show circuit arrangements in the case where the correction clock generator circuit 50 in FIG. 21 is configured of TTL components from the "74" Series.

FIG. 22 is a circuit diagram of the ON-display counter 51 configured of "74" Series TTL components, in which the input display data consists of 4 parallel bits.

FIG. 23 is a circuit diagram of the adder 64-1 which adds up the numbers 52 of the ON-display items delivered from the ON-display counter 51 and which is configured of "74" Series TTL components.

Referring to FIG. 24, the latch 57-1 consists of a "74374" device, the ON-displaying decoder circuit 59 (or the OFF-displaying decoder circuit 79) is a "HD27128" device, which is a ROM, and the ON-displaying horizontal counter 61 (or the OFF-displaying horizontal counter 81) is comprised of "74161", "7404", "7486", "7420" and "7402" devices. The output of the "7402" serves as the correction clock 35 or 36. In FIG. 24, the decoder and the horizontal counter are only shown for the ON display. Since the decoder and the horizontal counter for the OFF display can be formed of the same circuit arrangements, they are omitted here.

Figure 25:
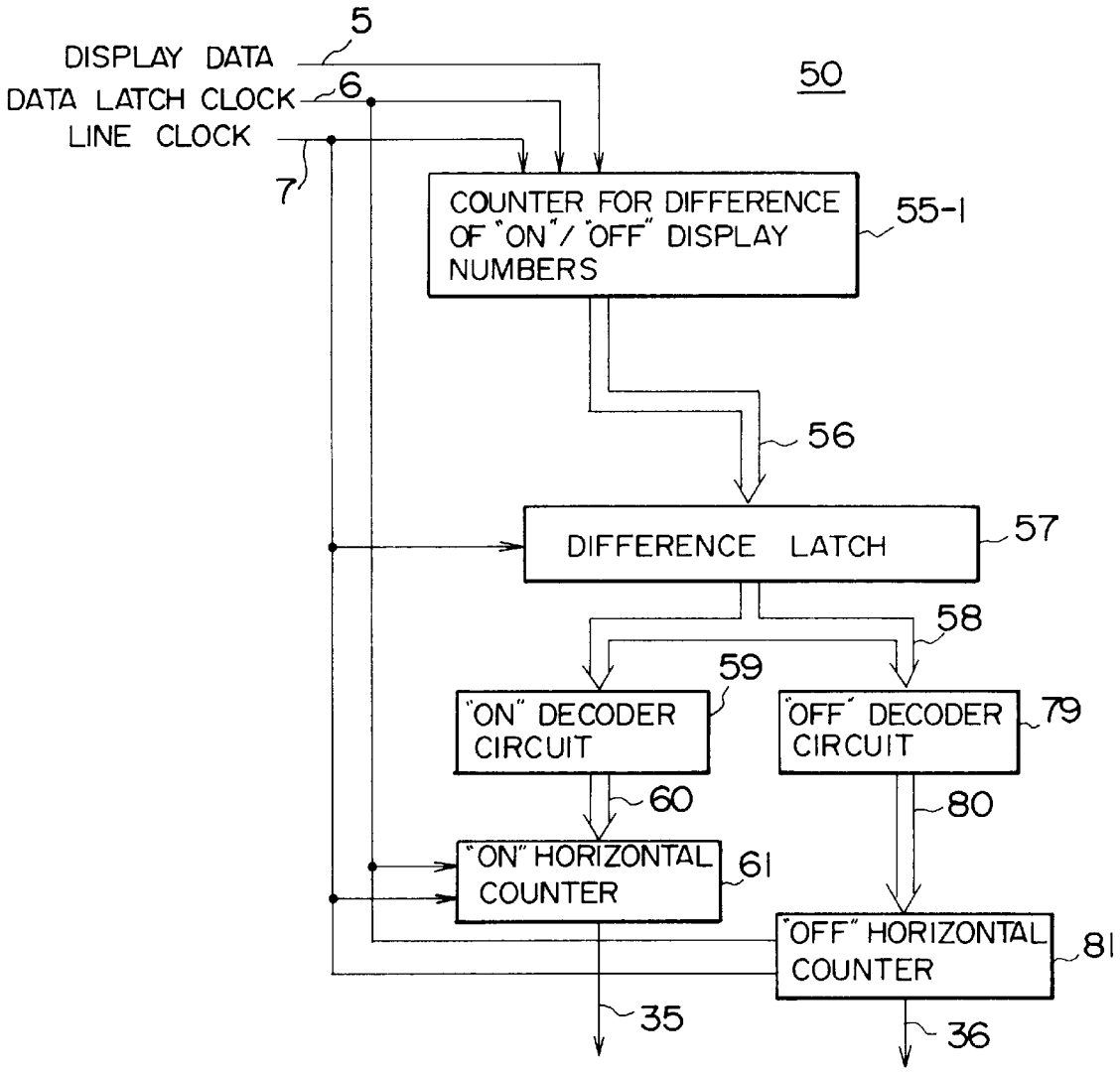
FIG. 25 is a circuit diagram showing still another example of the correction clock generator circuit in the third embodiment.

As illustrated in FIG. 25, it is also possible to employ a counter 55-1 for the difference of the ON/OFF display numbers, which has the same functions as those of the ON-display counter 51, OFF-display counter 53 and difference circuit 55 shown in FIG. 16.

Figure 26:
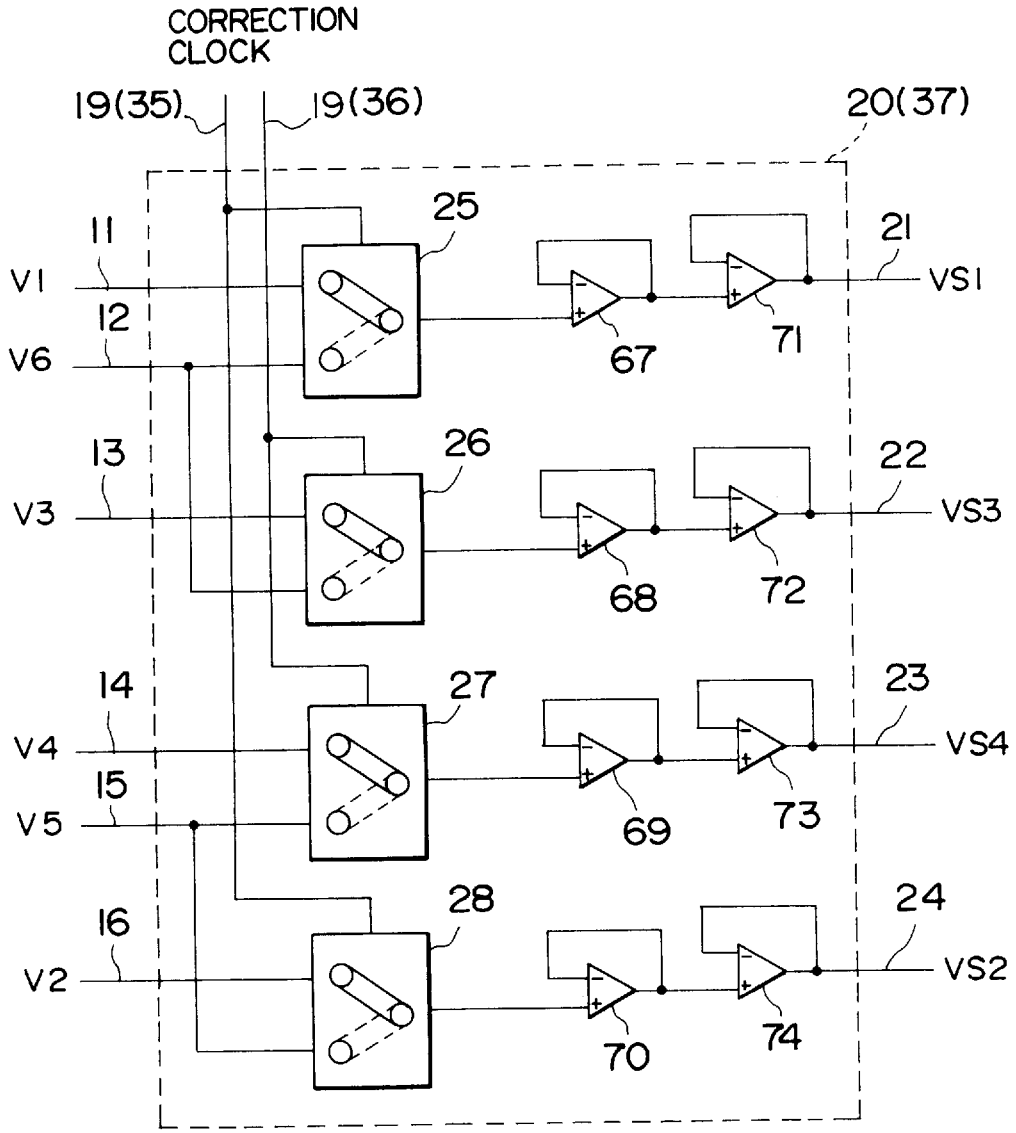
FIG. 26 is a circuit diagram showing another example of the voltage selector (20 or 37) in each of the embodiments of the present invention.
Figure 28:
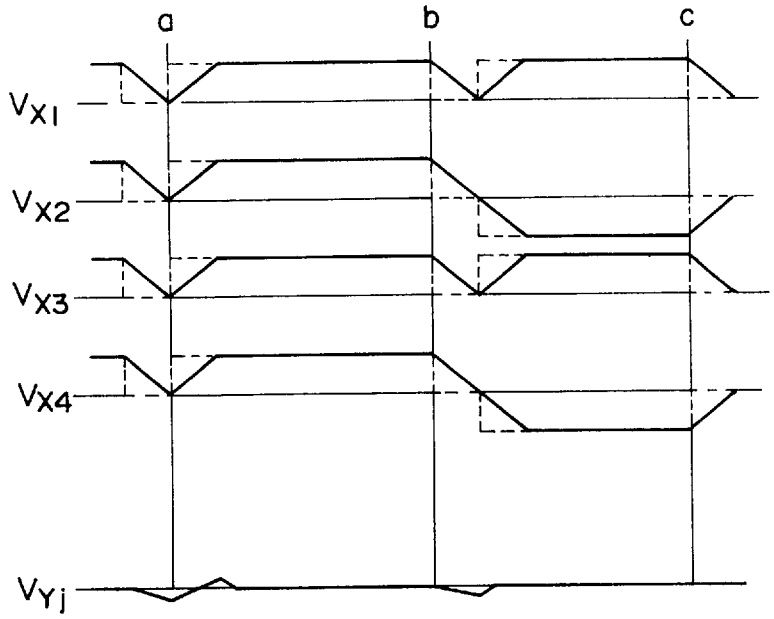
FIG. 28 is a diagram of the output waveforms of the X drive circuit and a Y drive circuit in the case of employing the voltage selector in FIG. 26.
Figure 29:
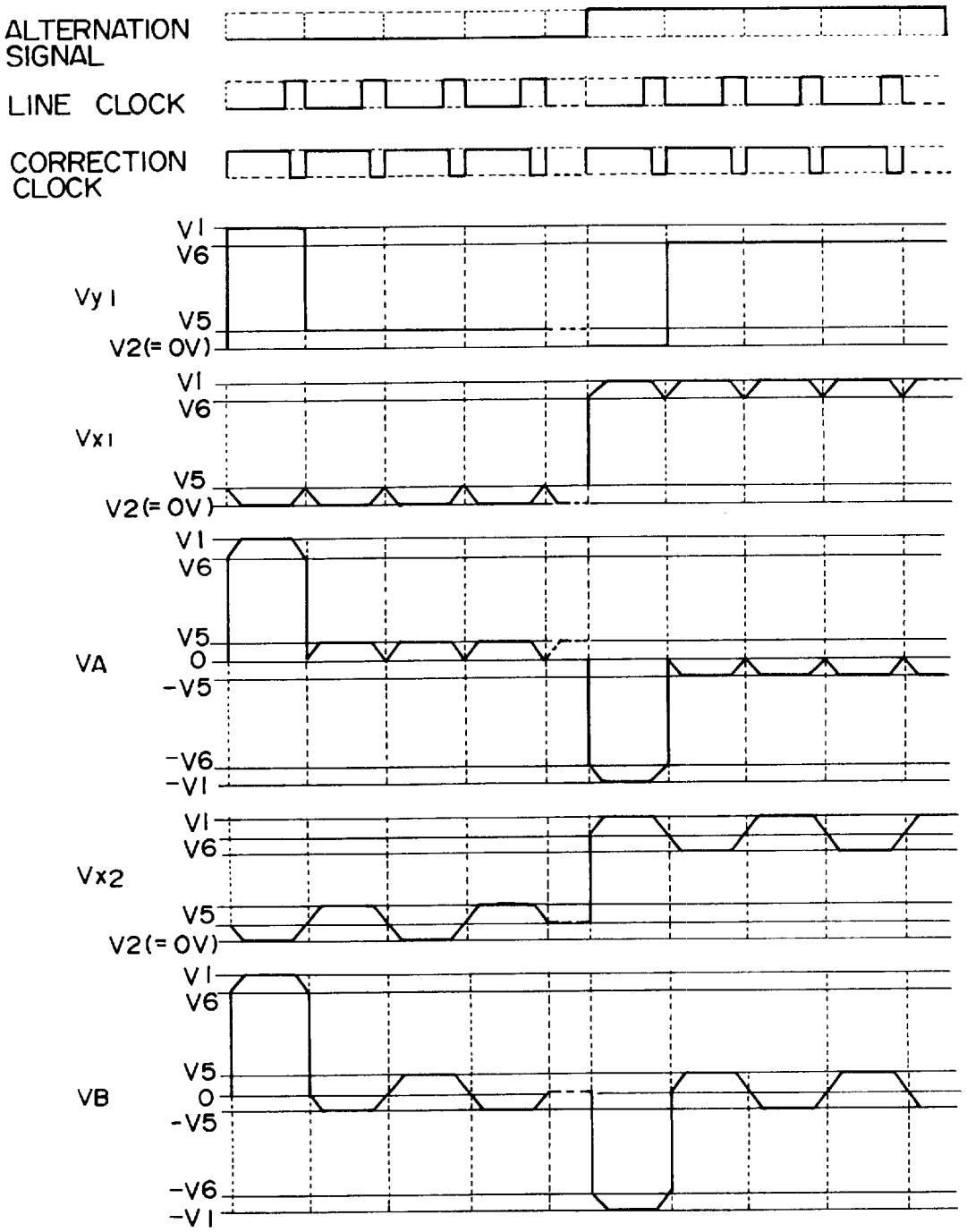
FIG. 29 is a timing chart showing the waveforms of applied voltages to a liquid crystal in the case of employing the voltage selector in FIG. 26.

FIG. 26 shows another example of the arrangement of the voltage selector 20. Referring to FIG. 26, numerals 67–74 indicate operational amplifiers, and the other constituents are the same as in the arrangement of the voltage selector 20 in FIG. 3. The operational amplifier circuits 67–70 (voltage follower circuits) are of the type having low slew rates, and they fail to conform to the switching operations of the selectors 25–28, thereby to undergoing delays. As a result, these circuits 67–70 can bring the voltage changes into triangular waves (refer to FIG. 27). In order to stabilize the triangular waves, the outputs of the circuits 67–70 are further passed through the operational amplifier circuits 71–74 (voltage follower circuits) of high slew rates, whereupon the output voltages of these circuits 71–74 are afforded to the X drive circuit 2. Owing to the fact that the voltage changes are turned into the triangular waves, the outputs of the X drive circuit 2 can be rendered less influential on the output of the Y drive circuit 3 than in the case of the square waves as illustrated in FIG. 28. FIG. 29 illustrates how the waveforms of the applied voltages of the liquid crystal (FIG. 7) in the first embodiment change owing to the arrangement in FIG. 26.

Although, in the example of FIG. 26, the triangular waves are generated using the operational amplifiers of low slew rates, this measure is not restrictive. It is also allowed to generate the triangular waves by the use of time-constant circuits each of which includes a resistor and a capacitor. Besides, the waveform of the voltage changes during the correction time periods is not restricted to the triangular waveform, but similar effects are achieved with a waveform with a reduced high-frequency component, a sine waveform, etc.

In addition, the circuit arrangement of the voltage selector shown in FIG. 26 is also applicable to the voltage selector 37 constituting the embodiment in FIG. 15.

The liquid-crystal display devices thus far described employ the liquid-crystal panels of one-frame construction 1 in which the number of display lines "j" is small, as illustrated in FIGS. 1, 8 and 15. The applications of the present invention to liquid-crystal display devices with liquid-crystal panels constructed having two, upper and lower frames in which the number of display lines are as comparatively large as 400, 480 and 780 dots, will be described with reference to FIGS. 30–33.

Figure 30:
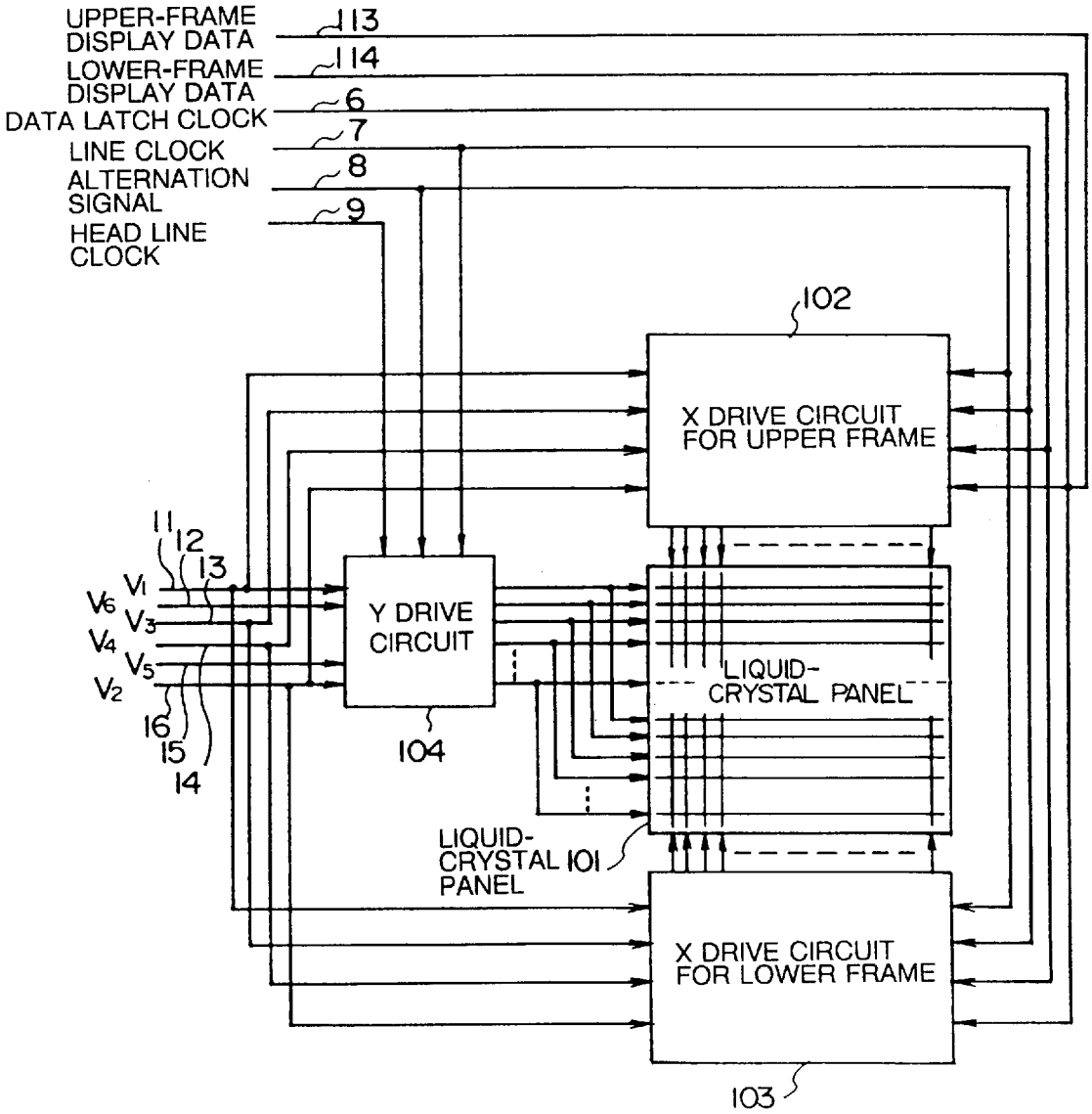
FIG. 30 PRIOR ART
FIG. 30 is a block diagram showing the construction of a prior-art liquid-crystal display device of two, upper and lower frames to which the fourth embodiment of the present invention is to be applied.

FIG. 30 is a block diagram of the liquid-crystal display device of two-frame construction having heretofore been known. The liquid-crystal panel 101 is constructed having the two, upper and lower frames. Numerals 102 and 103 indicate X drive circuits for the upper frame and for the lower frame, respectively, and these X drive circuits operate similarly to the fore-going X drive circuit 2 for the single frame. A Y drive circuit 104 functions to scan the two, upper and lower frames simultaneously. Numerals 113 and 114 designate display data for the upper frame and display data for the lower frame, respectively. The other constituents are the same as in the case of employing the liquid-crystal panel of the one-frame construction.

By way of example, in the case where the number of display lines is 400 (each of the upper and lower frames contains 200 lines), the Y drive circuit 104 accepts the head line clock 9 in response to the line clock 7 so as to simultaneously select the head line (Y1) of the upper frame and that (Y201) of the lower frame for scanning operations. Thenceforth, it shifts the scanning lines of the upper frame and lower frame simultaneously in accordance with the line clock pulses 7. Owing to such a scheme, the two, upper and lower frames can be displayed in the display time period of one frame (a one-frame period). From a different viewpoint, the number of the display dots which the single Y drive circuit scans during one scanning period is double that in the single-frame display scheme. That is, in a case where one line contains 640 display dots, the number of display dots to be scanned during the scanning period of one line becomes 1280.

Figure 31:
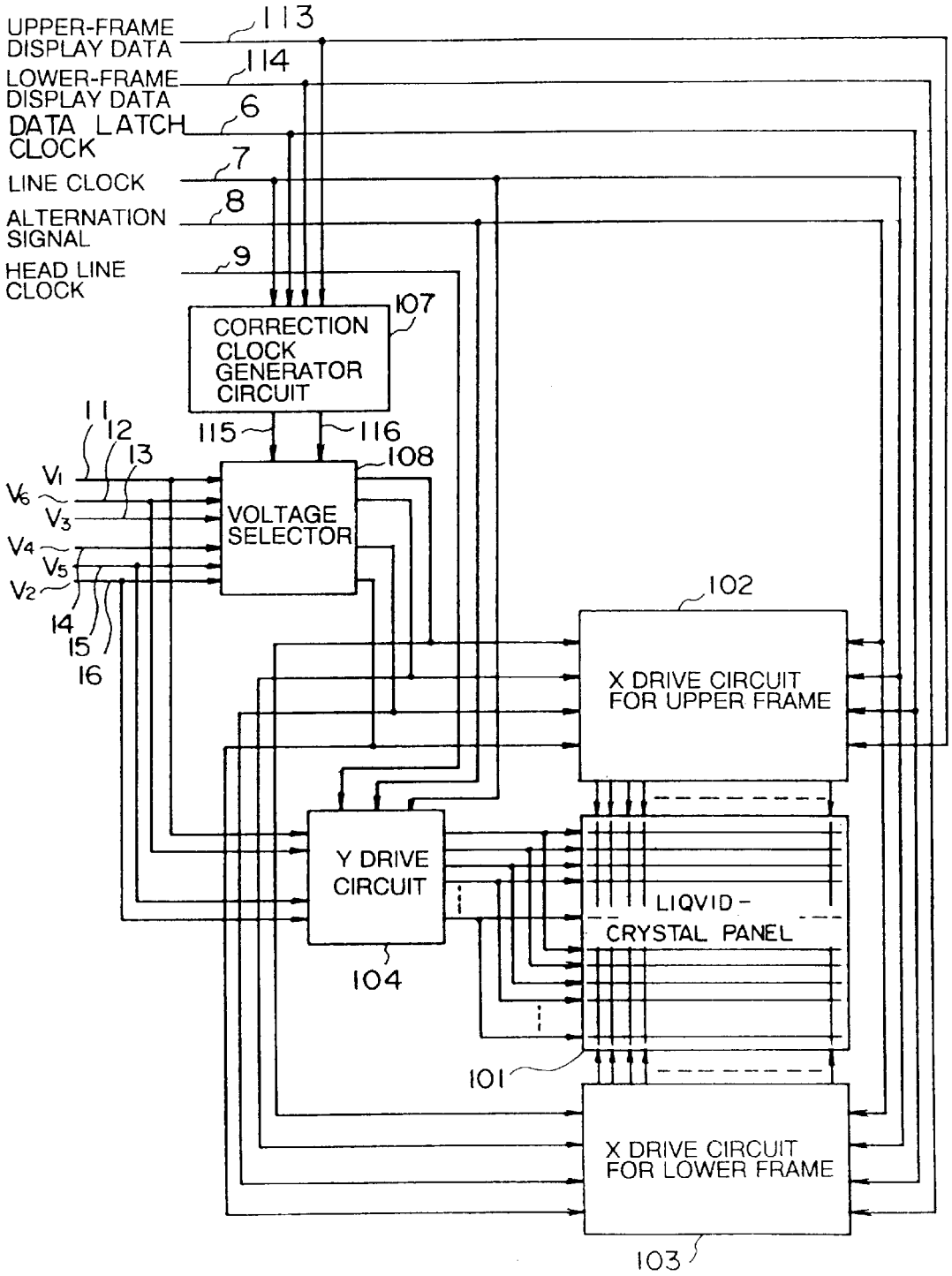
FIG. 31 is a block diagram showing the construction of a liquid-crystal display device in the fourth embodiment.

A construction in which the foregoing expedient of changing the durations of the correction clock pulses in accordance with the display data items (the third embodiment) is applied to the liquid-crystal display device in the prior art, is shown as the fourth embodiment in FIG. 31.

Referring to FIG. 31, numeral 107 indicates a correction clock generator circuit by which the durations of correction clock pulse trains 115 and 116 separated for ON-display data items and OFF-display data items are controlled depending upon their respective display states. Numeral 108 indicates a voltage selector by which the supply voltages to be afforded to the upper-frame X drive circuit 102 and lower-frame X drive circuit 103 are selected in conformity with the ON-displaying correction clock 115 and OFF-displaying correction clock 116, respectively. The other constituents are the same as in the construction shown in FIG. 30. In the case where one line contains 640 display dots, the number of display dots to be scanned during the scanning period of one line becomes 1280. The correction clock generator circuit 107 detects the display states during the scanning period of one line, that is, the difference between the numbers of the ON-display items and OFF-display items in the aforementioned 1280 dots, whereupon it generates the correction clock pulse trains 115, 116.

Incidentally, the voltage selector 108 affords the same set of supply voltages to both the upper-frame X drive circuit 102 and lower-frame X drive circuit 103.

Figure 32:
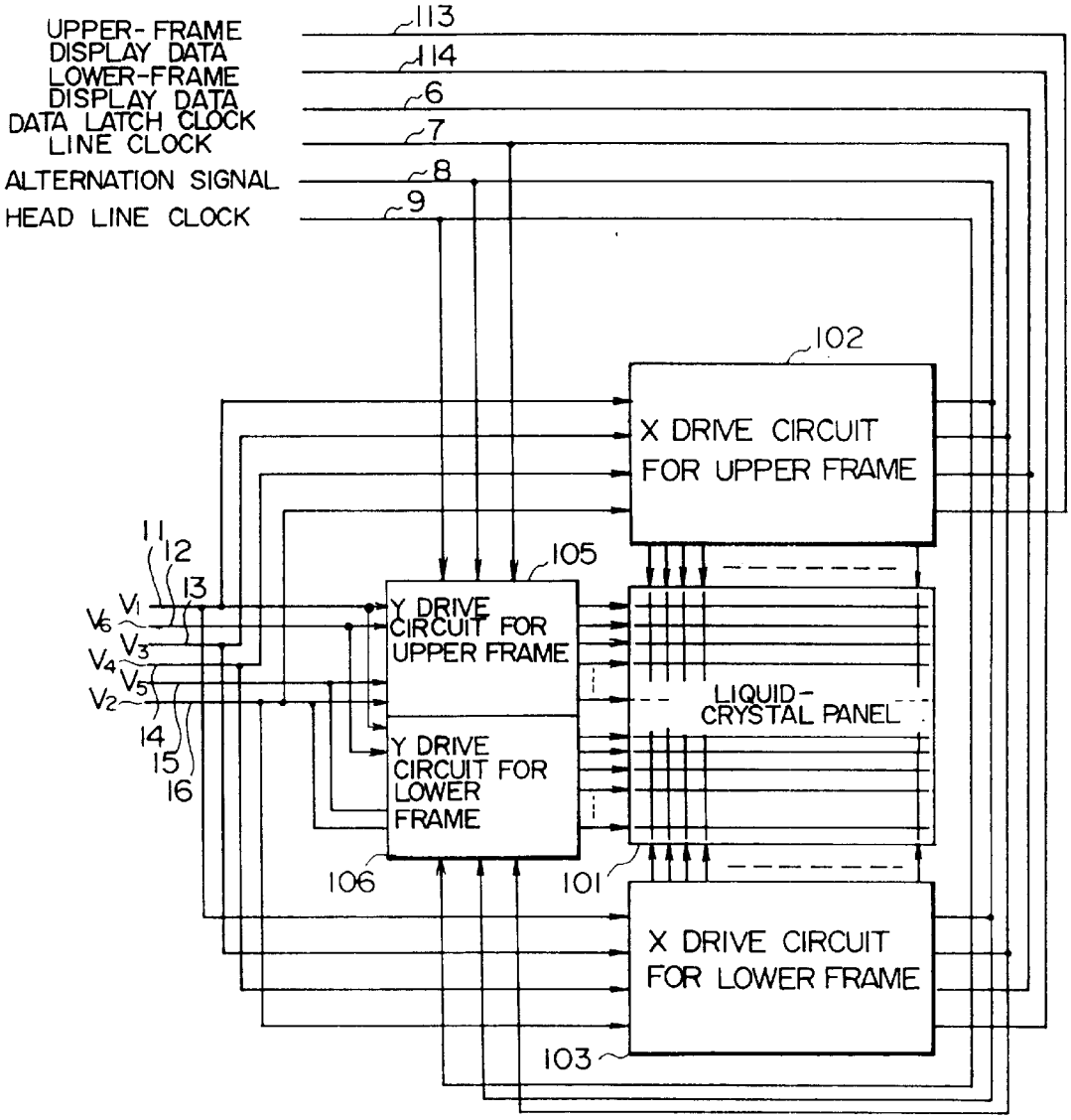
FIG. 32 PRIOR ART
FIG. 32 is a block diagram showing the construction of another prior-art liquid-crystal display device of two, upper and lower frames to which the fifth embodiment of the present invention is to be applied.

Next, FIG. 32 is a block diagram of another liquid-crystal display device of two-frame construction having heretofore been known. The liquid-crystal panel 101 is constructed having the two, upper and lower frames. Numerals 102 and 103 indicate X drive circuits for the upper frame and for the lower frame, respectively, and these X drive circuits operate similarly to the foregoing X drive circuit 2 for the single frame. Numerals 105 and 106 indicate Y drive circuits for the upper frame and for the lower frame, respectively, and these Y drive circuits operate similarly to the foregoing Y drive circuit 2 for the single frame. Numerals 113 and 114 designate display data for the upper frame and display data for the lower frame, respectively. The other constituents are the same as in the case of employing the liquid-crystal panel of the one-frame construction. By way of example, in the case where the number of display lines is 400 (each of the upper and lower frames contains 200 lines), the upper-frame Y drive circuit 105 accepts the head line clock 9 in response to the line clock 7 so as to select the head line of the upper frame for a scanning operation. Thenceforth, it shifts the scanning lines of the upper frame sequentially in accordance with the line clock pulses 7. On the other hand, the lower-frame Y drive circuit 106 accepts the head line clock 9 in response to the line clock 7 so as to select the head line of the lower frame for a scanning operation. Thenceforth, it shifts the scanning lines of the lower frame sequentially in accordance with the line clock pulses 7. Owing to such a scheme, the two, upper and lower frames can be displayed in the display time period of one frame (a one-frame period).

Figure 33:
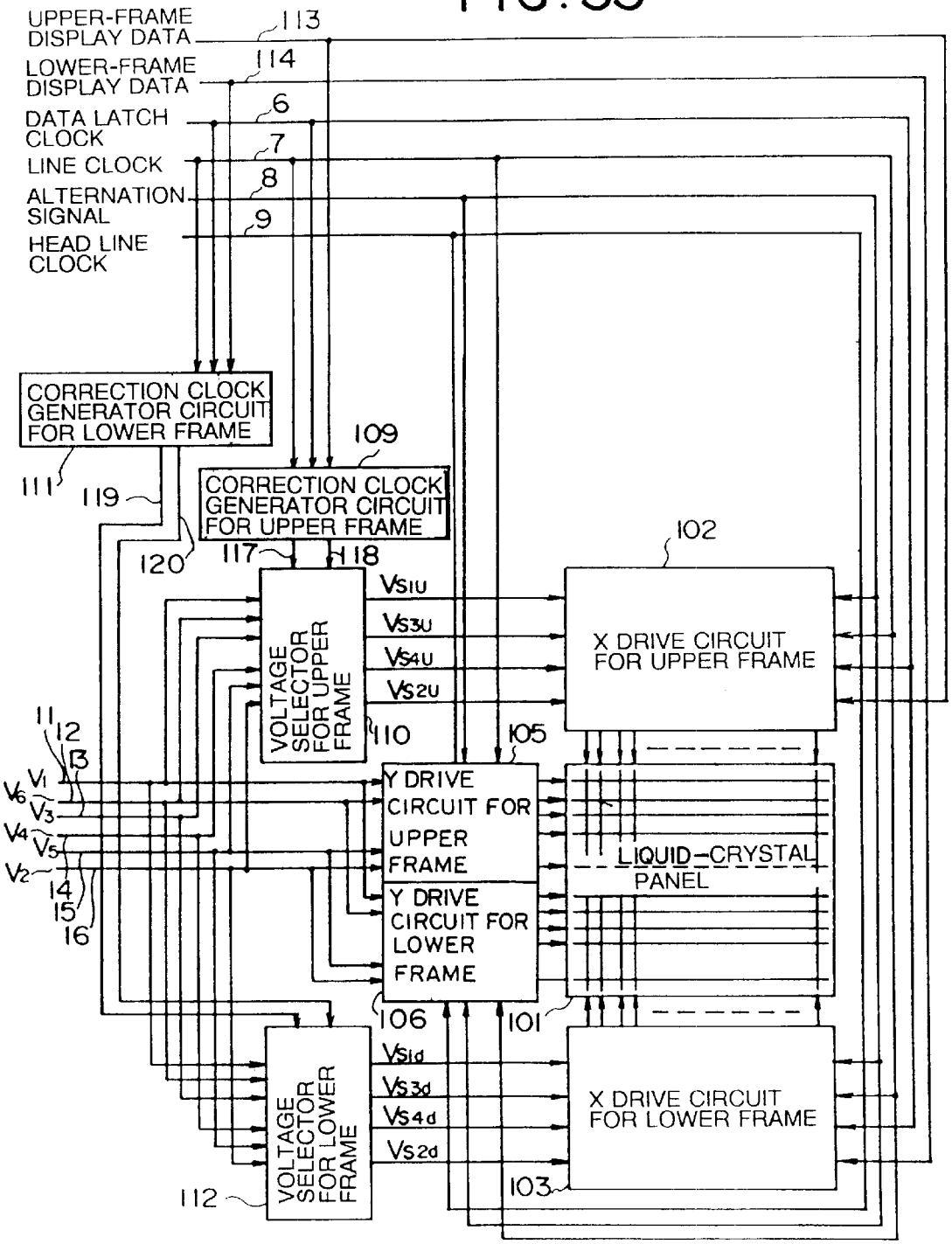
FIG. 33 is a block diagram showing the construction of a liquid-crystal display device in the fifth embodiment.

A construction in which the third embodiment is applied to the prior-art liquid-crystal display device in FIG. 32, is shown as the fifth embodiment in FIG. 33.

Referring to FIG. 33, numeral 109 indicates a correction clock generator circuit for the upper frame, by which the durations of correction clock pulse trains 117 and 118 separated for ON-display data items and OFF-display data items are controlled depending upon the respective display states of the upper frame. Numeral 110 indicates a voltage selector for the upper frame, by which the supply voltages to be afforded to the upper-frame X drive circuit 102 are respectively selected in conformity with the ON-displaying correction clock 117 and OFF-displaying correction clock 118. Likewise, numeral 111 indicates a correction clock generator circuit for the lower frame, by which the durations of correction clock pulse trains 119 and 120 separated for ON-display data items and OFF-display data items are controlled depending upon the respective display states of the lower frame. Numeral 112 indicates a voltage selector for the lower frame, by which the supply voltages to be afforded to the lower-frame X drive circuit 103 are respectively selected in conformity with the ON-displaying correction clock 119 and OFF-displaying correction clock 120. The Y drive circuits are independent for the upper frame and for the lower frame. Therefore, in the case where one line contains 640 display dots, the number of display dots to be scanned during the scanning period of one line by each of the Y drive circuits becomes 640. The correction clock generator circuits 109 and 111 detect the display states during the scanning period of one line, that is, the differences between the number of ON-display items and OFF-display items in the aforementioned 640 dots, and they generate the correction clock pulse trains 117, 118 and 119, 120, respectively.

Accordingly, the upper frame and the lower frame are driven quite independently of each other. Therefore, the supply voltages which are afforded from the upper-frame voltage selector 110 to the upper-frame X drive circuit 102 are different from the supply voltages which are afforded from the lower-frame voltage selector 112 to the lower-frame X drive circuit 103. In contrast, the supply voltages which are afforded to the upper-frame Y drive circuit 105 are the same as the supply voltages which are afforded to the lower-frame Y drive circuit 106.

Now, the sixth embodiment of the present invention will be described with reference to FIGS. 34–43(*b*).

This embodiment eliminates nonuniformity in display brightness in such a way that the magnitude of distortion in the waveform of an applied voltage to a liquid crystal is calculated from the ON-display and OFF-display states of display data in one horizontal display time period (the scanning period of one line), and that a correction voltage for compensating the distortion is applied in a correction time period set every horizontal time period.

Figure 34:
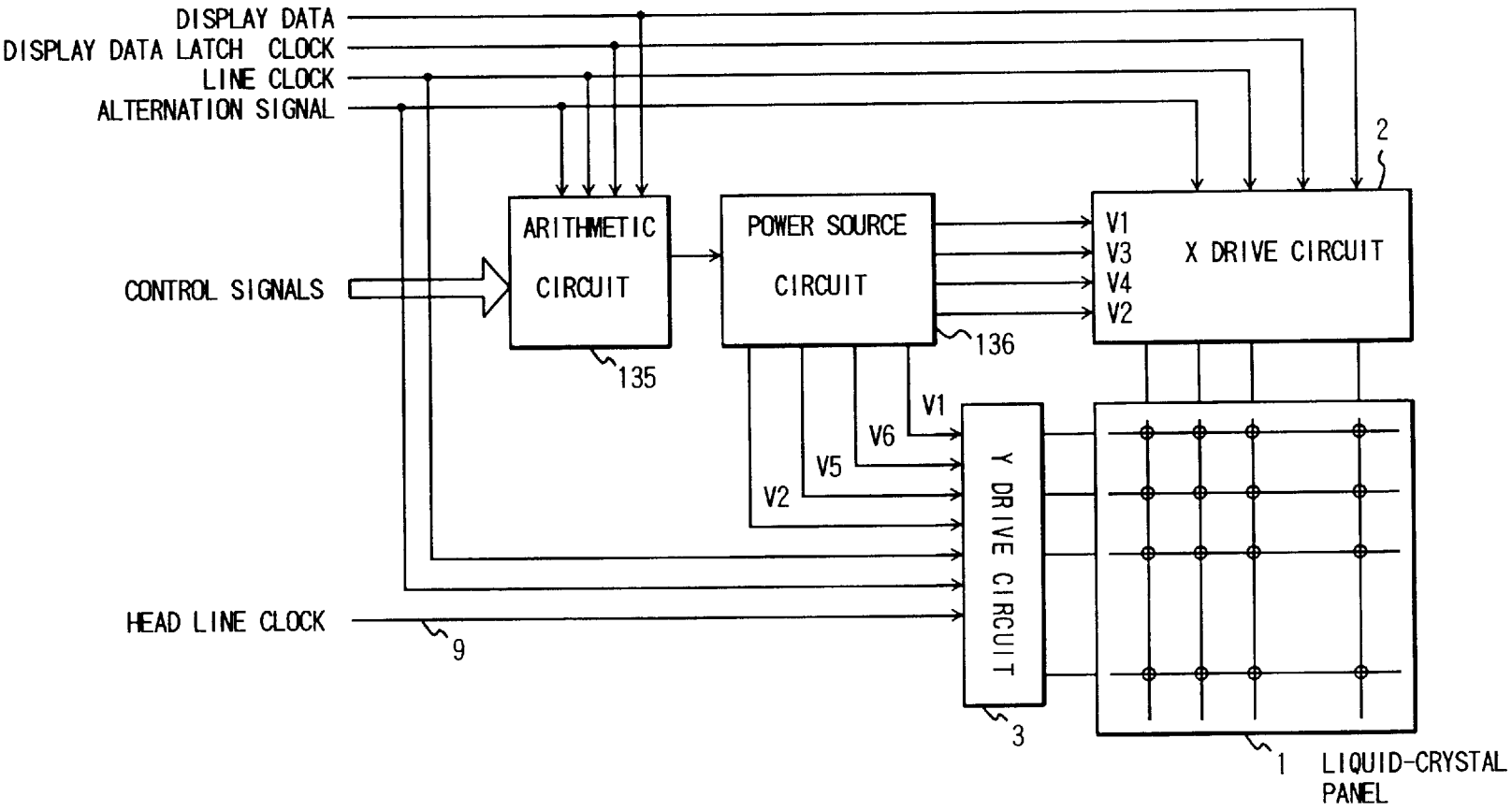
FIG. 34 is a block diagram showing the construction of a liquid-crystal display device in the sixth embodiment of the present invention.

FIG. 34 is a block diagram showing a liquid-crystal display device in the sixth embodiment. Referring to the figure, as in the foregoing embodiments, a liquid-crystal panel 1 shifts the states of the liquid crystal on the basis of the difference between the output voltages of an X driver 2 and a Y driver 3, thereby presenting a display. An arithmetic circuit 135 detects the change points of the display data and those of an alternation signal which will be the cause for distorting the applied voltage of the liquid crystal, and it calculates the magnitude of the distortion of the applied voltage of the liquid crystal on the basis of the number of change points. Then, an output supply voltage from a power source circuit 136 is changed-over to the correction voltage on the basis of the magnitude of the distortion. The X driver 2 switches output supply voltages from the power source circuit 136 and delivers them to the liquid-crystal panel 1 in accordance with the display data, as well as control signals consisting of a data latch clock, a line clock and the alternation signal, while the Y driver 3 does so in accordance with the control signals.

Figure 35:
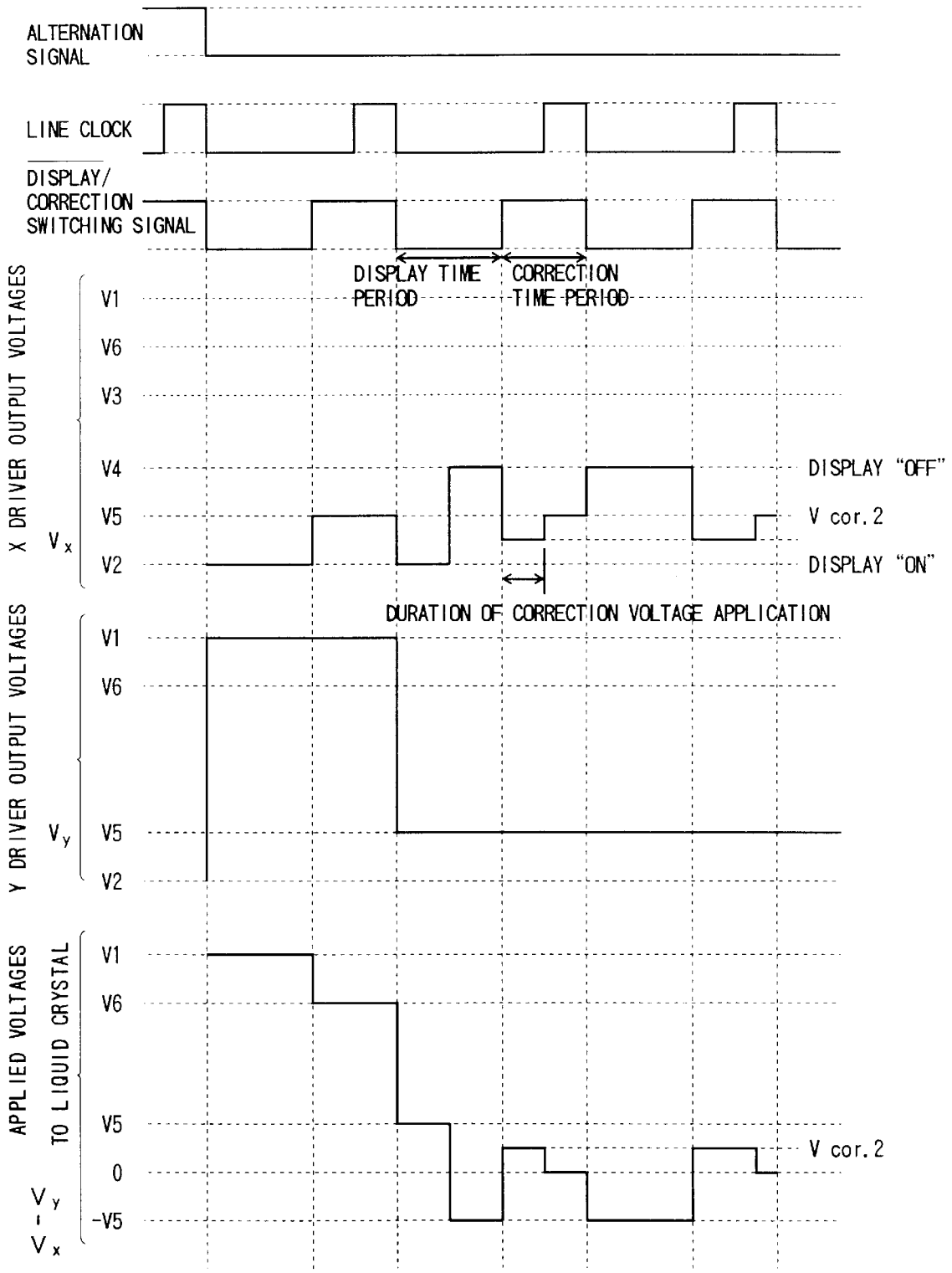
FIG. 35 is a timing chart illustrating the operation of the sixth embodiment.

FIG. 35 illustrates the waveforms of the applied voltages of the liquid crystal in the sixth embodiment. As seen from the figure, the scanning period of one line is divided into a display time period and the correction time period which have predetermined lengths. Further, a duration for which the correction voltage (Vcor.2) is applied in response to the output of the arithmetic circuit 135 is determined within the correction time period. The voltage V5 is applied for that time period within the correction time period which is other than the application duration of the correction voltage, so as to bring the applied voltage (VY−VX) of the liquid crystal to 0 [V]. Incidentally, FIG. 35 illustrates the states in the case where the alternation signal is "low" (L), and the voltages V2, V5, V4 and Vcor.2 are respectively replaced with the voltages V1, V6, V3 and Vcor.1 when the alternation signal is "high" (H).

Figure 36:
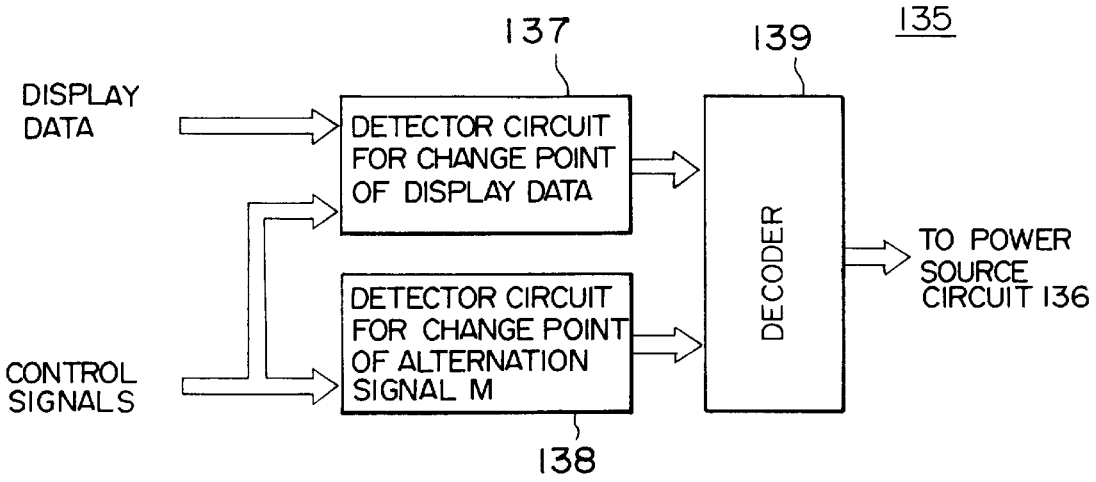
FIG. 36 is a block diagram showing the internal arrangement of an arithmetic circuit (135) in the sixth embodiment.

FIG. 36 shows an internal block diagram of the arithmetic circuit 135. This arithmetic circuit 135 is comprised of a display-data change point detector circuit 137 for detecting the change point of the display data, an alternation-signal-M change point detector circuit 138 for detecting the change point of the alternation signal M among the control signals, and a decoder 139 for evaluating the correction magnitude from the outputs of the detector circuits.

Figure 37:
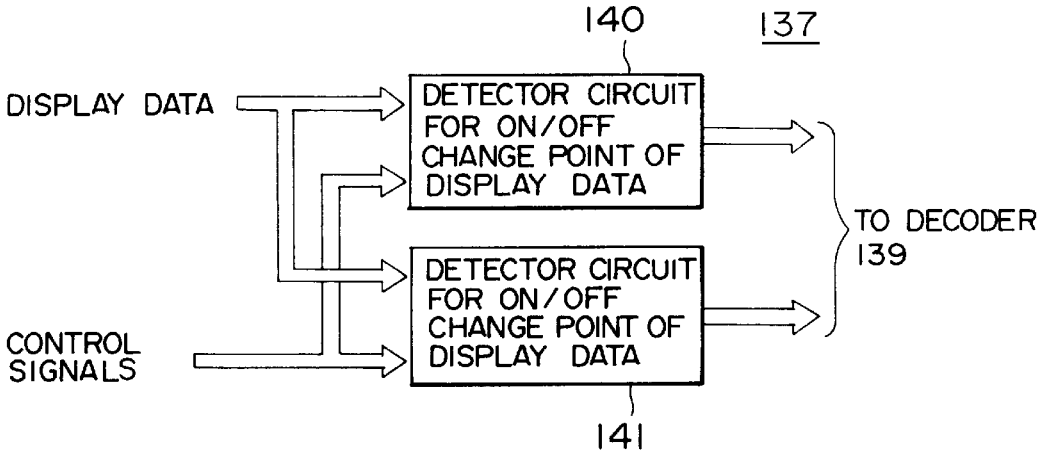
FIG. 37 is a block diagram showing the internal arrangement of a display-data change point detector circuit (137) shown in FIG. 36.

As shown in FIG. 37, the display-data change point detector circuit 137 is comprised of a display-data OFF/ON-change point detector circuit 140 for detecting the number of times which the display data changes from the OFF-display state to the ON-display state during the display of one line, and a display-data ON/OFF-change point detector circuit 141 for detecting the number of times which the display data similarly changes from the ON-display state to the OFF-display state. The provision of the respective circuits for detecting the number of transitions from the OFF state to the ON state of the display data and the number of transitions from the ON state to the OFF state, is intended to enhance the precision of the correction in view of the fact that the distortion magnitude of the waveform of the applied voltage of the liquid crystal differs between the change from the OFF-display state to the ON-display state and the change from the ON-display state to the OFF-display state. In a case where the precision of the correction of the distortion of the waveform of the applied voltage of the liquid crystal is allowed to be lower, it well be that only one of the detector circuits 140 and 141 is provided.

Figure 38:
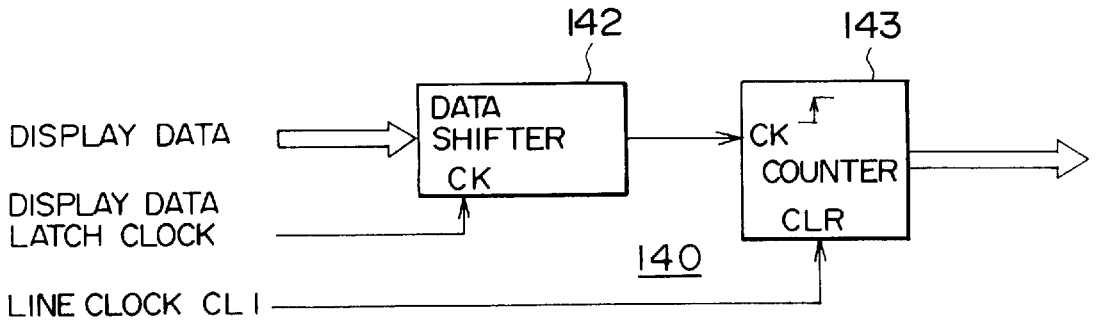
FIG. 38 is a circuit diagram showing the internal arrangement of a display-data OFF/ON change point detector circuit (140) shown in FIG. 37.

As shown in FIG. 38, the internal arrangement of the display-data OFF/ON-change point detector circuit 140 includes a data shifter 142 which shifts the parallel display data items in accordance with the display-data latch clock among the control signals, thereby converting them into serial display data items, and a counter 143 which rises with the output serial display data items of the data shifter 142 as clock pulses, thereby counting the OFF/ON changes.

Figure 39:
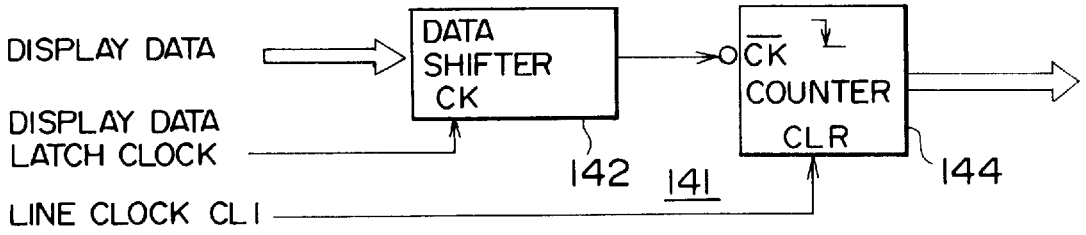
FIG. 39 is a circuit diagram showing the internal arrangement of a display-data ON/OFF change point detector circuit (141) shown in FIG. 37.

As shown in FIG. 39, the internal arrangement of the display-data ON/OFF-change point detector circuit 141 includes a data shifter 142, and a counter 144 which falls with the output serial display data items of the data shifter 142 as clock pulses, thereby counting the ON/OFF changes. The counters 143 and 144 are reset by the "high" part ("H" or "1") of the pulse of the line clock CL1. The count values of these counters are delivered to the decoder 139.

Figures 40A, 40B:
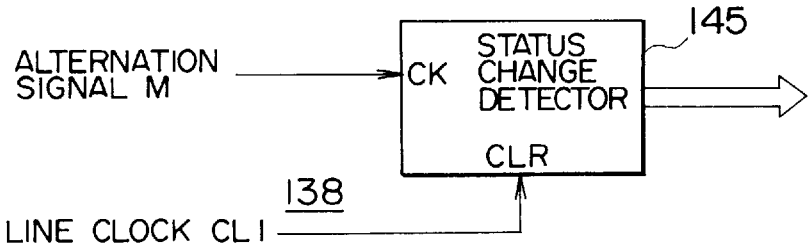
FIG. 40(*a*) is a circuit diagram showing the internal arrangement of an alternation-signal (M) change point detector circuit (138) shown in FIG. 36, while FIG. 40(*b*) is a table for explaining the operation of the detector circuit (138)

FIG. 40(*a*) shows the internal arrangement of the detector circuit 138 for the change point of the alternation signal M, while FIG. 40(*b*) shows a table for explaining the operation of this detector circuit. A state shift detector 145 receives the alternation signal M, and it delivers the level "H" (or "1") when the signal M has changed from the level "H" to the level "L" (or "0"), or vice versa. In addition, it is reset by the "high" part of the pulse of the line clock CL1.

Figure 41A:
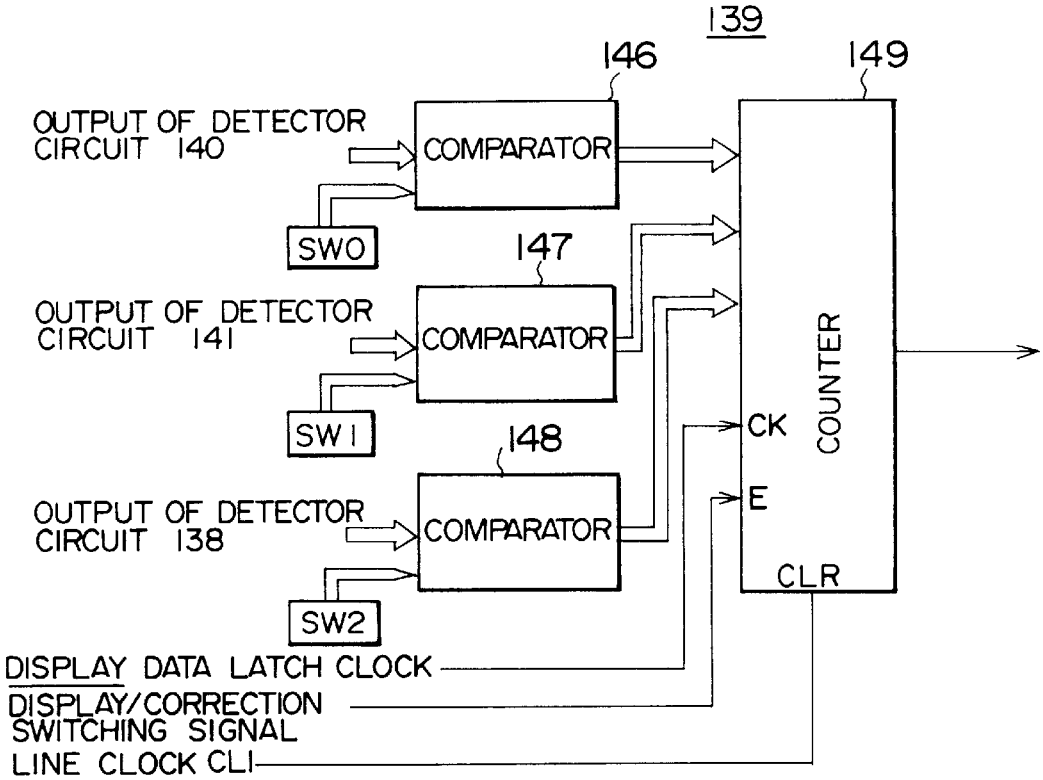
FIG. 41(*a*) is a block diagram showing the internal arrangement of a decoder (139) shown in FIG. 36, while FIG. 41(*b*) is a circuit diagram of a counter (149) in FIG. 41(*a*)
Figure 41B:
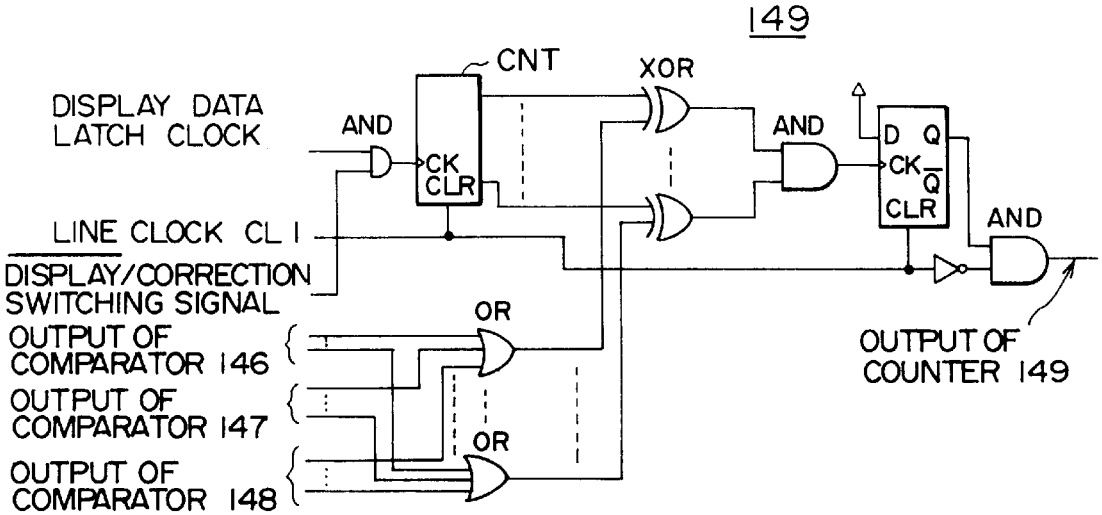

FIG. 41(*a*) shows the internal arrangement of the decoder 139. This decoder 139 is comprised of comparators 146–148, switches SW0–SW2 for producing data to-be-compared, and a counter 149. The comparator 146 is fed with the output of the display-data OFF/ON-change point detector circuit 140 and that of the switch SW0, while the comparator 147 is fed with the output of the display-data ON/OFF-change point detector circuit 141 and that of the switch SW1. Likewise, the comparator 148 is fed with the output of the alternation-signal-M change point detector circuit 138 and that of the switch SW2. Each of the comparators compares the output of the corresponding change point detector circuit with the set value of the corresponding switch for each bit, and produces "1" outputs for coincident bits. In the counter 149, the outputs of the comparators 146–148 are subjected to a logical sum for every identical bit as illustrated in FIG. 41(*b*). A counter element CNT included in the counter 149 counts the data latch clock pulses in the correction time period. The count value is compared with the result of the logical sum of the outputs of the comparators, and when they have coincided, the output of the counter 149 is changed from "0" to "1". Incidentally, the output of the counter 149 is cleared to "0" by the "high" part of the pulse of the line clock CL1.

In this way, the arithmetic circuit 135 detects the number of transitions from the ON-display state to the OFF-display state or/and from the OFF-display state to the ON-display state of the display data to be presented by the liquid crystal, and the number of transitions of the alternation signal M among the control signals. These detected numbers are converted into the data of the correction-voltage application duration corresponding to the distortion magnitude of the waveform of the applied voltage of the liquid crystal which the arithmetic circuit 135 delivers the data to the power source circuit 136 as the signal for the correction voltage application produced in the display-data latch clock unit.

Figure 42:
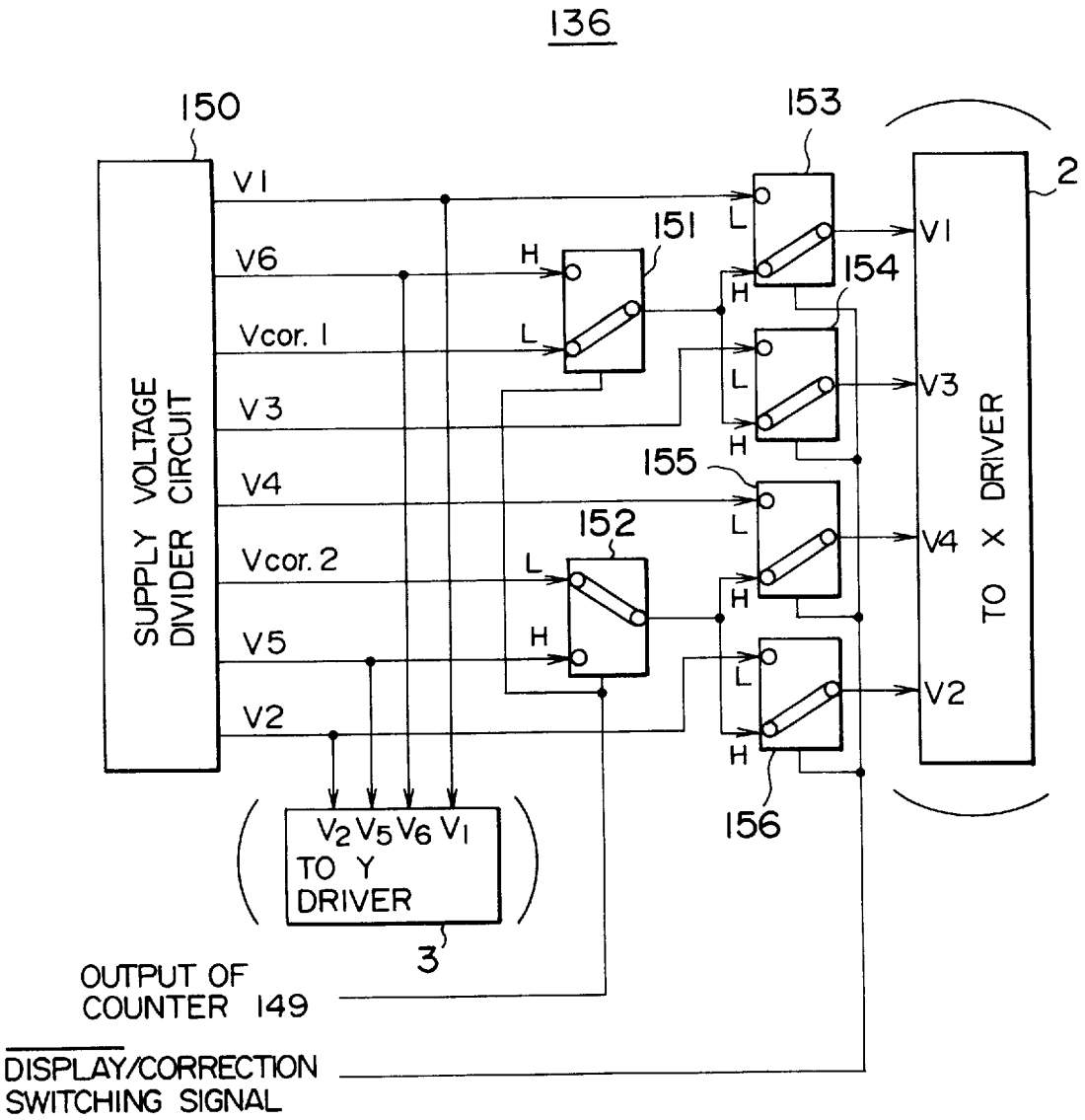
FIG. 42 is a block diagram showing the internal arrangement of a power source circuit (136) shown in FIG. 34.

FIG. 42 is a block diagram showing the internal arrangement of the power source circuit 136. A supply voltage divider circuit 150 divides a liquid-crystal driving supply voltage VLCD into the voltages V1, V6, Vcor.1, V3, V4, Vcor.2, V5 and V2, and delivers these voltages. Selectors 151 and 152 select the respective voltages Vcor.1 and Vcor.2 as the correction voltages of the distortion magnitudes of the waveforms of the applied voltages of the liquid crystal when the output of the counter 149 is "L", whereas they select the respective voltages V6 and V5 so as to bring the applied voltages of the liquid crystal to 0 [V] when the output of the counter 149 is "H". Selectors 153, 154, 155 and 156 operate in accordance with a display/correction switching signal. More specifically, the selectors 153–156 select the respective supply voltages V1, V3, V4 and V2 for the ordinary display operations and feed them to the X driver 2 during the display time period on condition that the display/correction switching signal is "L", whereas they deliver the respectively corresponding selected voltages of the selectors 151 and 152 during the correction time period on condition that the display/correction switching signal is "H". Thus, the correction voltages for compensating for the distortion magnitudes of the waveforms of the applied voltages of the liquid crystal are output as well as the applied voltages for the ordinary display operations, so that the effective values of the applied voltages of the liquid crystal are always held constant, thereby realizing the liquid-crystal display which is free from nonuniformity in display brightness.

The output voltages V1, V6, Vcor.1, V3, V4, Vcor.2, V5 and V2 of the power source circuit 136 have the relationships of V1>V6>V3>V4>V5>V2 and V6≧Vcor.1≧V4 as well as V3≧Vcor.2≧V5.

By the way, the data shifters 142, the counters 143, 144 and 149, and the state shift detector 145 shown in FIGS. 38–40(*a*) can be formed of the products "7474" belonging to the TTL "74" Series. The comparators 146, 147 and 148 shown in FIG. 41(*a*) can be formed of the products "7486" and "7400" also belonging to the TTL "74" Series.

Figure 43A:
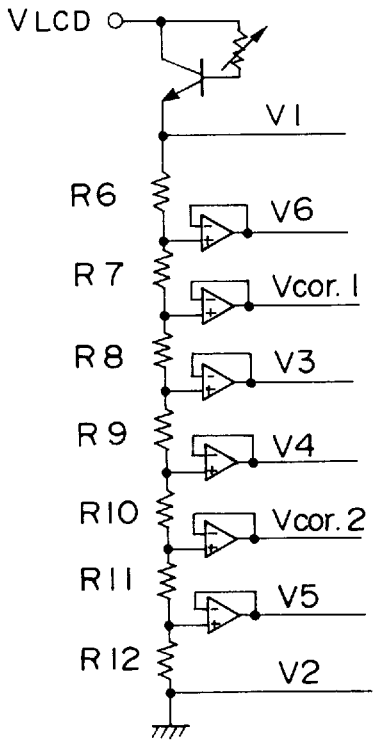
FIGS. 43(*a*) and 43(*b*) are circuit diagrams each showing an example of the internal arrangement of a supply voltage divider circuit (150) shown in FIG. 42.
Figure 43B:
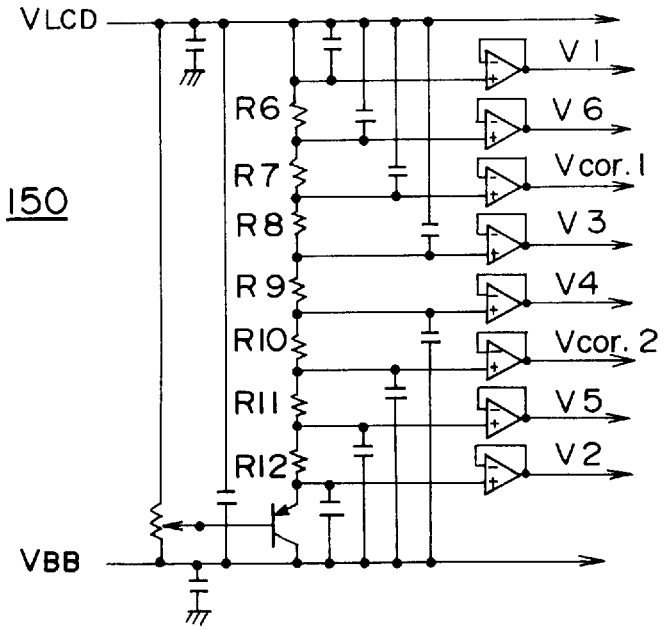

FIGS. 43(*a*) and 43(*b*) show two sorts of internal circuits of the supply voltage divider circuit 150 for reference.

Now, the seventh embodiment of the present invention will be described with reference to FIGS. 44–47(*b*). This embodiment does not correct the applied voltages of the liquid crystal at the respective scanning periods of one line, but it corrects them every display time period of one frame. More specifically, the distortion magnitudes of the waveforms of the applied voltages of the liquid crystal are calculated in accordance with the ON-display and OFF-display states of the display data of one frame and are stored in a memory, and the correction data items are read out of the memory so as to apply correction voltages in a correction time period set every frame display period, whereby non-uniformity in display brightness is eliminated.

Figure 44:
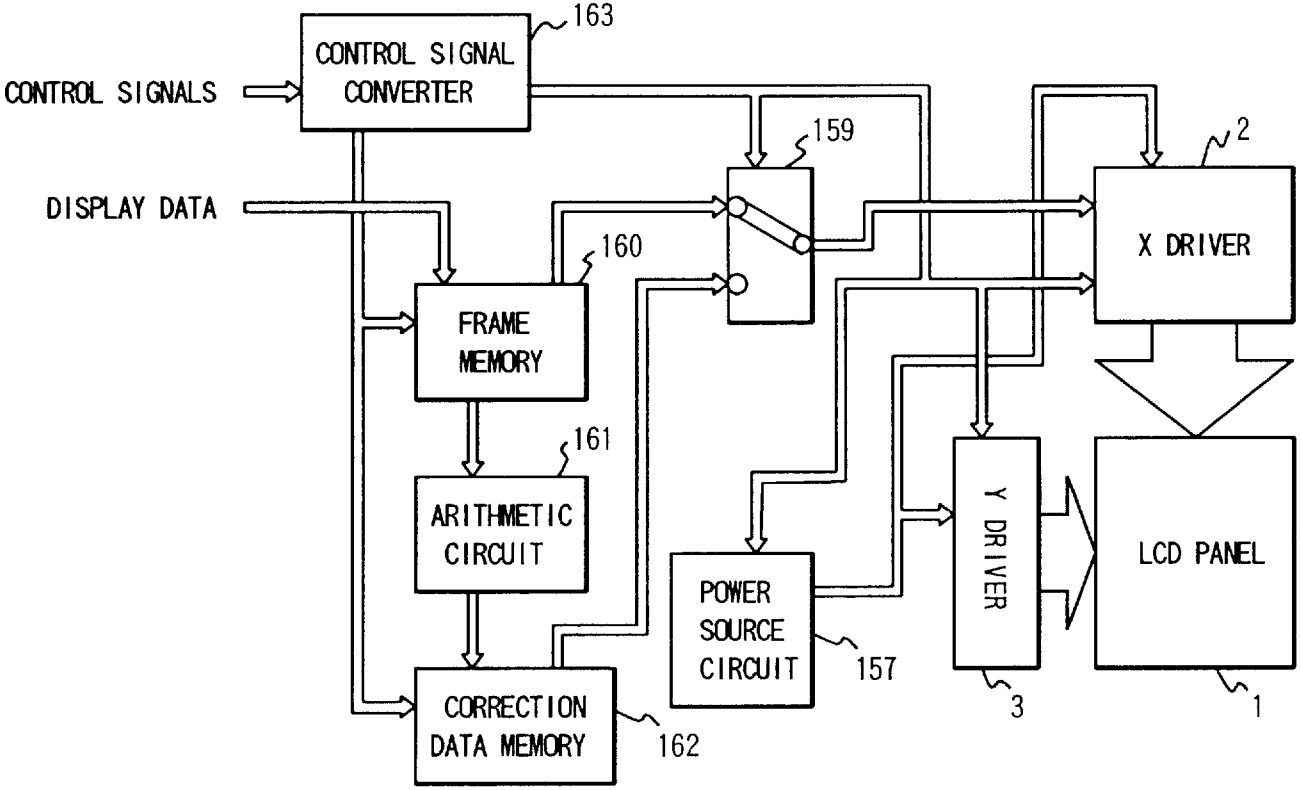
FIG. 44 is a block diagram showing the construction of a liquid-crystal display device in the seventh embodiment of the present invention.

FIG. 44 is a block diagram showing a liquid-crystal display device in the seventh embodiment of the present invention. Referring to the figure, as described before, a liquid-crystal display panel 1 presents a display in such a way that the state of the liquid crystal is shifted on the basis of the difference between the output potentials of an X driver 2 and a Y driver 3. The X driver 2 switches output supply voltages from a power source circuit 157 and delivers them to the liquid-crystal panel 1 in accordance with the display data, as well as control signals consisting of a data latch clock, a line clock and an alternation signal, while the Y driver 3 does so in accordance with the control signals.

A frame memory 160 stores the display data items corresponding to one frame. The data items from the frame memory 160 are converted by an arithmetic circuit 161 into the correction data items which compensate for the distortion magnitudes of the waveforms of the applied voltages attributed to the display data, and which are stored in the correction data memory 162. Each of the frame memory 160 and the correction data memory 162 can be formed using a memory IC (for example, "HM6264A") mentioned in "Hitachi IC Memory Data Book". Regarding the read cycle and write cycle of this memory IC, control signals which satisfy access timings stated in the above data book are generated by a control signal converter 163. The display data corresponding to one frame is read out of the frame memory 160, and is transferred to the X driver 2 so as to be displayed. Thereafter, the correction data is read out of the correction data memory 162 and is transferred. A selector 159 changes over the display data of one frame from the frame memory 160 and the correction data from the correction data memory 162 in accordance with a display/correction switching signal, and transfers them to the X driver 2 as the display data of each lateral line of the frame.

The control signal converter 163 converts control signals to be output for controlling the frame memory 160, correction data memory 162, selector 159, X driver 2, Y driver 3 and power source circuit 157, in accordance with the control signals consisting of the data latch clock, line clock and alternation signal.

Figure 45:
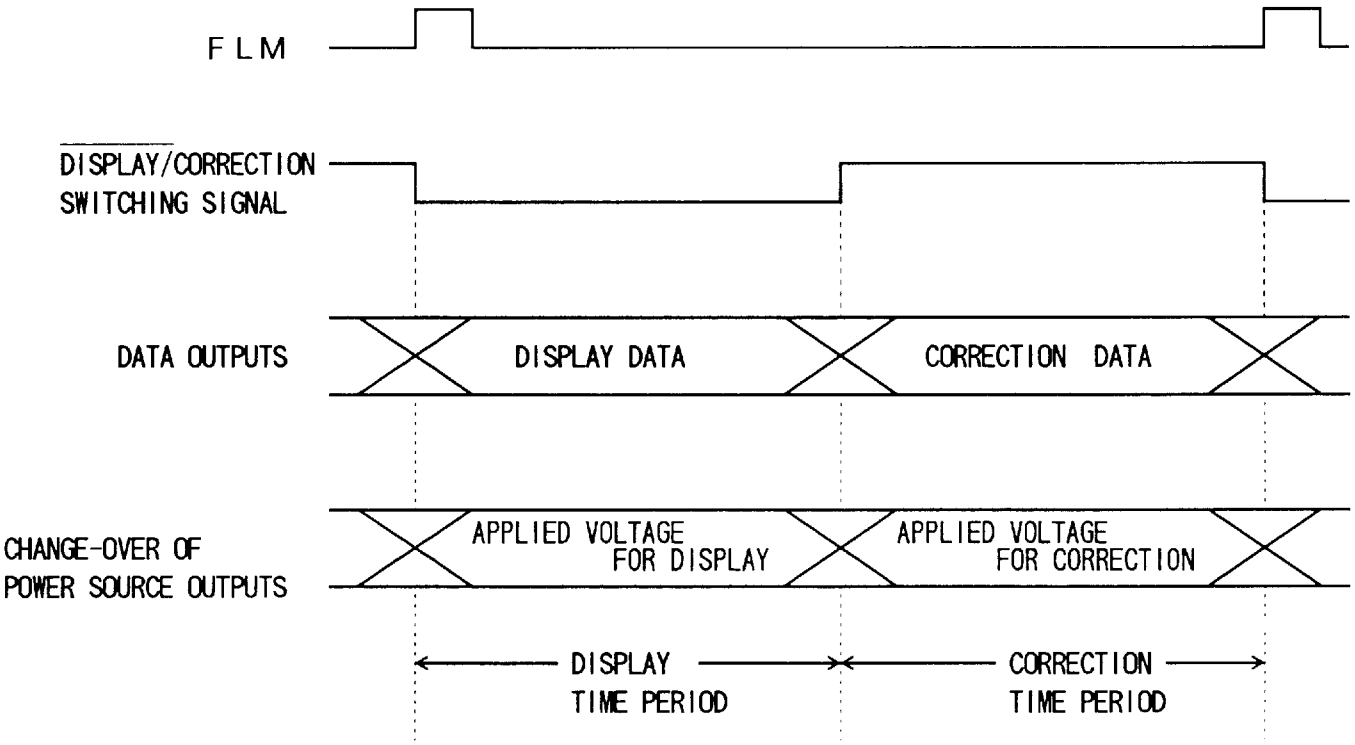
FIG. 45 is a timing chart illustrating the operation of the seventh embodiment.

FIG. 45 illustrates the change over timing of the display data and the correction data which are output to the X driver 2. The display data items of one frame to be displayed on the liquid-crystal panel 1, and the correction data items for compensating for the distortion magnitudes of the waveforms of the applied voltages of the liquid crystal caused by the display data items are transferred to the X driver 2 by changing over the selector 159, within a period for which the liquid-crystal panel 1 presents the display on the basis of a signal FLM (a frame synchronizing signal for each frame) being the control signal from the control signal converter 163, and in accordance with the display/correction switching signal being the control signal from the control signal converter 163. Incidentally, although the display time period and the correction time period are depicted as being substantially equal in the figure, they need not always have equal lengths.

Figure 46:
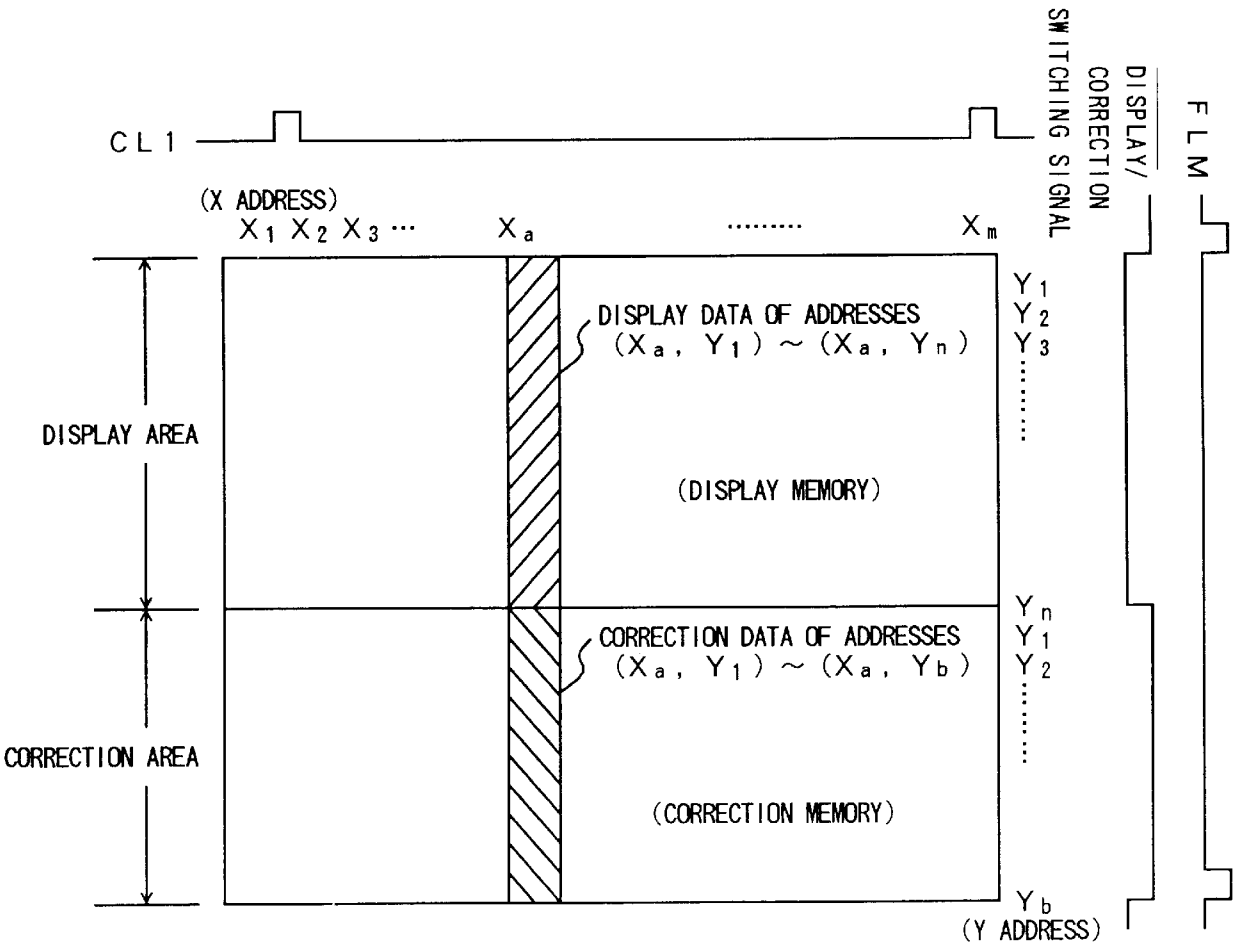
FIG. 46 is an explanatory diagram of a method of generating and transferring display data and correction data in the seventh embodiment.

A method of generating and transferring the display data and the correction data will be described with reference to FIG. 46. Assuming that the screen of the liquid-crystal panel 1 has a size of dots X1–Xm in the lateral direction thereof and dots Y1–Yn in the vertical direction thereof, the frame memory 160 has a memory size of the greatest column address Xm and the greatest row address Yn. On the other hand, the correction data memory 162 has a memory size of the greatest column address Xm being identical to that of the frame memory 160 and the greatest row address Yb. The display data items of the frame memory 160 corresponding to the column address Xa, that is, the display data items corresponding to addresses (Xa, Y1)–(Xa, Yn) in terms of (column address, row address) are read out. Subsequently, the correction data items for compensating for the distortion magnitudes of the waveforms of the applied voltages of the liquid crystal attributed to the difference between the numbers of the ON-display items and OFF-display items and to the arrayal of the ON- and OFF-display items are generated by the arithmetic circuit 161, and they are stored in the area of the correction data memory 162 corresponding to the column address Xa, that is, in the addresses (Xa, Y1)–(Xa, Yb) in terms of (column address, row address).

Figure 47A:
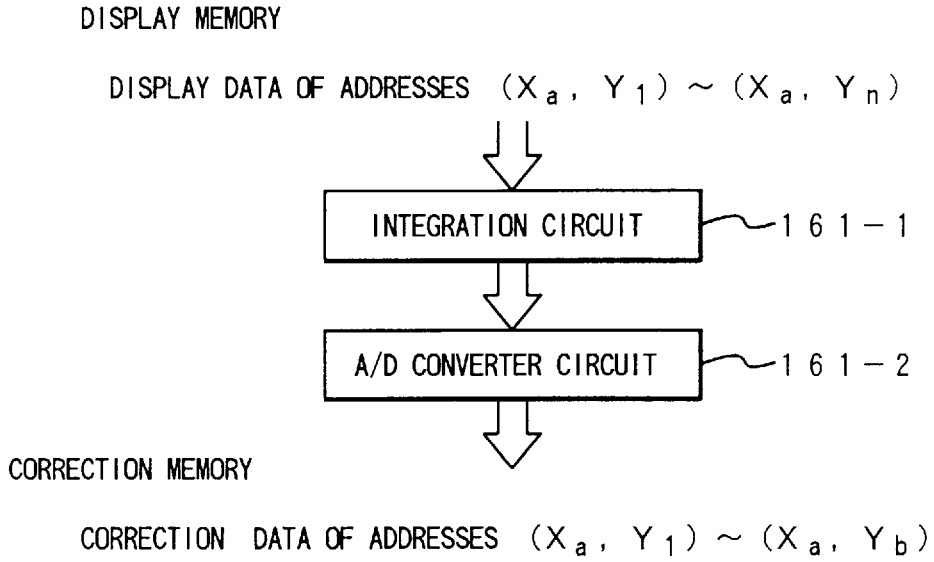
FIGS. 47(*a*) and 47(*b*) are explanatory diagrams each exemplifying the internal arrangement and correction data generation method of a converter circuit (161) shown in FIG. 44.
Figure 47B:
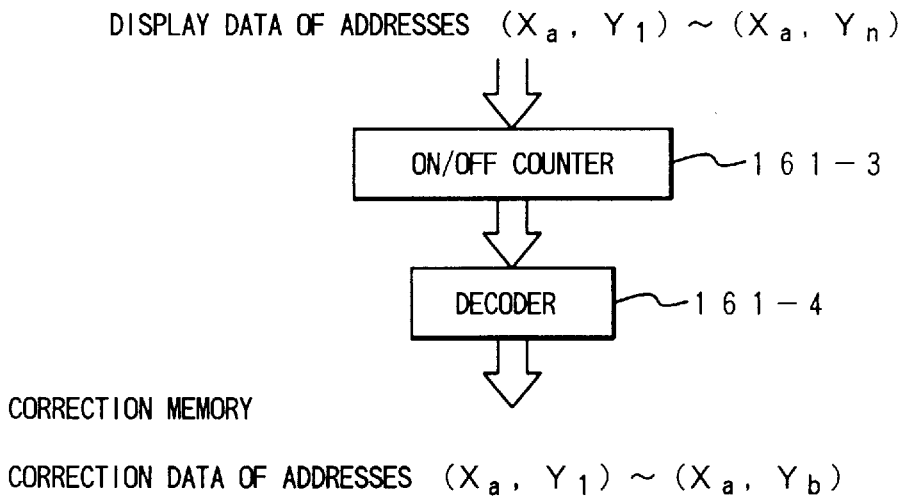

FIGS. 47(*a*) and 47(*b*) show examples of the internal arrangement of the arithmetic circuit 161 for generating the correction data. The arithmetic circuit 161 has the two types of correction data generation based on an integration circuit (in FIG. 47(*a*)) and one based on a counter (in FIG. 47(*b*)). In the example of FIG. 47(*a*), concerning the display data items of the column address Xa of the frame memory 160, namely, the display data items of the addresses (Xa, Y1)–(Xa, Yn) in terms of (column address, row address), the display magnitudes thereof are put into an integral value by the display-data integration circuit 161-1. The integral value is converted into the correction data by an A/D (analog-to-digital) converter circuit 161-2, and the correction data is output to the addresses (Xa, Y1)–(Xa, Yb) of the correction data memory 162. On the other hand, in the example of FIG. 47(*b*), the numbers of the ON- and OFF-display items of the display data of the column address Xa of the frame memory 160 are counted by the counter 161-3 and are converted into the correction data by a decoder 161-4, and the correction data is similarly output to the addresses (Xa, Y1)–(Xa, Yb) of the correction data memory 162.

As described above, the arithmetic circuit 161 detects the number of transitions from the ON-display state to the OFF-display state or/and from the OFF-display state to the ON-display state of the display data to be presented by the liquid crystal, and the number of transitions of the alternation signal M among the control signals. These detected numbers are converted into the data of the application duration of the correction voltage or the data of the set potential of the correction voltage corresponding to the distortion magnitude of the waveform of the applied voltage of the liquid crystal attributed to the changes. Such data items are temporarily stored in the correction data memory 162, and are delivered to the power source circuit 158 as the signal data for the correction voltage application in the correction time period. Thus, the fluctuations of the effective values of the applied voltages of the liquid-crystal dependent upon the display patterns can be compensated for by controlling the correction voltage application on the basis of the data items of the application durations of the correction voltages or the data items of the set potentials of the correction voltages in the correction time period, and the non-uniformity in the display brightness can be eliminated.

The display data and correction data to be transferred to the X driver 2 are respectively output from the frame memory 160 and correction data memory 162 in row address units. Besides, the Y driver 3 scans the lines of the frame sequentially in synchronism with the horizontal synchronizing signal (the line clock CL1) being the control signal from the control signal converter 163. In consequence, the time period during which the liquid-crystal panel 1 presents the display in accordance with the frame synchronizing signal FLM being the control signal corresponds to the horizontal scanning periods of (Yn+Yb) lines in total.

Figure 48:
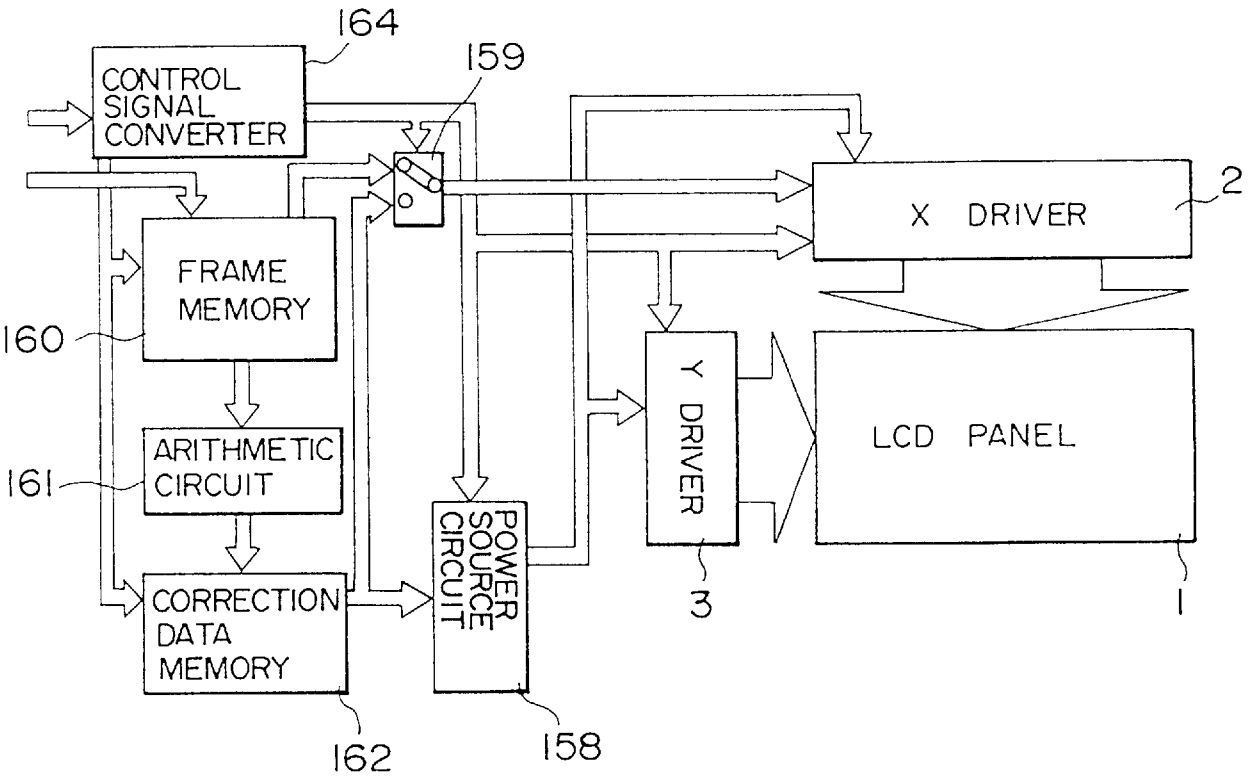
FIG. 48 is a block diagram showing the construction of a liquid-crystal display device in the eighth embodiment of the present invention.

FIG. 48 shows a block diagram of the eighth embodiment of the present invention. Although this embodiment is substantially the same as the seventh embodiment shown in FIG. 44, the former differs from the latter in that the correction output of the memory 162 is afforded, not only to the X driver 2, but also to a power source circuit 158. The frame memory 160 and the correction data memory 162 are formed as stated before.

The display data items of one frame to be displayed on the liquid-crystal panel 1, and the correction data items for compensating for the distortion magnitudes of the waveforms of the applied voltages of the liquid crystal caused by the display data items are transferred to the X driver 2 by changing over the selector 159, within the period for which the liquid-crystal panel 1 presents the display on the basis of the signal FLM being the control signal from a control signal converter 164, and in accordance with the display/correction switching signal being the control signal from the control signal converter 164. In addition, the voltages of the power source circuit 158 for actuating the X driver 2 are changed over and delivered.

Figure 49:
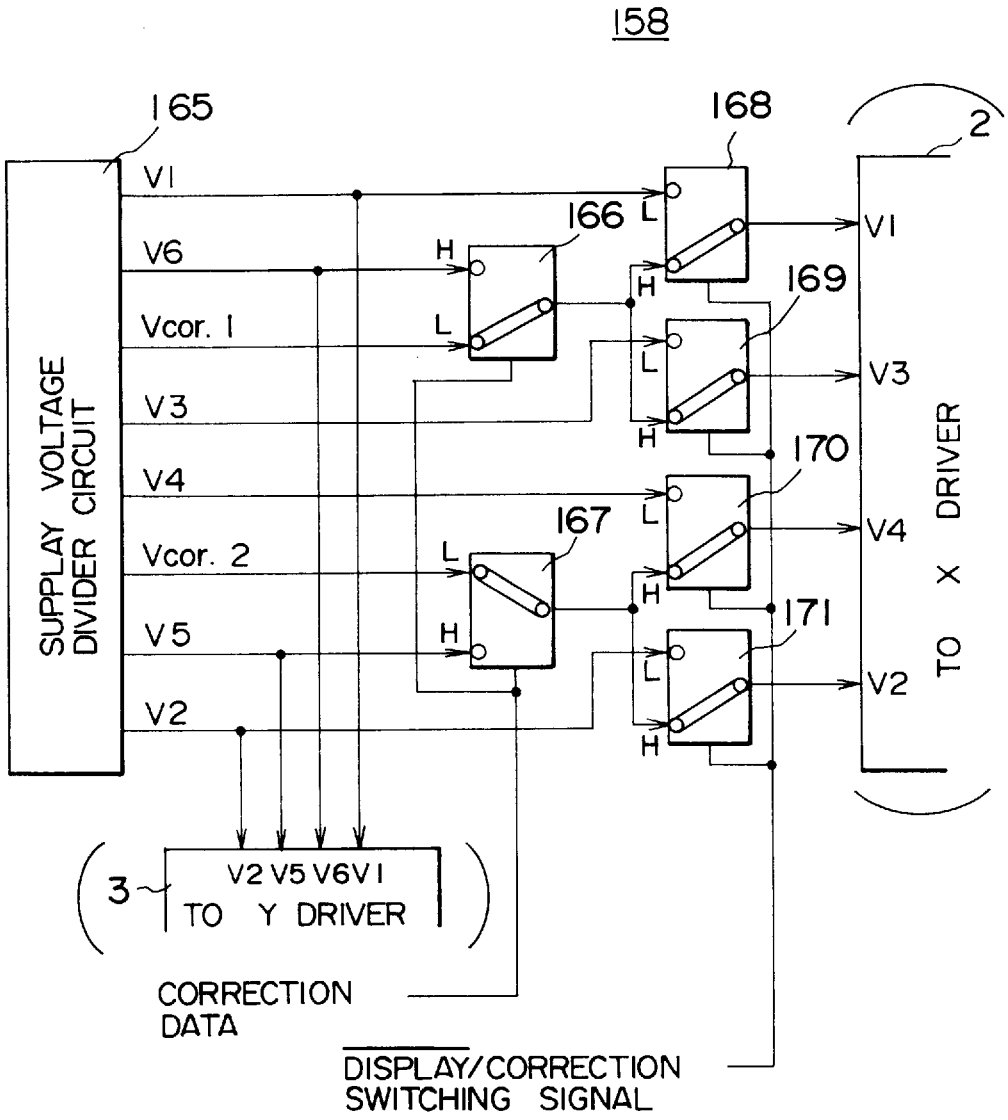
FIG. 49 is a block diagram showing the internal arrangement of a power source circuit (158) shown in FIG. 48.

FIG. 49 shows the first example of the internal arrangement blocks of the power source circuit 158 in the eighth embodiment.

A supply voltage divider circuit 165 divides a liquid-crystal driving supply voltage VLCD into the voltages V1, V6, Vcor.1, V3, V4, Vcor.2, V5 and V2, and delivers the voltages V1, V6, V5 and V2 to the Y driver 3. Selectors 166 and 167 select the respective voltages Vcor.1 and Vcor.2 as the correction voltages of the distortion magnitudes of the waveforms of the applied voltages of the liquid crystal when the correction data being the output of the correction data memory 162 is "L", whereas they select the respective voltages V6 and V5 so as to bring the applied voltages of the liquid crystal to 0 [V] when the correction data being the output of the correction data memory 162 is "H". Selectors 168, 169, 170 and 171 operate in accordance with the display/correction switching signal. More specifically, the selectors 168–171 select the respective supply voltages V1, V3, V4 and V2 for the ordinary display operations and feed them to the X driver 2 during the display time period in the ordinary data-display mode (when the display/correction switching signal is "L"), whereas they deliver the respectively corresponding selected voltages of the selectors 166 and 167 during the correction time period in the correction-data transfer mode (when the display/correction switching signal is "H").

The output voltages V1, V6, Vcor.1, V3, V4, Vcor.2, V5 and V2 of the power source circuit 158 have the relationships of V1>V6>V3>V4>V5>V2 and V1≧Vcor.1≧V4 as well as V3≧Vcor.2≧V2.

Figure 50:
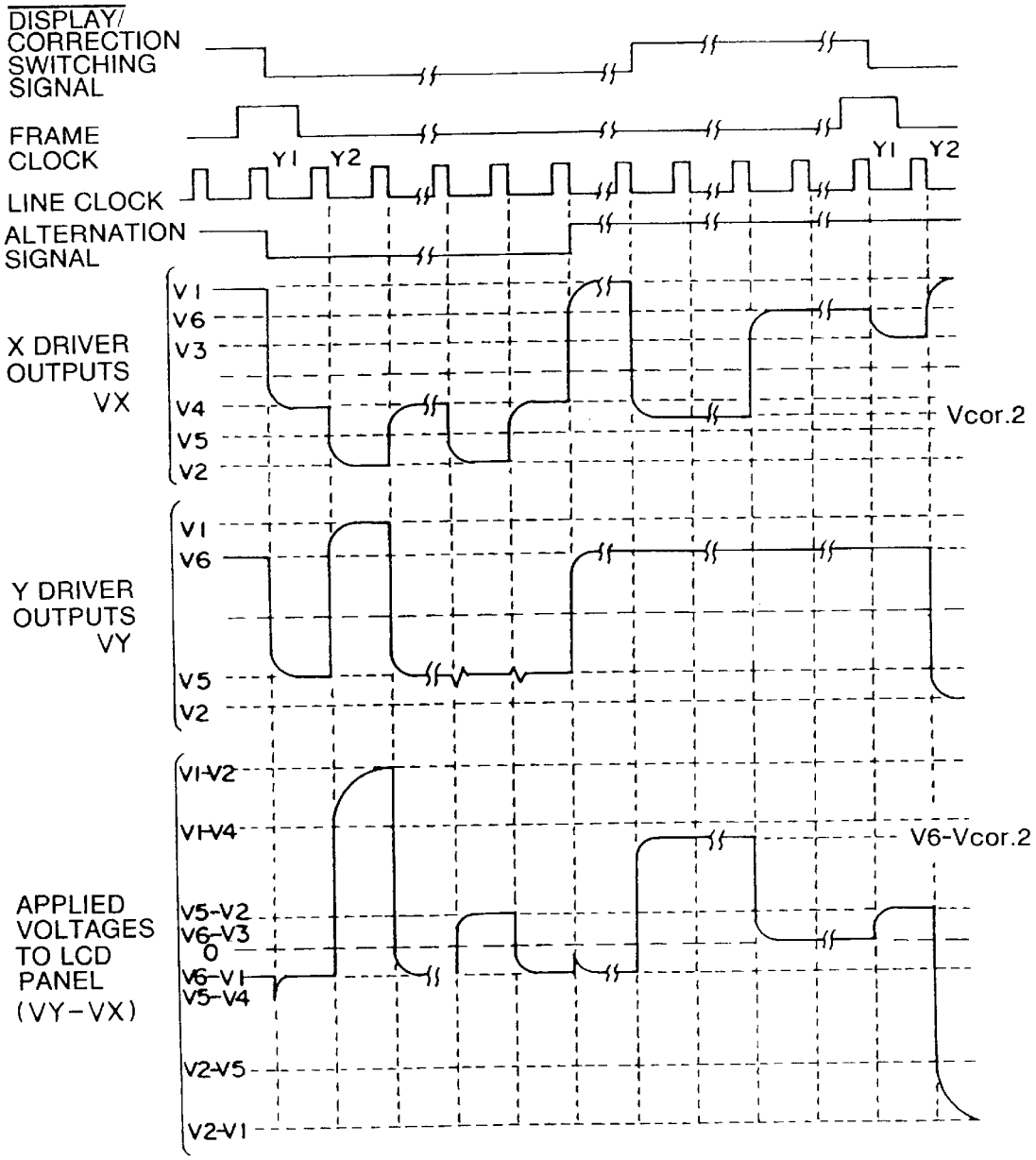
FIG. 50 is a timing chart exemplifying the waveforms of applied voltages to the liquid crystal of a liquid-crystal panel in the eighth embodiment.

FIG. 50 exemplifies the waveforms of the voltages applied to the liquid-crystal panel 1.

During the display time period in the ordinary data-display mode based on the display/correction switching signal (when the display/correction switching signal is "L"), the liquid-crystal panel 1 is driven by the same waveforms of the drive voltages as in the prior art. During the correction time period in the correction-data transfer mode (when the display/correction switching signal is "H"), the voltages are applied so as to bring the applied voltage (VY−VX) of the liquid-crystal panel 1 to a value (V6−Vcor.2) and to compensate for the distortion magnitudes of the waveforms of the applied voltages of the liquid crystal as have occurred during the display time period, on condition that the correction data being the output of the correction data memory 162 is "H", and during the remaining part of the correction time period, the applied voltage of the liquid crystal is rendered o [V] on condition that the correction data is "L".

Figure 51:
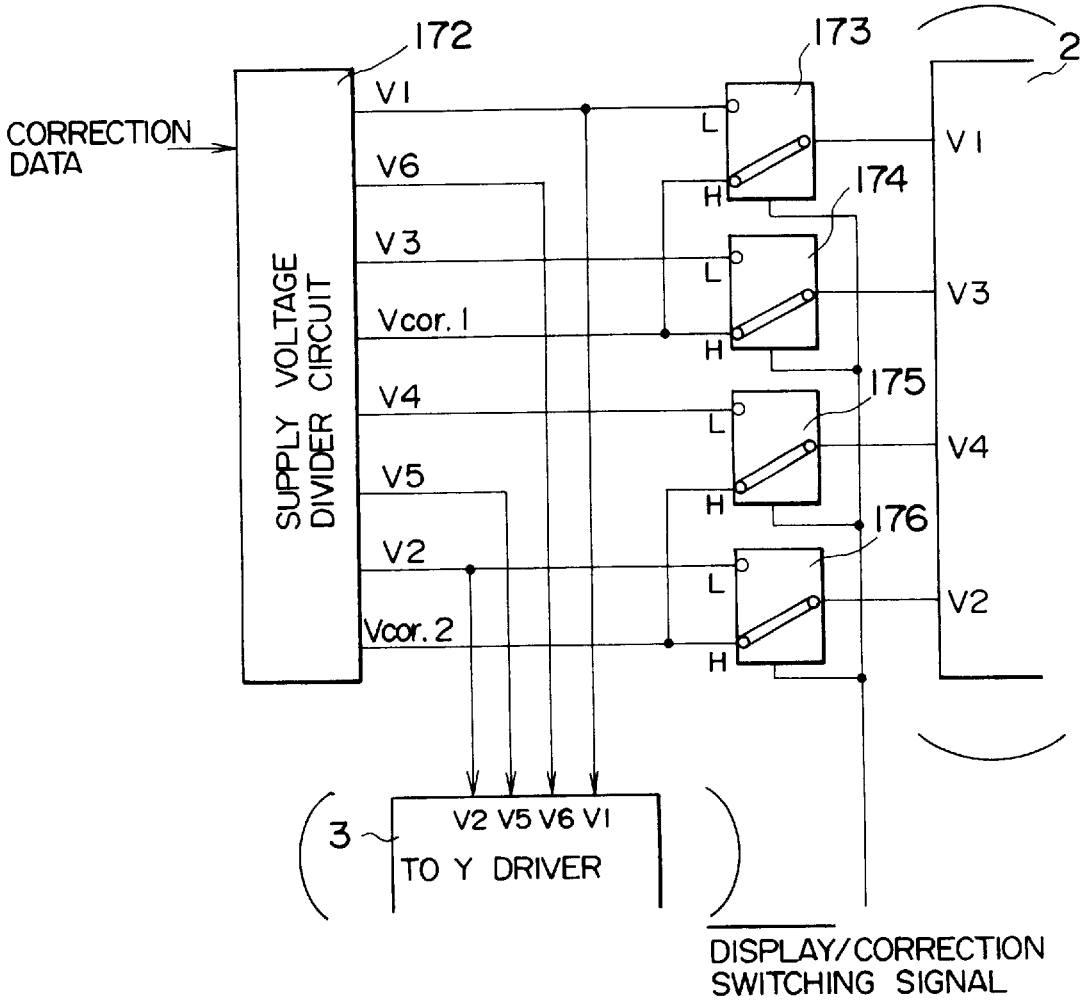
FIG. 51 is a block diagram showing another example of the internal arrangement of the power source circuit (158) shown in FIG. 48.

FIG. 51 shows the second example of the internal arrangement blocks of the power source circuit 158.

A supply voltage divider circuit 172 divides a liquid-crystal driving supply voltage VLCD into the voltages V1, V6, Vcor.1, V3, V4, Vcor.2, V5 and V2, and delivers the voltages V1, V6, V5 and V2 to the Y driver 3. The X driver 2 is fed with the supply voltages V1, V3, V4 and V2 for the ordinary display as have been selected through respective selectors 173–176, during the display time period in the ordinary data-display mode (when the display/correction switching signal is "L"), whereas it is fed with the correction voltages Vcor.1 and Vcor.2 during the correction time period in the correction-data transfer mode (when the display/correction switching signal is "H"). On this occasion, the output voltages V1, V6, Vcor.1, V3, V4, Vcor.2, V5 and V2 of the power source circuit 158 have the relationships of V1>V6>V3>V4>V5>V2, and the potentials of the correction voltages Vcor.1 and Vcor.2 are controlled into the relationship of Vcor.1≧Vcor.2 by the correction data and are selected and output by the correction data values.

Figure 52:
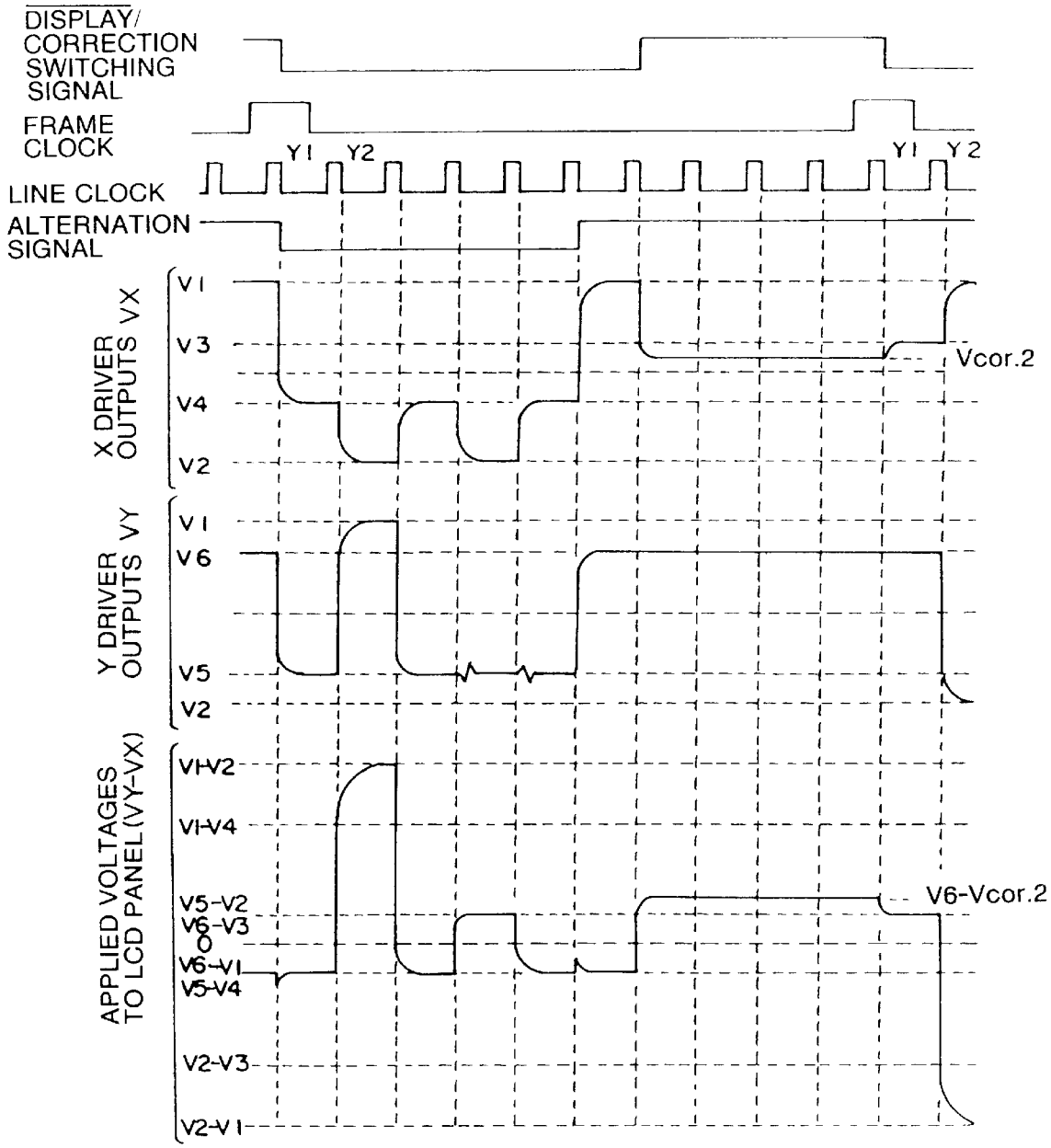
FIG. 52 is a timing chart exemplifying the waveforms of applied voltages to the liquid-crystal panel (1) in the case of employing the power source circuit (158) in FIG. 51.

FIG. 52 exemplifies the waveforms of the voltages applied to the liquid-crystal panel 1.

During the display time period in the ordinary data-display mode based on the display/correction switching signal (when the display/correction switching signal is "L"), the liquid-crystal panel 1 is driven by the same waveforms of the drive voltages as in the prior art. During the correction time period in the correction-data transfer mode (when the display/correction switching signal is "H"), the output correction voltages Vcor.1 and Vcor.2 of the supply voltage divider circuit 172 are selected in accordance with the correction data being the output of the correction data memory 162, and a voltage (V6−Vcor.2) is applied as the applied voltage (VY−VX) of the liquid-crystal panel 1 so as to compensate for the distortion magnitudes of the waveforms of the applied voltages of the liquid crystal as have occurred during the display time period.

Figure 53:
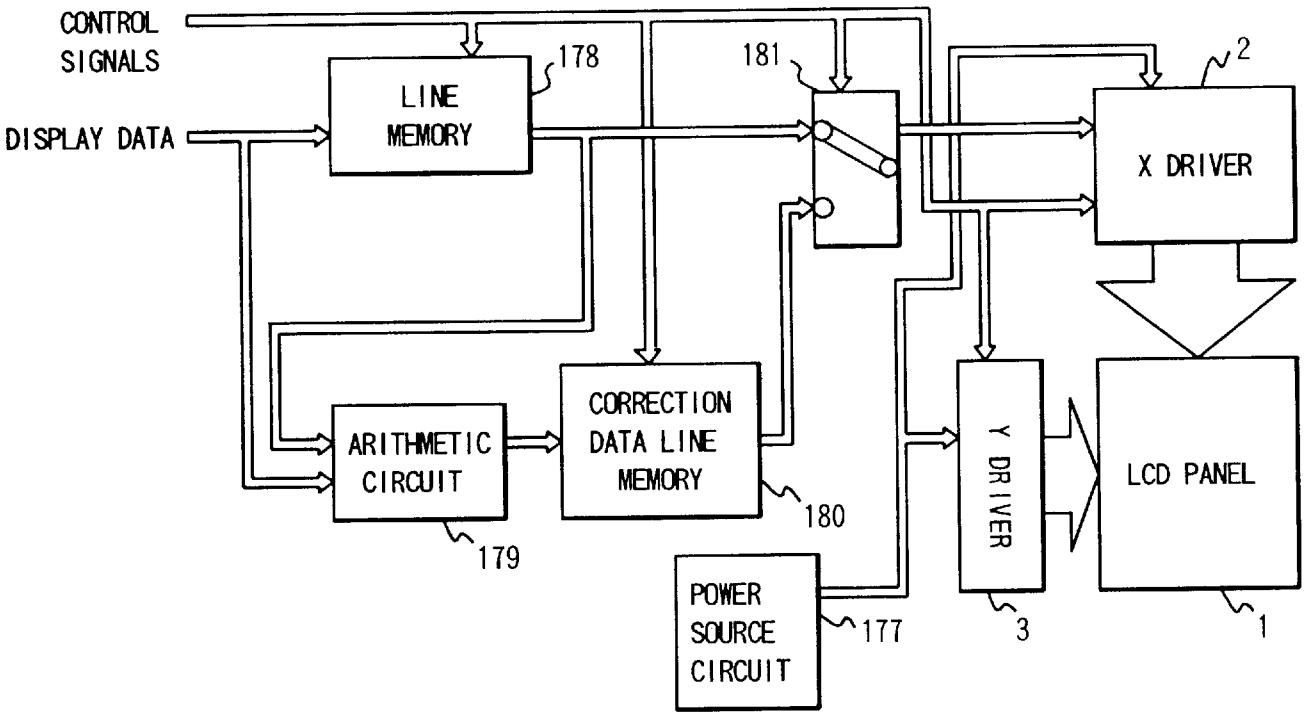
FIG. 53 is a block diagram showing the construction of a liquid-crystal display device in the ninth embodiment of the present invention.

FIG. 53 shows a block diagram of the ninth embodiment. This embodiment is such that the frame memory 160 in the seventh embodiment shown in FIG. 44 is replaced with a line memory 178, while the correction data memory 162 is replaced with a correction-data line memory 180.

The line memory 178 stores display data corresponding to one horizontal scanning period. The stored data from the line memory 178 and display data subsequently received are subjected to comparison processing by an arithmetic circuit 179, and are converted into correction data for compensating for the distortion magnitude of the waveforms of applied voltages attributed to the stored display data. The correction data is stored in the correction-data line memory 180. The display data for one horizontal scanning period is read out of the line memory 178, and is transferred to an X driver 2 in order to present a display. Thereafter, the correction data is read out of the correction-data line memory 180 and is transferred. A selector 181 changes over the output display data of the line memory 178 for one horizontal scanning period and the output correction data of the correction-data line memory 180 in accordance with a display/correction switching signal, and delivers them to the X driver 2 as the display data of each lateral line of a frame.

Each of the line memory 178 and the correction-data line memory 180 can be formed using a memory IC (for example, a line memory "HM63021" or a multiport memory "HM534251") mentioned in "Hitachi IC Memory Data Book". The read cycle and write cycle of this memory IC are controlled by control signals which satisfy access timings stated in the above data book. Alternatively, each of the line memory 178 and the correction-data line memory 180 can be realized by forming a data shifter by the use of the device "7474" belonging to the TTL "74" Series.

The display data for one horizontal scanning period to be displayed on the liquid-crystal panel 1, and the correction data for compensating for the distortion magnitude of the waveforms of the applied voltages of the liquid crystal caused by the display data are transferred to the X driver 2 on the basis of a line clock XCL1 and by changing over the selector 181, within a period for which the liquid-crystal panel 1 presents the display on the basis of a line clock CL1 being a control signal from the control signal converter 163 not shown in FIG. 53, and in accordance with the display/correction switching signal being a control signal from the control signal converter 163. Thus, the correction is made in conformity with the cycle of the line clock CL1. The line clock XCL1 has a frequency double that of the line clock CL1.

Figure 54:
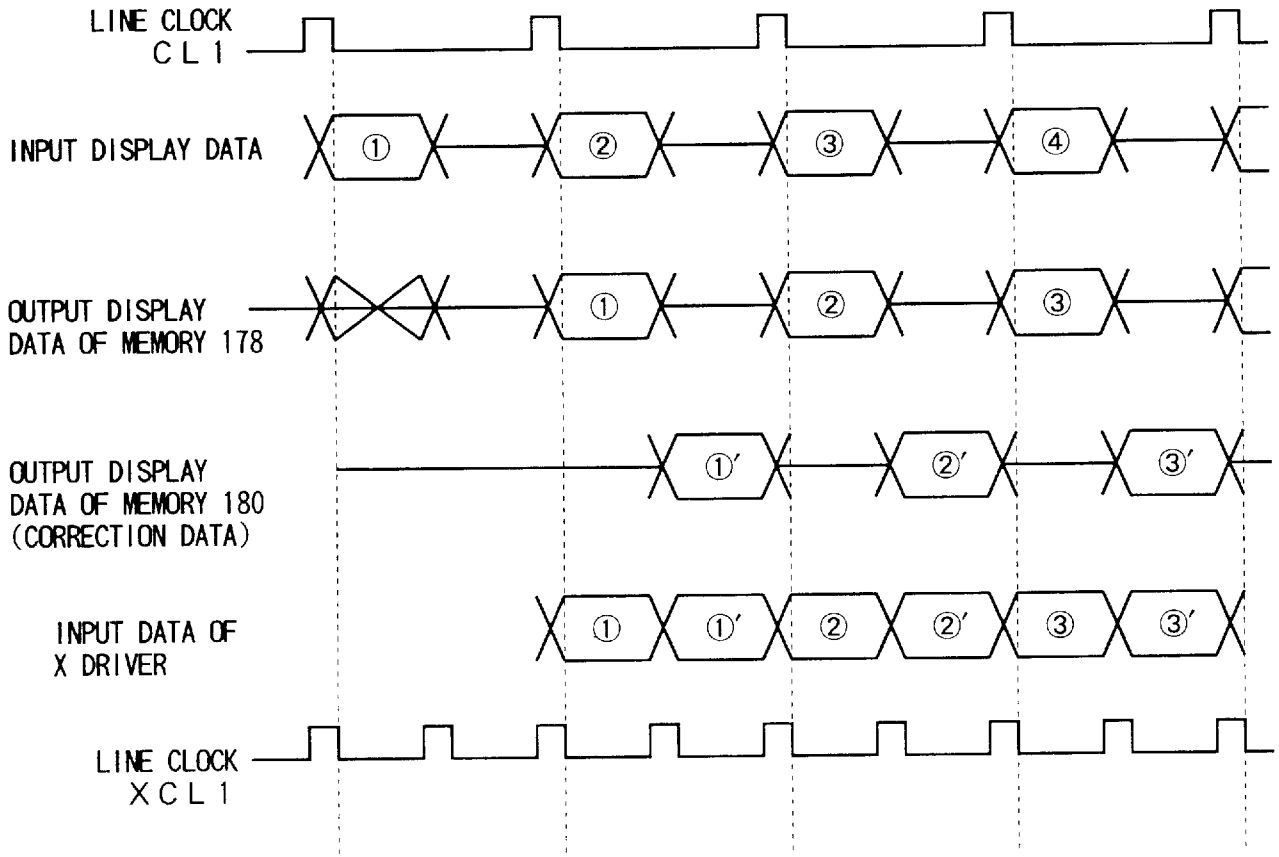
FIG. 54 is a timing chart illustrating the operation of the ninth embodiment.

FIG. 54 shows the transfer timings of the input display data and the correction data.

When the input display data corresponding to the display of one horizontal line is stored in the line memory 178, it is compared by the arithmetic circuit 179 with the input display data preceding it for one horizontal scanning period and having been stored in the line memory 178, so as to generate the correction data for predictively compensating for the fluctuation of the effective values of the applied voltages of the liquid crystal attributed to the difference between the numbers of the ON-display and OFF-display pattern dots of the display data. The correction data is stored in the correction-data line memory 180. The input display data and the correction data are delivered to the X driver 2 in the mentioned order in synchronism with the line clock CL1 and the line clock XCL1.

The X driver 2 (or the X drive circuit 2) employed in each of the foregoing embodiments is an X drive circuit for driving a column side as represented by the product "HD66107T" manufactured by Hitachi, Ltd., while the Y driver 3 (or the Y drive circuit 3) is a Y drive circuit for driving a row side as represented by the same product. Although the display data is parallel data items of 4 dots or 8 dots in an example employing the aforementioned product as the X drive circuit, it has been explained as serial data here for the brevity of the explanation.

Now, the tenth embodiment of the present invention will be described with reference to FIGS. 55–58.

Figure 74:
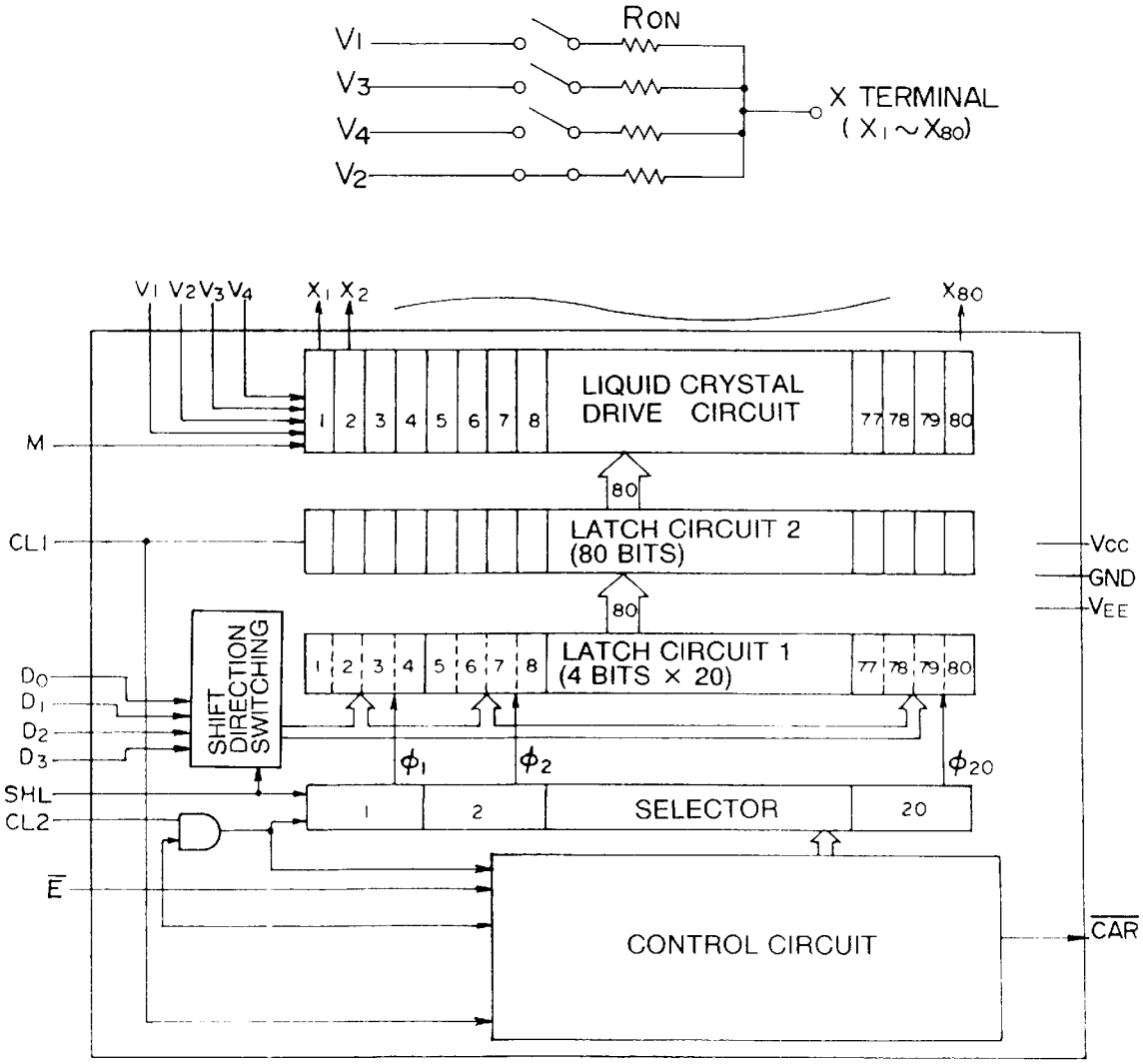
FIG. 74 is a diagram for explaining the arrangement of a liquid-crystal driver in the prior art.

With a liquid-crystal driver in the prior art, as illustrated in FIG. 74, supply voltages V1, V2, V3 and V4 are changed over and output in accordance with display data and an alternation signal M by a liquid-crystal drive circuit included in the liquid-crystal driver. That is, the supply voltages V1, V2, V3 and V4 are changed over and delivered from an X terminal by four switches and four ON-resistances RON as illustrated in a diagram for explaining the output terminal of the liquid-crystal drive circuit portion of a liquid-crystal driver "HD66104/HD66104A", contained on page 254 in "Hitachi LCD Driver LSI Data Book, 90. 3 (5th Edition)".

The tenth embodiment of the present invention is such that the liquid-crystal drive circuit portion included in the liquid-crystal driver is endowed with the same function as that of the voltage selector 20 or 37 stated before.

Figure 55:
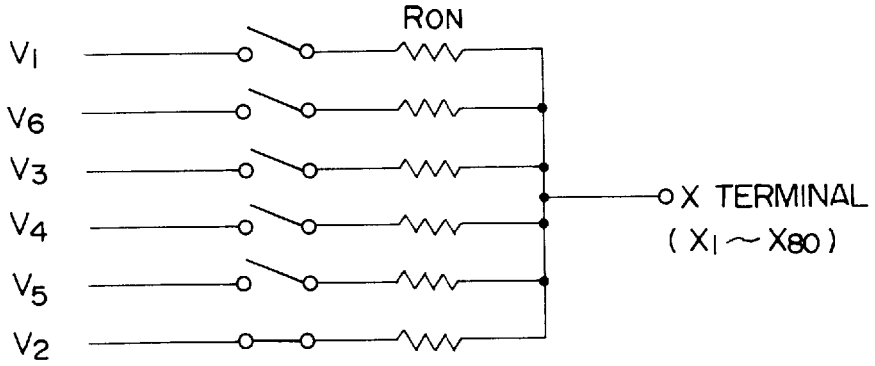
FIG. 55 is an equivalent circuit diagram of the output terminals of a liquid-crystal drive circuit portion according to the tenth embodiment of the present invention.

FIG. 55 shows an equivalent circuit diagram of the output terminal of a liquid-crystal drive circuit portion in the tenth embodiment according to the present invention. With the liquid-crystal drive circuit portion included in the liquid-crystal driver, supply voltages V1, V2, V3, V4, V5 and V6 are changed over and delivered from the X terminal by six sets of switches and ON-resistances RON. As seen from FIG. 56 illustrative of the liquid-crystal drive circuit portion according to the present invention, the change overs of the supply voltages realize the foregoing operation shown in FIG. 5 or FIG. 27 through an alternation signal M 18 and a correction clock 19.

Figure 56:
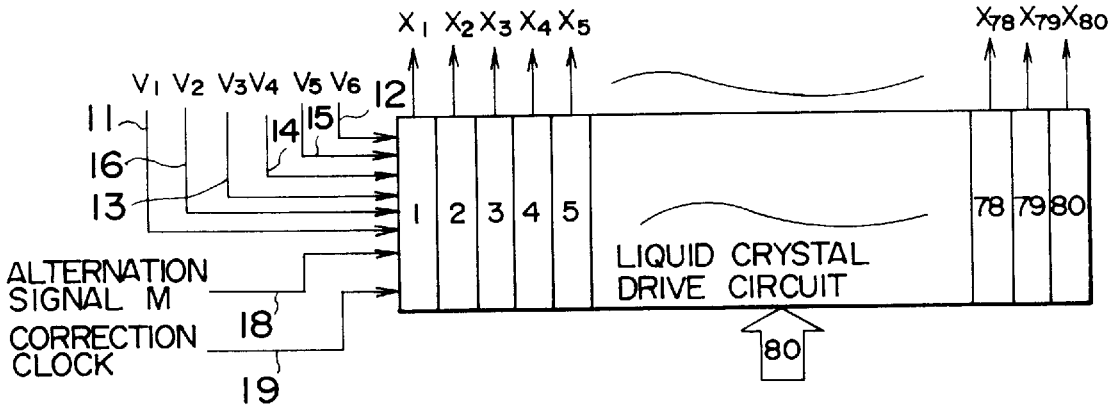
FIG. 56 is a block diagram showing the arrangement of the liquid-crystal drive circuit portion in the tenth embodiment.
Figure 57:
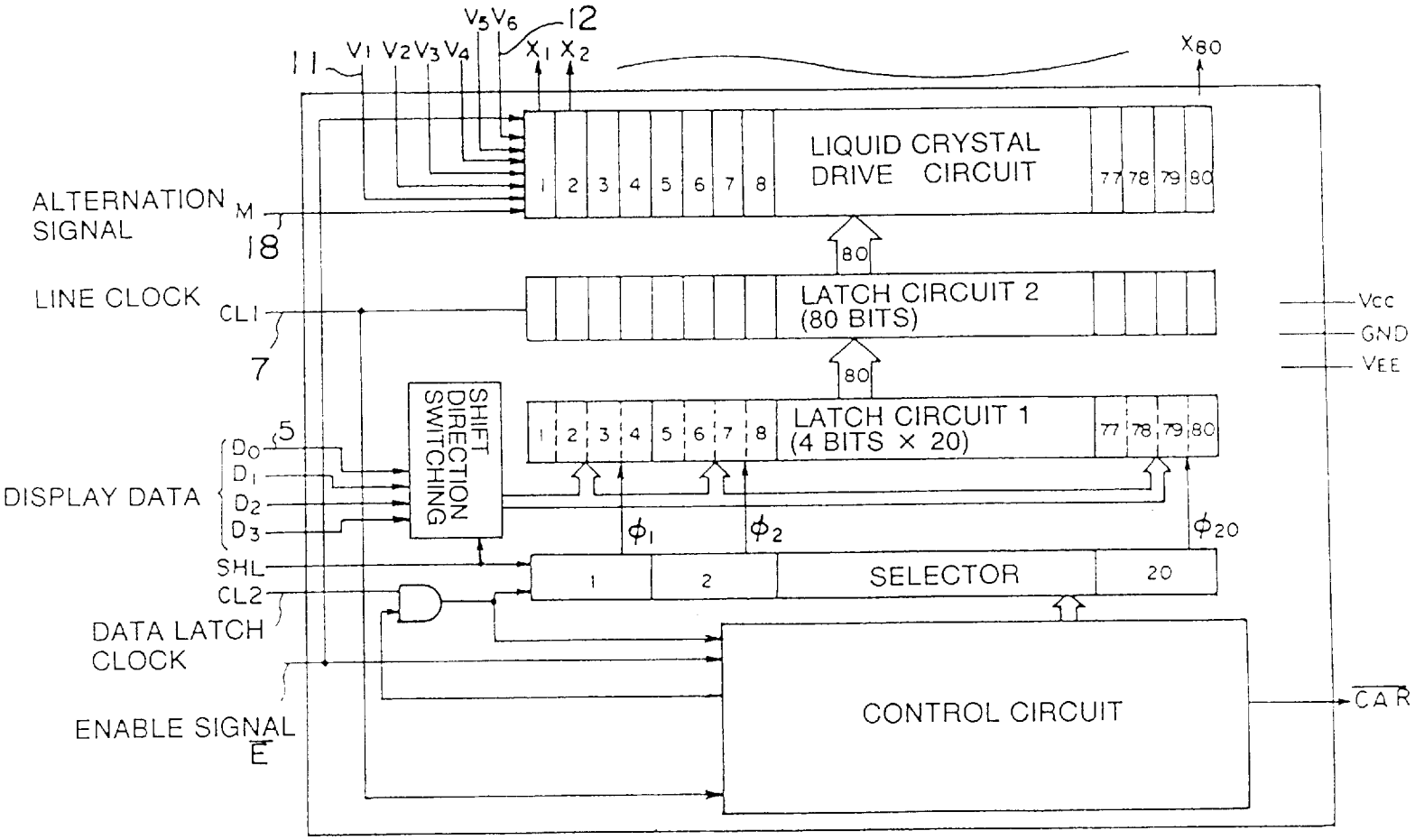
FIG. 57 is a block diagram showing the internal arrangement of a liquid-crystal driver which employs the tenth embodiment.

FIG. 57 shows a diagram of the internal blocks of the liquid-crystal driver in the case where an enable signal E for the liquid-crystal driver is employed as the input correction clock 19 in the liquid-crystal drive circuit portion depicted in FIG. 56.

Figure 27:
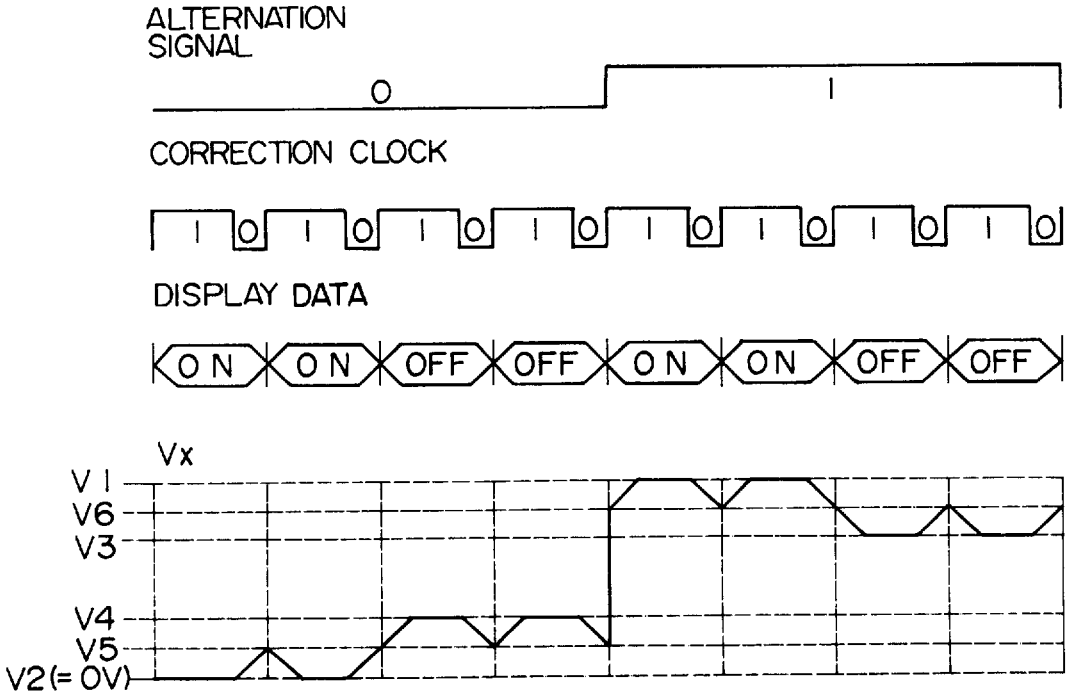
FIG. 27 is an explanatory diagram of the triangular wave correction output operation of an X drive circuit in the case of employing the voltage selector in FIG. 26.
Figure 58:
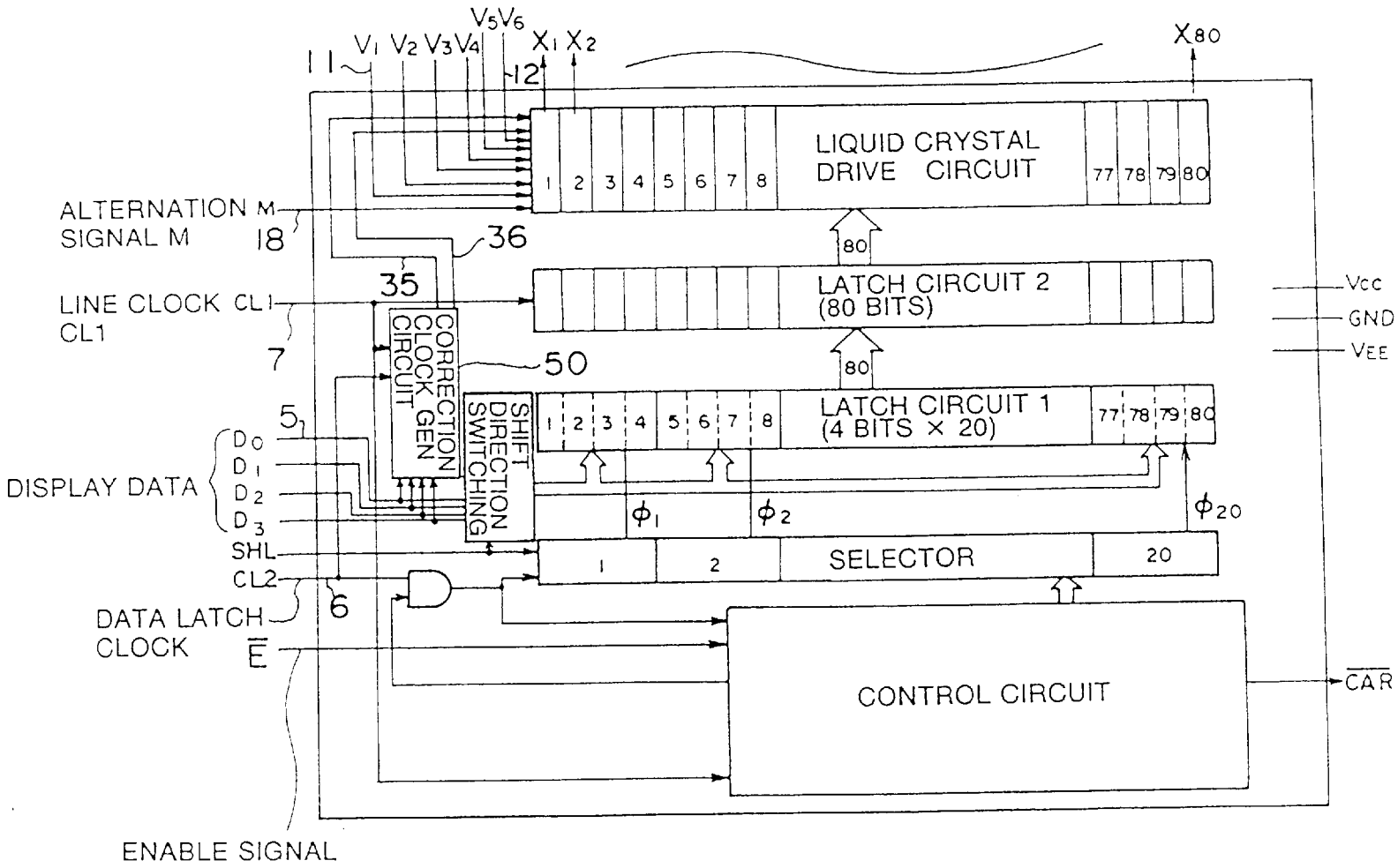
FIG. 58 is a block diagram showing another example of the internal arrangement of the liquid-crystal driver which employs the tenth embodiment.

Besides, FIG. 58 shows a diagram of the internal blocks of a liquid-crystal driver, into which is built a correction-clock generator circuit 50 and in which a liquid-crystal drive circuit having the same output-terminal equivalent circuit as in FIG. 55 performs the operation shown in FIG. 27 in accordance with the correction clock pulse trains 35, 36 likewise to the voltage selector 37 stated before. The amplifier portions of the output stages of this liquid-crystal drive circuit are constituted by buffer portions which are equivalent to the respective combinations between the elements 67 and 71, 68 and 72, 69 and 73, and 70 and 74 in FIG. 26, whereby the same operation as shown in FIG. 27 is permitted.

Next, the eleventh embodiment of the present invention will be described with reference to FIGS. 59–62.

This embodiment is such that a liquid-crystal drive circuit portion included in a liquid-crystal driver is endowed with the same function as that of the voltage selector 20 or 37 stated before.

Figure 59:
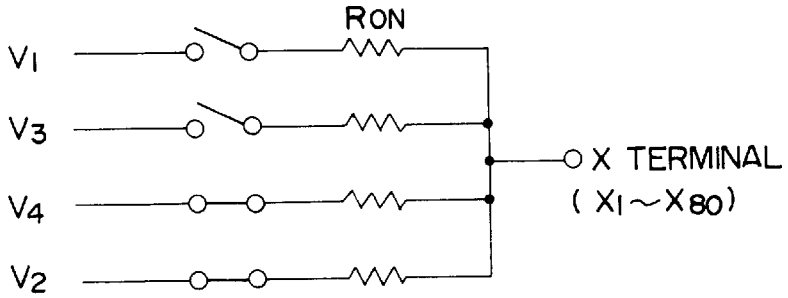
FIG. 59 is an equivalent circuit diagram of the output terminals of a liquid-crystal drive circuit portion according to the eleventh embodiment of the present invention.

FIG. 59 shows an equivalent circuit diagram of the output terminal of the liquid-crystal drive circuit portion in the eleventh embodiment according to the present invention. With the liquid-crystal drive circuit portion included in the liquid-crystal driver, supply voltages V1, V2, V3 and V4 are changed over and delivered from the X terminal by four sets of switches and ON-resistances RON. In this embodiment, any of the supply voltages V1–V4 is selected and output in an ordinary display mode, but the voltages V1 and V3 or those V4 and V2 are simultaneously selected and output during a correction time period. Owing to this expedient, when the voltages V1 and V3 are simultaneously selected and output, the potential of the output voltage of the X terminal becomes the combined potential V6 of the voltages V1 and V3, and when the voltages V4 and V2 are simultaneously selected and output, the output potential becomes the combined potential V5 of the voltages V4 and V2. Thus, as seen from FIG. 60 illustrative of the liquid-crystal drive circuit portion according to the present invention, the change overs of the supply voltages realize the foregoing operation shown in FIG. 5 or FIG. 27 through an alternation signal M 18 and a correction clock 19.

Figure 60:
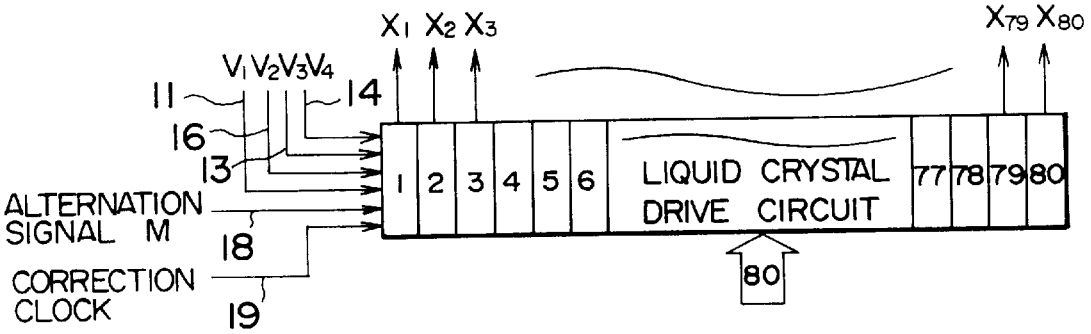
FIG. 60 is a block diagram showing the arrangement of the liquid-crystal drive circuit portion in the eleventh embodiment.
Figure 61:
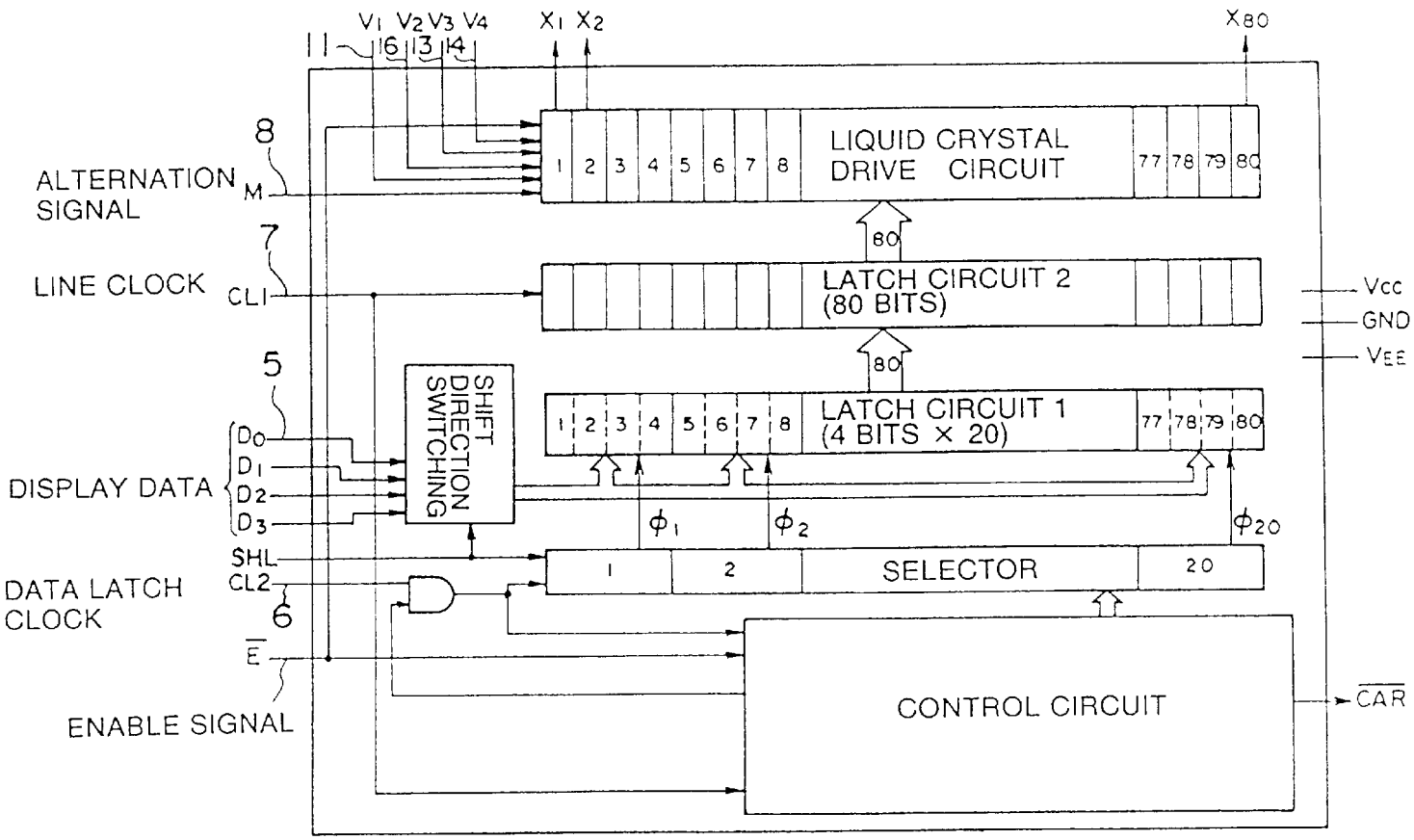
FIG. 61 is a block diagram showing the internal arrangement of a liquid-crystal driver which employs the eleventh embodiment.

FIG. 61 shows a diagram of the internal blocks of the liquid-crystal driver in the case where the liquid-crystal drive circuit portion depicted in FIG. 60 is adopted and where an enable signal E entering the liquid-crystal driver is employed as the input correction clock 19.

Figure 62:
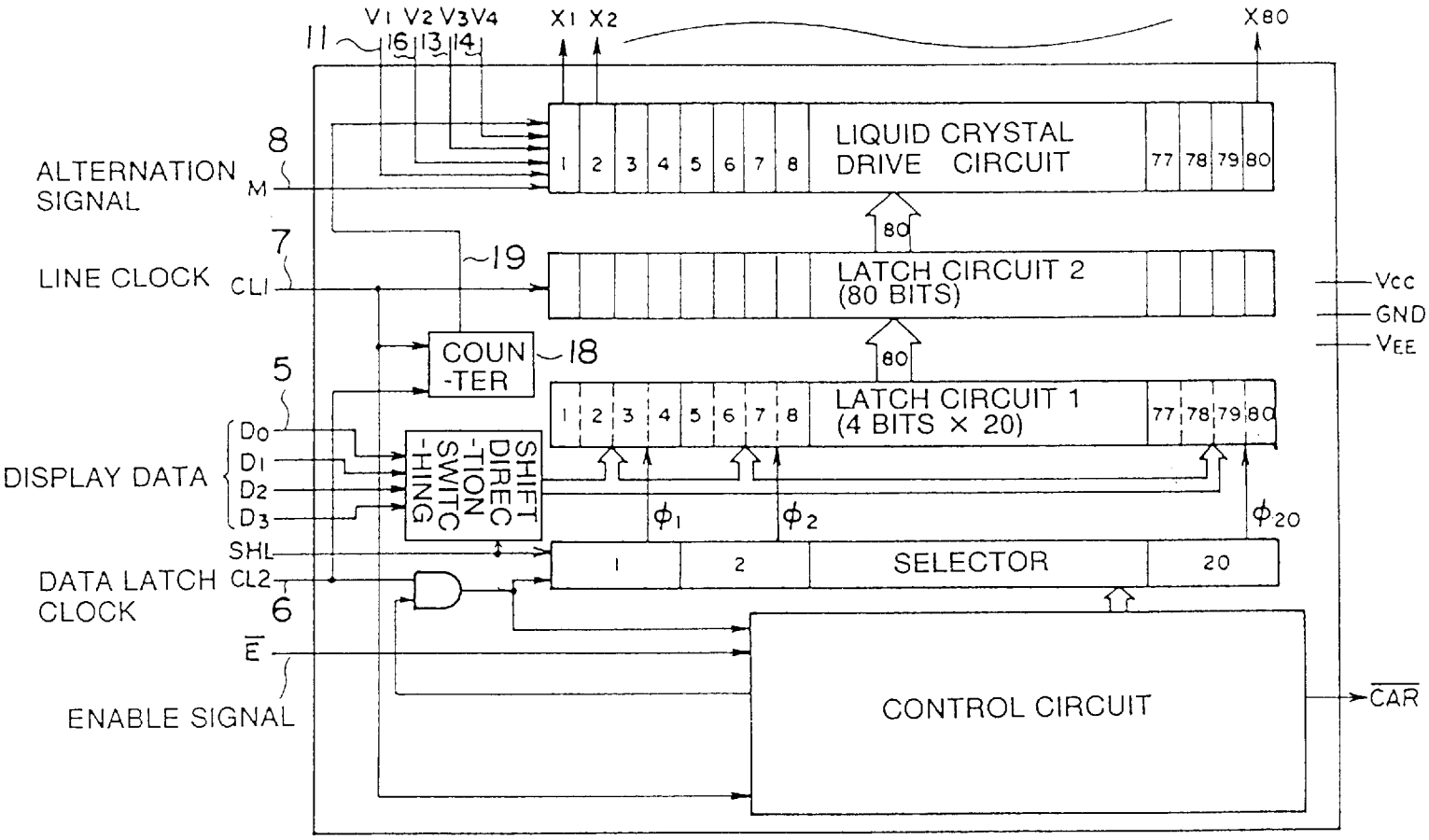
FIG. 62 is a block diagram showing another example of the internal arrangement of the liquid-crystal driver which employs the eleventh embodiment.

FIG. 62 shows a diagram of the internal blocks of a liquid-crystal driver which adopts the liquid-crystal drive circuit portion in FIG. 60 and which has the foregoing counter 18 built therein.

Likewise, it is easily considered that a liquid-crystal drive circuit portion included in a liquid-crystal driver can be endowed with the same functions as those of the voltage selectors 151–156 of the internal arrangement of the power source circuit 136 stated before or the voltage selectors 166–171 of the internal arrangement of the power source circuit 158 stated before, by changing over the supply voltages V1, V6, Vcor.1, V3, V4, Vcor.2, V5 and V2 and delivering them from an X terminal with eight sets of switches and ON-resistances RON. On this occasion, the liquid-crystal drive circuit portion is fed with the supply voltages V1, V6, Vcor.1, V3, V4, Vcor.2, V5 and V2, and the display/correction switching signal, the output of the counter 149, or the correction data as the control signal for changing over the supply voltages.

In the above, the correction clock 19, 35 or 36 of the liquid-crystal drive circuit portion in the tenth or eleventh embodiment is fed as the enable signal E received by the liquid-crystal driver or is fed by the built-in counter 18 or the correction clock generator circuit 50. Alternatively, it is possible to provide an input terminal for the correction clock 19, 35 or 36, to which this correction clock is fed from outside the liquid-crystal driver.

Figure 63:
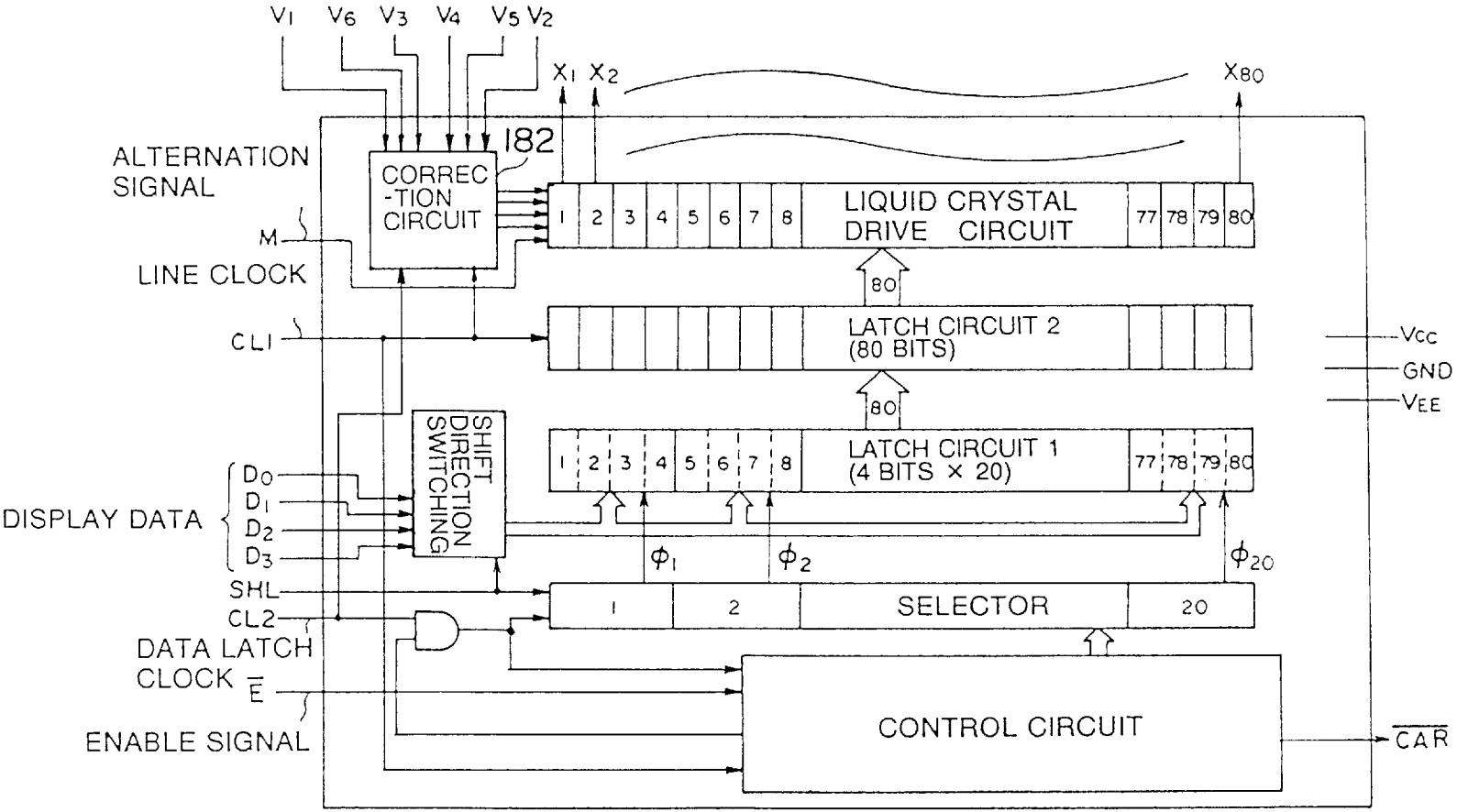
FIG. 63 is a block diagram showing still another example of the internal arrangement of the liquid-crystal driver which employs the eleventh embodiment.
Figure 64:
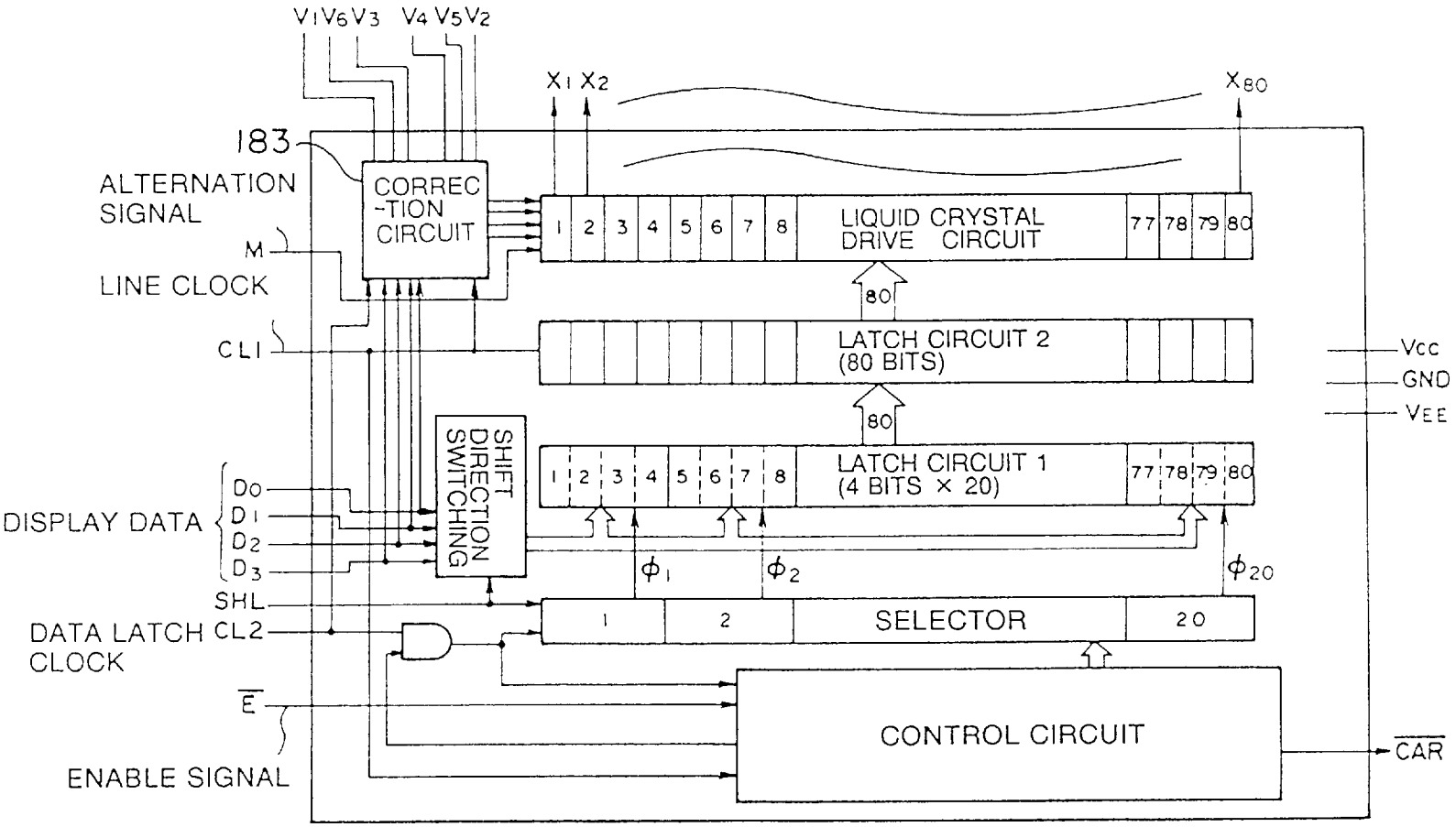
FIG. 64 is a block diagram showing yet another example of the internal arrangement of the liquid-crystal driver which employs the eleventh embodiment.

FIG. 63 shows a liquid-crystal driver in which the counter 18 and the voltage selector 20 stated before are built as a correction circuit 182, while FIG. 64 shows a liquid-crystal driver in which the correction clock generator circuit 50 and the voltage selector 37 stated before are built as a correction circuit 183.

Figure 75:
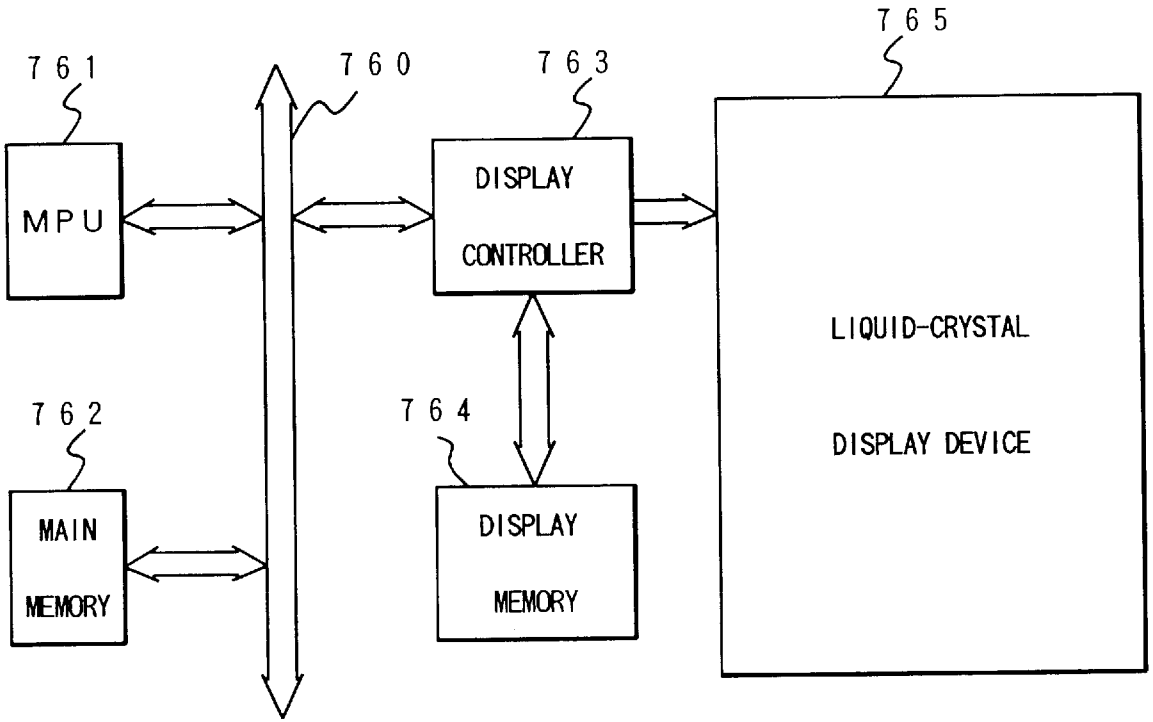
FIG. 75 is a block diagram of an information equipment which adopts the liquid-crystal display device of the present invention.

Lastly, FIG. 75 shows a block diagram of an information equipment which adopts the liquid-crystal display device in any of the foregoing embodiments.

An MPU 761, a main memory 762 and a display controller 763 are connected to a bus 760 for transferring data, and the display controller 763 performs a control for causing the liquid-crystal display device 765 to indicate display data stored in a display memory 764. The general information equipment is constructed in this manner. Although the liquid-crystal display device 765 can be constructed of the foregoing embodiment, one or more circuits in the embodiment may well be built in the display controller 763 as stated below.

In the first or second embodiment (FIG. 1 or FIG. 8), only the counter or the counter as well as the voltage selector can be built into the display controller.

In the third, fourth or fifth embodiment (FIG. 15, FIG. 31 or FIG. 33), only the correction clock generator circuit or this circuit as well as the selector(s) can be built into the display controller.

In the sixth embodiment (FIG. 34), the arithmetic circuit 135 can be built into the display controller.

In the seventh embodiment (FIG. 44), the elements 159–163 or these elements as well as the power source circuit 157 can be built into the display controller.

In the eighth embodiment (FIG. 48), the elements 158–162 and 164, or the elements 159–162 and 164 can be built into the display controller.

In the ninth embodiment (FIG. 53), the elements 178–181 can be built into the display controller.

According to the present invention, a correction time period is set every scanning period of one line or every scanning period of one frame irrespective of display patterns, or the length of the correction time period or the level of a correction voltage is controlled in accordance with display data, whereby a dispersion in the effective values of applied voltages to liquid-crystal cells as depends upon the display patterns can be relieved to eliminate nonuniformity in display brightness attributed to the dispersion.

What is claimed is:

1. A method of driving a liquid-crystal display device wherein voltages which correspond to potential differences between scanning voltages from a Y drive circuit and display voltages from an X drive circuit are applied to liquid-crystal cells at intersection points between scanning electrodes (Y electrodes) and data electrodes (X electrodes), thereby presenting a display conforming to display data, the method comprising the steps of:

providing a correction time period for correcting a display voltage to be output from said X drive circuit at least once every scanning period of one line such that each scanning period of one line includes at least one correction time period; and outputting a correction voltage at a voltage level which is intermediate between a voltage level in an ON-display state and a voltage level in an OFF-display state instead of said display voltage from said X drive circuit within each correction time period in each scanning period of one line.

2. A method of driving a liquid-crystal display device as defined in claim 1, wherein said correction voltage to be output from said X drive circuit within said correction time period is set at a voltage of the same level as that of a voltage which is output in a non-scanning state from said Y drive circuit, whereby the voltage to be applied to the liquid-crystal cell is set at 0 [V] during said correction time period.

3. A method of driving a liquid-crystal display device as defined in claim 1, wherein said correction voltage to be output from said X drive circuit to said each data electrode within said correction time period is made unequal between in said ON-display state and in said OFF-display state.

4. A method of driving a liquid-crystal display device as defined in claim 1, wherein a difference between the level of a voltage in said ON-display state to be output from said X drive circuit and the level of said correction voltage is made unequal to a difference between the level of a voltage in said OFF-display state to be output from said X drive circuit and the level of said correction voltage.

5. A method of driving a liquid-crystal display device as defined in claim 1, wherein said correction voltage has a triangular waveform.

6. A method of driving a liquid-crystal display device as defined in claim 1, wherein at least either of ON-display pixels and OFF-display pixels which are respectively contained in the display data within the scanning period of one line is counted, and either of a duration of said correction time period and a duration of application of said correction voltage is controlled in accordance with a counted result of said pixels.

7. A method of driving a liquid-crystal display device as defined in claim 1, wherein the step of outputting a correction voltage includes determining the voltage level of the correction voltage outputted within each correction time period in each scanning period of one line such that a number of transitions in a respective voltage applied to each of the data electrodes within a scanning period of one frame is constant and is the same for all of the data electrodes irrespective of contents of the display data.

8. A method of driving a liquid-crystal display device wherein voltages which correspond to potential differences between scanning voltages from a Y drive circuit and display voltages from an X drive circuit are applied to liquid-crystal cells at intersection points between scanning electrodes (Y electrodes) and data electrodes (X electrodes), thereby presenting a display conforming to display data, the method comprising the steps of:

providing a correction time period for correcting a display voltage to be output from said X drive circuit at least once every scanning period of one frame;

determining either of a magnitude and an application duration of a correction voltage to be applied to the corresponding data electrode in accordance with contents of display data items which are to be bestowed on the respective data electrodes within the scanning period of one frame such that a number of transitions in a respective voltage applied to each of said data electrodes within said scanning period of one frame is constant and is the same for all of said data electrodes irrespective of said contents of said display data items; and outputting said correction voltage instead of said display voltage from said X drive circuit to said each data electrode within said correction time period.

9. A method of driving a liquid-crystal display device as defined in claim 8, wherein said correction voltage is at a voltage level which is intermediate between a voltage level in an ON-display state and a voltage level in an OFF-display state.

10. An apparatus for driving a liquid-crystal display device wherein voltages are applied to liquid-crystal cells at intersection points between scanning electrodes (Y electrodes) and data electrodes (X electrodes), thereby presenting a display conforming to display data, the apparatus comprising:

scanning-electrode drive means for sequentially selecting any of said scanning electrodes and applying a scanning voltage thereto for every predetermined scanning period of one line, and for applying a non-scanning voltage to the other scanning electrodes not selected at that time;

data-electrode drive means for applying display voltages to said data electrodes, said display voltages corresponding to contents of display data items which are externally input; and voltage control means for applying a correction voltage to said each data electrode instead of the display voltage to be output from said X drive circuit, within a predetermined correction time period each time the respective scanning electrode is selected by said scanning-electrode drive means, said correction voltage being at a voltage level which is intermediate between a voltage level in an ON-display state and a voltage level in an OFF-display state.

11. An apparatus for driving a liquid-crystal display device as defined in claim 10, wherein said voltage control means unequalizes said correction voltage to be applied to said each data electrode within said correction time period, depending upon whether the corresponding data electrode is in said ON-display state or in said OFF-display state.

12. An apparatus for driving a liquid-crystal display device as defined in claim 10, wherein said correction voltage is set at the same level as that of said voltage which is output in a non-scanning state from said scanning-electrode drive means.

13. An apparatus for driving a liquid-crystal display device as defined in claim 10, wherein said correction voltage is set at a level close to that of said voltage which is output in a non-scanning state from said scanning-electrode drive means.

14. An apparatus for driving a liquid-crystal display device as defined in claim 10, wherein said voltage control means has also a function of controlling either of a duration of said correction time period and an application duration of said correction voltage.

15. An apparatus for driving a liquid-crystal display device as defined in claim 14, further comprising counter means for counting at least either of ON-display pixels and OFF-display pixels which are respectively contained in the display data within the scanning period of one line, and said voltage control means controls said application duration of said correction voltage in said scanning period of one line scanning period on the basis of a counted result of said counter means.

16. An apparatus for driving a liquid-crystal display device as defined in claim 15, wherein said voltage control means determines said application duration of said correction voltage to be applied to said each data electrode within said correction time period, individually for said data electrodes, depending upon whether the corresponding data electrode is in said ON-display state or in said OFF-display state.

17. An apparatus for driving a liquid-crystal display device as defined in claim 15, wherein said voltage control means controls said application duration of said correction voltage on the basis of a difference between the numbers of said ON-display pixels and said OFF-display pixels in said corresponding line scanning period.

18. An apparatus for driving a liquid-crystal display device as defined in claim 12, further comprising a transition detector circuit which detects the number of transitions of the display data in the scanning period of one line, and said voltage control means controls said application duration of said correction voltage on the basis of the detected number of transitions.

19. An apparatus for driving a liquid-crystal display device as defined in claim 14, further comprising arithmetic means for processing and comparing the display data in the scanning period of one line and the display data in the scanning period of the previous line, and said voltage control means controls said application duration of said correction voltage on the basis of a processed result of said arithmetic means.

20. An apparatus for driving a liquid-crystal display device as defined in claim 10, wherein said voltage control means includes waveform control means for making inclinations of a leading edge and a trailing edge of said correction voltage gentler.

21. An apparatus for driving a liquid-crystal display device as defined in claim 10, comprising two blocks of data-electrode drive means for applying the display voltages in accordance with the display data items which are respectively bestowed on upper and lower frames of a liquid-crystal panel divided into the two, upper and lower frames, and a single block of scanning-electrode drive means for applying the scanning voltage commonly to said upper and lower frames; wherein said voltage control means is shared by said two blocks of data-electrode drive means.

22. An apparatus for driving a liquid-crystal display device as defined in claim 10, comprising two blocks of data-electrode drive means for applying the display voltages in accordance with the display data items which are respectively bestowed on upper and lower frames of a liquid-crystal panel divided into the two, upper and lower frames, and two blocks of scanning-electrode drive means for applying the scanning voltages to said upper and lower frames, respectively; wherein the individual voltage control means are provided for said two blocks of data-electrode drive means.

23. An apparatus for driving a liquid-crystal display device as defined in claim 10, wherein said voltage control means is built in said data-electrode drive means.

24. An apparatus for driving a liquid-crystal display device as defined in claim 10, wherein the voltage control means determines the voltage level of the correction voltage such that a number of transitions in a respective voltage applied to each of the data electrodes within a scanning period of one frame is constant and is the same for all of the data electrodes irrespective of the contents of the display data items.

25. An apparatus for driving a liquid-crystal display device wherein voltages are applied to liquid-crystal cells at intersection points between scanning electrodes (Y electrodes) and data electrodes (X electrodes), thereby presenting a display conforming to display data, the apparatus comprising:

a frame memory in which display data items corresponding to one frame are stored;

scanning-electrode drive means for sequentially selecting any of said scanning electrodes and applying a scanning voltage thereto for every predetermined scanning period of one line, for applying a non-scanning voltage to the other scanning electrodes not selected at that time, and for applying the non-scanning voltage to all the scanning electrodes in a correction time period which is provided after scanning of said one frame;

data-electrode drive means for applying display voltages to said data electrodes, said display voltages corresponding to contents of the display data items which are input from said frame memory;

arithmetic means for calculating either of a magnitude and an application duration of a correction voltage to be applied to the respective data electrode in said correction time period in accordance with the contents of the display data items which are to be bestowed on the respective data electrodes within said scanning period of one frame; and voltage control means for outputting said correction voltage instead of said display voltage to said respective data electrode within said correction time period.

26. An apparatus for driving a liquid crystal display device as defined in claim 25, wherein said correction voltage is at a voltage level which is intermediate between a voltage level in an ON-display state and a voltage level in an OFF-display state.

* * * * *